US010908532B2

(12) United States Patent
Kikuchi et al.

(10) Patent No.: US 10,908,532 B2
(45) Date of Patent: Feb. 2, 2021

(54) NOZZLE INSERTION MEMBER, POWDER CONTAINER, AND IMAGE FORMING APPARATUS

(71) Applicant: Ricoh Company, Ltd., Tokyo (JP)

(72) Inventors: Kenji Kikuchi, Kanagawa (JP); Shinji Tamaki, Tokyo (JP); Shunji Katoh, Kanagawa (JP); Junji Yamabe, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/861,246

(22) Filed: Apr. 29, 2020

(65) Prior Publication Data

US 2020/0264537 A1 Aug. 20, 2020

Related U.S. Application Data

(63) Continuation of application No. 16/503,478, filed on Jul. 4, 2019, now Pat. No. 10,670,990, which is a (Continued)

(30) Foreign Application Priority Data

Feb. 25, 2013 (JP) ..... 2013-034830
Mar. 15, 2013 (JP) ..... 2013-054370
May 22, 2013 (JP) ..... 2013-108362

(51) Int. Cl.
*G03G 15/08* (2006.01)

(52) U.S. Cl.
CPC ..... *G03G 15/0886* (2013.01); *G03G 15/0877* (2013.01); *G03G 15/087* (2013.01); (Continued)

(58) Field of Classification Search
CPC ..... G03G 15/0832; G03G 15/0837; G03G 15/0886; G03G 15/0865–0872
See application file for complete search history.

(56) References Cited

U.S. PATENT DOCUMENTS 4,949,123 A 8/1990 Takashima
5,345,297 A 9/1994 Katakabe et al.
(Continued)

FOREIGN PATENT DOCUMENTS

EP 1 229 402 A2 8/2002
EP 1 921 512 A2 5/2008
(Continued)

OTHER PUBLICATIONS

Office Action dated Jul. 22, 2016 for European Patent Application No. 14 156 278.5.
(Continued)

*Primary Examiner* — Erika J Villaluna
(74) *Attorney, Agent, or Firm* — Xsensus LLP

(57) ABSTRACT

A nozzle insertion member is in a powder container that includes a nozzle insertion opening into which a conveying nozzle is inserted. The nozzle insertion member includes an opening/closing structure to move to an opening position to open the nozzle insertion opening by being pressed by the inserted conveying nozzle, and to a closing position to close the nozzle insertion opening when the conveying nozzle is separated from the nozzle insertion member, and a seal arranged at the nozzle insertion opening and including a through hole into which the conveying nozzle is insertable. The opening/closing structure includes a front cylindrical portion to contact with an inner surface of the through hole, and a slide area formed on another side relative to the front cylindrical portion. W1<W4 is satisfied, where W1 is an inner diameter of the through hole, and W4 is an outer diameter of the slide area.

20 Claims, 35 Drawing Sheets

Related U.S. Application Data continuation of application No. 16/028,897, filed on Jul. 6, 2018, now Pat. No. 10,401,760, which is a continuation of application No. 15/822,044, filed on Nov. 24, 2017, now Pat. No. 10,048,621, which is a continuation of application No. 15/239,356, filed on Aug. 17, 2016, now Pat. No. 9,857,729, which is a continuation of application No. 14/186,417, filed on Feb. 21, 2014, now Pat. No. 9,465,317.

(52) U.S. Cl.
CPC ..... *G03G 15/0865* (2013.01); *G03G 15/0872* (2013.01); *G03G 2215/0132* (2013.01); *G03G 2215/0678* (2013.01)

(56) References Cited

U.S. PATENT DOCUMENTS

| | | | |
|---|---|---|---|
| 5,495,323 | A | 2/1996 | Meetze, Jr. et al. |
| 5,576,816 | A | 11/1996 | Staudt et al. |
| 5,648,840 | A | 7/1997 | Ikunami et al. |
| 5,890,040 | A | 3/1999 | Matsuoka et al. |
| 5,995,782 | A | 11/1999 | Isobe et al. |
| 6,118,951 | A | 9/2000 | Kato et al. |
| 6,169,864 | B1 | 1/2001 | Baxendell et al. |
| 6,405,011 | B1 | 6/2002 | Wang et al. |
| 6,505,006 | B1 | 1/2003 | Solanki et al. |
| 6,665,505 | B2 | 12/2003 | Meetze, Jr. et al. |
| 6,665,508 | B2 | 12/2003 | Sudo |
| 6,898,405 | B2 | 5/2005 | Matsumoto et al. |
| 7,031,635 | B2 | 4/2006 | Huang et al. |
| 7,065,313 | B2 | 6/2006 | Matsumoto et al. |
| 7,079,788 | B2 | 7/2006 | Ban et al. |
| 7,248,825 | B2 | 7/2007 | Nishitani et al. |
| 7,321,744 | B2 | 1/2008 | Hosokawa et al. |
| 7,480,476 | B2 | 1/2009 | Hosokawa et al. |
| 7,519,317 | B2 | 4/2009 | Hosokawa et al. |
| 7,697,870 | B2 | 4/2010 | Hosokawa et al. |
| 7,702,262 | B2 | 4/2010 | Taguchi et al. |
| 7,706,699 | B2 | 4/2010 | Taguchi et al. |
| 7,751,737 | B2 | 7/2010 | Ishida et al. |
| 7,822,371 | B2 | 10/2010 | Taguchi et al. |
| 7,835,673 | B2 | 11/2010 | Hosokawa et al. |
| 7,853,184 | B2 | 12/2010 | Taguchi et al. |
| 7,991,334 | B2 | 8/2011 | Taguchi et al. |
| 8,005,406 | B2 | 8/2011 | Hosokawa et al. |
| 8,095,049 | B2 | 1/2012 | Ishiguro et al. |
| 8,126,373 | B2 | 2/2012 | Utsunomiya et al. |
| 8,126,375 | B2 | 2/2012 | Taguchi et al. |
| 8,195,070 | B2 | 6/2012 | Hosokawa et al. |
| 9,170,530 | B2 | 10/2015 | Oshikawa et al. |
| 2001/0021326 | A1 | 9/2001 | Yanagisawa et al. |
| 2002/0106215 | A1 | 8/2002 | Ban et al. |
| 2002/0114646 | A1 | 8/2002 | Sudo et al. |
| 2002/0122676 | A1 | 9/2002 | Yamada et al. |
| 2003/0116923 | A1 | 6/2003 | Meetze, Jr. |
| 2003/0170049 | A1 | 9/2003 | Itoh et al. |
| 2004/0223790 | A1 | 11/2004 | Hosokawa et al. |
| 2004/0223791 | A1 | 11/2004 | Yamada et al. |
| 2004/0247343 | A1 | 12/2004 | Matsumoto et al. |
| 2005/0180782 | A1 | 8/2005 | Matsumoto et al. |
| 2005/0249518 | A1 | 11/2005 | Huang et al. |
| 2006/0034642 | A1 | 2/2006 | Taguchi et al. |
| 2006/0228127 | A1 | 10/2006 | Miyabe et al. |
| 2007/0077100 | A1 | 4/2007 | Suzuki et al. |
| 2007/0077101 | A1 | 4/2007 | Tamura et al. |
| 2007/0122205 | A1 | 5/2007 | Taguchi et al. |
| 2007/0147902 | A1 | 6/2007 | Taguchi et al. |
| 2007/0154244 | A1 | 7/2007 | Taguchi et al. |
| 2007/0160394 | A1 | 7/2007 | Taguchi et al. |
| 2007/0177886 | A1 | 8/2007 | Taguchi et al. |
| 2007/0177905 | A1 | 8/2007 | Hosokawa et al. |
| 2007/0242982 | A1 | 10/2007 | Sudo et al. |
| 2008/0003021 | A1 | 1/2008 | Hosokawa et al. |
| 2008/0124133 | A1 | 5/2008 | Yoshizawa et al. |
| 2008/0286013 | A1 | 11/2008 | Hosokawa et al. |
| 2009/0047037 | A1 | 2/2009 | Miyabe et al. |
| 2009/0129813 | A1 | 5/2009 | Nagashima et al. |
| 2009/0175660 | A1 | 7/2009 | Hosokawa et al. |
| 2010/0158556 | A1 | 6/2010 | Miyabe et al. |
| 2010/0189470 | A1 | 7/2010 | Yoshizawa et al. |
| 2010/0278564 | A1 | 11/2010 | Nagashima et al. |
| 2010/0296847 | A1 | 11/2010 | Kurenuma et al. |
| 2011/0002713 | A1 | 1/2011 | Taguchi et al. |
| 2011/0026973 | A1 | 2/2011 | Hosokawa et al. |
| 2011/0044717 | A1 | 2/2011 | Miyabe et al. |
| 2011/0123232 | A1 | 5/2011 | Takashima et al. |
| 2011/0249991 | A1 | 10/2011 | Hosokawa et al. |
| 2012/0033998 | A1 | 2/2012 | Hori et al. |
| 2012/0042504 | A1 | 2/2012 | Fowler |
| 2012/0099887 | A1 | 4/2012 | Shokaku |
| 2012/0134717 | A1 | 5/2012 | Nagashima et al. |
| 2012/0134718 | A1 | 5/2012 | Nagashima et al. |
| 2012/0134719 | A1 | 5/2012 | Nagashima et al. |
| 2012/0134720 | A1 | 5/2012 | Nagashima et al. |
| 2012/0141169 | A1 | 6/2012 | Yamane et al. |
| 2012/0163877 | A1 | 6/2012 | Kikuchi et al. |
| 2012/0177395 | A1 | 7/2012 | Miyabe et al. |
| 2012/0213555 | A1 | 8/2012 | Komatsu et al. |
| 2012/0301188 | A1 | 11/2012 | Yamabe et al. |
| 2013/0136505 | A1 | 5/2013 | Nagashima et al. |
| 2013/0272750 | A1 | 10/2013 | Matsumoto et al. |
| 2013/0336680 | A1 | 12/2013 | Nagashima et al. |
| 2014/0050509 | A1 | 2/2014 | Kadota et al. |
| 2014/0169838 | A1 | 6/2014 | Nagashima et al. |
| 2014/0270859 | A1 | 9/2014 | Hosokawa et al. |
| 2015/0338775 | A1 | 11/2015 | Hosokawa et al. |

FOREIGN PATENT DOCUMENTS

| | | |
|---|---|---|
| EP | 1 927 898 A2 | 6/2008 |
| EP | 2856265 | 12/2013 |
| JP | 61-162071 | 7/1986 |
| JP | 63-178271 | 7/1988 |
| JP | 1-130159 | 9/1989 |
| JP | 04-009061 | 1/1992 |
| JP | 04-168459 | 6/1992 |
| JP | 04-243277 A | 8/1992 |
| JP | 4-368965 | 12/1992 |
| JP | 05-249825 | 9/1993 |
| JP | 05-075767 | 10/1993 |
| JP | 06-059572 | 3/1994 |
| JP | 07-020705 | 1/1995 |
| JP | 07-181788 | 7/1995 |
| JP | 07-199632 | 8/1995 |
| JP | 07-261492 | 10/1995 |
| JP | 08-220857 | 8/1996 |
| JP | 09-197819 | 7/1997 |
| JP | 09-211977 | 8/1997 |
| JP | 10-020642 | 1/1998 |
| JP | 10-153911 | 6/1998 |
| JP | 10-171230 | 6/1998 |
| JP | 10-198147 | 7/1998 |
| JP | 10-254229 | 9/1998 |
| JP | 10-260574 | 9/1998 |
| JP | 10-260575 | 9/1998 |
| JP | 2000-187382 | 7/2000 |
| JP | 2000-267420 | 9/2000 |
| JP | 2001-034053 | 2/2001 |
| JP | 2001-083785 | 3/2001 |
| JP | 2001-271912 | 10/2001 |
| JP | 2001-312130 | 11/2001 |
| JP | 2002-031943 | 1/2002 |
| JP | 2002-196629 | 7/2002 |
| JP | 2002-202656 | 7/2002 |
| JP | 2002-244417 | 8/2002 |
| JP | 3353194 | 9/2002 |
| JP | 2002-302169 | 10/2002 |
| JP | 2002-357946 | 12/2002 |
| JP | 2003-057931 | 2/2003 |
| JP | 2003-066703 | 3/2003 |
| JP | 2003-66704 | 3/2003 |
| JP | 2003-191497 | 7/2003 |

(56) References Cited

FOREIGN PATENT DOCUMENTS

| | | | |
|---|---|---|---|
| JP | 2003-195616 | | 7/2003 |
| JP | 2003-233247 | | 8/2003 |
| JP | 2003-241496 | | 8/2003 |
| JP | 2004-12687 | | 1/2004 |
| JP | 2004-280064 | | 10/2004 |
| JP | 2005-099434 | | 4/2005 |
| JP | 3665376 | | 6/2005 |
| JP | 2005-193575 | | 7/2005 |
| JP | 2005-221825 | | 8/2005 |
| JP | 2005-242185 | | 9/2005 |
| JP | 2005-331622 | | 12/2005 |
| JP | 2006-058698 | | 3/2006 |
| JP | 2006-072166 | | 3/2006 |
| JP | 2006-209060 | | 8/2006 |
| JP | 2006-235641 | | 9/2006 |
| JP | 2006-293003 | | 10/2006 |
| JP | 2006-309016 | | 11/2006 |
| JP | 2007-065271 | | 3/2007 |
| JP | 2007-065613 | | 3/2007 |
| JP | 2007-140433 | | 6/2007 |
| JP | 2007-148320 | A | 6/2007 |
| JP | 2007-178969 | | 7/2007 |
| JP | 2008-298907 | | 12/2008 |
| JP | 2009-008698 | | 1/2009 |
| JP | 2009-069417 | | 4/2009 |
| JP | 2009-116120 | | 5/2009 |
| JP | 4342958 | | 7/2009 |
| JP | 2009-223351 | | 10/2009 |
| JP | 2009-276659 | | 11/2009 |
| JP | 2010-14763 | | 1/2010 |
| JP | 2010-20343 | | 1/2010 |
| JP | 4441581 | | 3/2010 |
| JP | 2011-018550 | A | 1/2011 |
| JP | 2011-107606 | | 6/2011 |
| JP | 2011-150121 | | 8/2011 |
| JP | 4794892 | | 8/2011 |
| JP | 2011-197159 | | 10/2011 |
| JP | 2011-215473 | | 10/2011 |
| JP | 2012-018377 | | 1/2012 |
| JP | 4958325 | | 3/2012 |
| JP | 2012-93460 | | 5/2012 |
| JP | 2012-133349 | | 7/2012 |
| JP | 2012-137740 | | 7/2012 |
| JP | 2013-113945 | A | 6/2013 |
| RU | 2 372 635 | C2 | 11/2009 |
| RU | 2 398 257 | C2 | 8/2010 |
| RU | 2 445 246 | C2 | 3/2012 |
| TW | 201011480 | | 3/2010 |
| TW | 201205209 | | 2/2012 |
| WO | 2006/132259 | | 12/2006 |
| WO | WO 2012/074139 | | 6/2012 |
| WO | 2013/077474 | | 5/2013 |
| WO | WO 2014/142362 | | 9/2014 |

OTHER PUBLICATIONS

Office Action dated Apr. 26, 2016 for Taiwanese Application No. 103131631 and English translation thereof.

Office Action dated Jan. 6, 2016 for Korean Application No. 10 2014-7032139 and English translation thereof.

Russian Decision on Grant dated Mar. 10, 2016 with an English translation thereof for Russian Application No. 2014125562.

Extended European Search Report dated Feb. 8, 2016 for European Patent Application No. 14762332.6.

Office Action dated Jan. 28, 2016 for corresponds Taiwan Application No. 103106106 with English translation.

Office Action dated Jul. 7, 2015 in Japanese Patent Application No. 2013-116876.

Extended European Search Report dated Apr. 1, 2015 in Patent Application No. 12851714.1.

International Search Report dated Jan. 8, 2013 in PCT/JP2012/081219.

International Written Opinion dated Jan. 8, 2013 in PCT/JP2012/081219.

Office Action dated Apr. 21, 2015 in Japanese Patent Application No. 2011-197303.

Office Action dated Jan. 20, 2015 in Australian Patent Application No. 2011337578.

Office Action dated Jun. 26, 2014 in Russian Patent Application No. 2013130231/28 (with English translation).

Extended European Search Report dated Jun. 18, 2014 in Patent Application No. 11845366.1.

Office Action dated Jul. 23, 2013 in Japanese Patent Application No. 2011-262861.

Office Action dated Nov. 5, 2013 in Japanese Patent Application No. 2011-262861.

Office Action dated Apr. 25, 2014 in Taiwanese Patent Application No. 100144415.

Office Action dated Jan. 15, 2014 in Canadian Patent Application No. 2,795,123.

International Search Report dated Jan. 17, 2012 in PCT/JP2011/078626.

European Search Report dated Apr. 1, 2015 in Patent Application No. 13800861.0.

International Search Report dated Aug. 13, 2013 in PCT/JP2013/065901.

International Search Report dated Jun. 17, 2014 in PCT/JP2014/057949.

Office Action dated Sep. 10, 2013 in Japanese Patent Application No. 2013-110330.

Office Action dated Apr. 22, 2014 in Japanese Patent Application No. 2013-153815.

Office Action dated Nov. 26, 2013 in Japanese Patent Application No. 2013-153815.

Office Action dated Apr. 29, 2015 for corresponds Russian Application No. 2014106826/28 with English translation.

Office Action dated Sep. 3, 2013 in Japanese Patent Application No. 2013-034830.

Indian Office Action dated Dec. 5, 2013, issued Indian Patent Application No. 230/KOL/2014 (with English translation).

Extended European Search Report dated Jan. 31, 2018, for corresponding European Application No. 17194955.5.

Decision on Grant of a Patent for Invention dated Mar. 26, 2018 in corr. Russian Patent App. No. 2017115968, filed May 5, 2017 (w/English translation).

FIG.40

| | SEAL FORM | SEAL INNER DIAMETER | SHUTTER FRONT DIAMETER | SEAL DEFORMATION AMOUNT | PORON THICKNESS | MOLTPREN THICKNESS | TONER LEAKAGE | SLIDING HEAT |
|---|---|---|---|---|---|---|---|---|
| 1 | ENTIRE SURFACE CONTACT | φ13.4 | φ15.8 | 2.2 | 3 | 4 | ◎ | - |
| 2 | ENTIRE SURFACE CONTACT | φ13.4 | φ15.3 | 1.9 | 3 | 4 | ○ | - |
| 3 | ENTIRE SURFACE CONTACT | φ13.4 | φ15.2 | 1.8 | 3 | 4 | ○ | ○ |
| 4 | PARTIAL SURFACE CONTACT | φ13.4 | φ15.6 | 2.2 | 3 | 4 | ○ | - |
| 5 | ENTIRE SURFACE CONTACT | φ13.4 | φ15.6 | 2.2 | 2 | 5 | ○ | - |
| 6 | ENTIRE SURFACE CONTACT | φ13.4 | φ15.3 | 1.9 | 2 | 5 | ○ | - |
| 7 | ENTIRE SURFACE CONTACT | φ13.4 | φ15.2 | 1.8 | 2 | 5 | ○ | ○ |
| 8 | ENTIRE SURFACE CONTACT | φ13.4 | φ15 | 1.6 | 2 | 5 | ○ | ○ |
| 9 | PARTIAL SURFACE CONTACT | φ13.4 | φ15.6 | 2.2 | 2 | 5 | ○ | - |
| 10 | POINT CONTACT | φ13.4 | φ15.6 | 2.2 | 2 | 5 | △ | - |
| 11 | POINT CONTACT | φ13.4 | φ15.4 | 2 | 2 | 5 | △ | - |
| 12 | POINT CONTACT | φ13.4 | φ15.2 | 1.8 | 2 | 5 | △ | - |
| 13 | POINT CONTACT | φ14 | φ15 | 1 | 2 | 5 | × | - |
| 14 | POINT CONTACT | φ14.4 | φ15 | 0.6 | 2 | 5 | × | - |
| | | [mm] | [mm] | [mm] | [mm] | [mm] | | |

NOZZLE INSERTION MEMBER, POWDER CONTAINER, AND IMAGE FORMING APPARATUS

CROSS-REFERENCE TO RELATED APPLICATIONS

The present application is a continuation of U.S. application Ser. No. 16/503,478, filed Jul. 4, 2019, which is a continuation of U.S. application Ser. No. 16/028,897, filed Jul. 6, 2018 (now U.S. Pat. No. 10,401,760), which is a continuation of U.S. application Ser. No. 15/822,044, filed Nov. 24, 2017 (now U.S. Pat. No. 10,048,621), which is a continuation of U.S. application Ser. No. 15/239,356, filed Aug. 17, 2016 (now U.S. Pat. No. 9,857,729), which is a continuation of U.S. application Ser. No. 14/186,417, filed Feb. 21, 2014 (now U.S. Pat. No. 9,465,317), which claims priority to Japanese Patent Application No. 2013-034830, filed Feb. 25, 2013, Japanese Patent Application No. 2013-054370, filed Mar. 15, 2013, and Japanese Patent Application No. 2013-108362, filed May 22, 2013. The entire contents of each of the above applications are hereby incorporated by reference in entirety. The present application also incorporates by reference the entire contents of International Publication No. WO2013/183782, which designates the United States.

BACKGROUND OF THE INVENTION

1. Field of the Invention

The present invention relates to a powder container, a nozzle insertion member attached to the powder container, and an image forming apparatus including the powder container.

2. Description of the Related Art

In electrophotographic image forming apparatuses, a toner replenishing device supplies (replenishes) toner, which serves as developer that is powder, from a toner container, which serves as a powder container for storing the developer, to a developing device. A toner container disclosed in Japanese Patent Application Laid-open No. 2012-133349 includes a rotatable cylindrical powder storage, a conveying nozzle receiver fixed to the powder storage, an opening arranged in the conveying nozzle receiver, and an opening/closing member that moves to a closing position to close the opening and an opening position to open the opening along with insertion of the conveying nozzle of the powder replenishing device. When the toner container is attached to the powder replenishing device, the conveying nozzle is inserted in the toner container and the conveyor conveys the toner to the developing device. Therefore, the toner adheres to the opening/closing member, the conveying nozzle receiver, and the conveying nozzle located inside the toner container. Therefore, it is preferable to prevent a cohesion of the adhered toner from being formed and conveyed to the inside of the image forming apparatus along with rotation of the toner container, in order to prevent generation of abnormal images with large drops splattered on a white background (so-called black-spot images).

SUMMARY OF THE INVENTION

An object of the present invention is to prevent powder cohesion with a simple structure.

According to an embodiment, a nozzle insertion member arranged in a powder container includes a nozzle insertion opening into which a conveying nozzle for conveying powder supplied from the powder container is inserted. The nozzle insertion member includes an opening/closing member, a supporting member, and a biasing member. The opening/closing member moves to an opening position so as to open the nozzle insertion opening by being pressed by the conveying nozzle thus inserted, and to a closing position so as to close the nozzle insertion opening when the conveying nozzle is separated from the nozzle insertion member. The supporting member supports the opening/closing member so as to guide the opening/closing member to the opening position and the closing position. The supporting member is formed with an opening thereon. The biasing member is provided to the supporting member and biases the opening/closing member toward the closing position. When the powder in the powder container is supplied to the conveying nozzle inserted into the nozzle insertion opening along with rotation of a rotary conveyor arranged inside the powder container, the supporting member rotates with the rotation of the rotary conveyor. The opening/closing member is rotated by a drive transmitting mechanism along with rotation of the supporting member. The drive transmitting mechanism includes an elongated member that is arranged on the opening/closing member so as to extend in a longitudinal direction of the conveying nozzle and that penetrates through the opening formed on the supporting member; a drive transmitted portion formed on the elongated member; and a drive transmitting portion that is formed on an inner surface of the opening and that is configured to come into contact with the drive transmitted portion.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 40 illustrates a toner leakage evaluation result obtained by performing a drop test on a powder container when the form of the sealing member is modified;

DETAILED DESCRIPTION OF THE PREFERRED EMBODIMENTS

Figure 1:
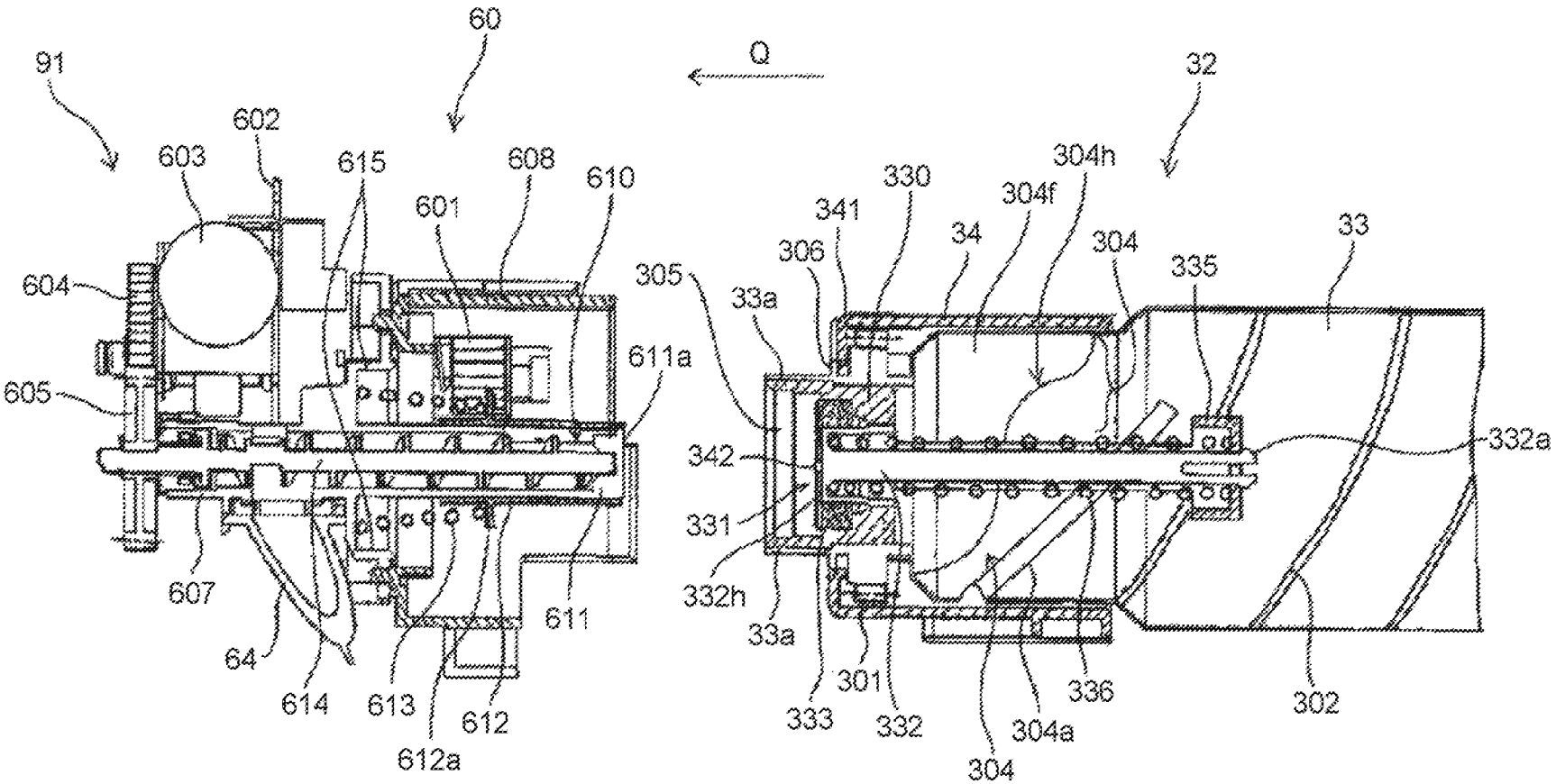
FIG. 1 is an explanatory cross-sectional view of a powder replenishing device before a powder container common to all of embodiments is attached and the powder container.

Various embodiments of the present invention will be explained below with reference to the accompanying drawings. In the embodiments, the same components or components with the same functions are denoted by the same reference numerals and symbols, and the same explanation will not be repeated. The descriptions below are mere examples and do not limit the scope of the appended claims. In the drawings, Y, M, C, and K are symbols appended to components corresponding to yellow, magenta, cyan, and black, respectively, and will be omitted appropriately.

First, a configuration common to all of the embodiments will be explained below.

Figure 2:
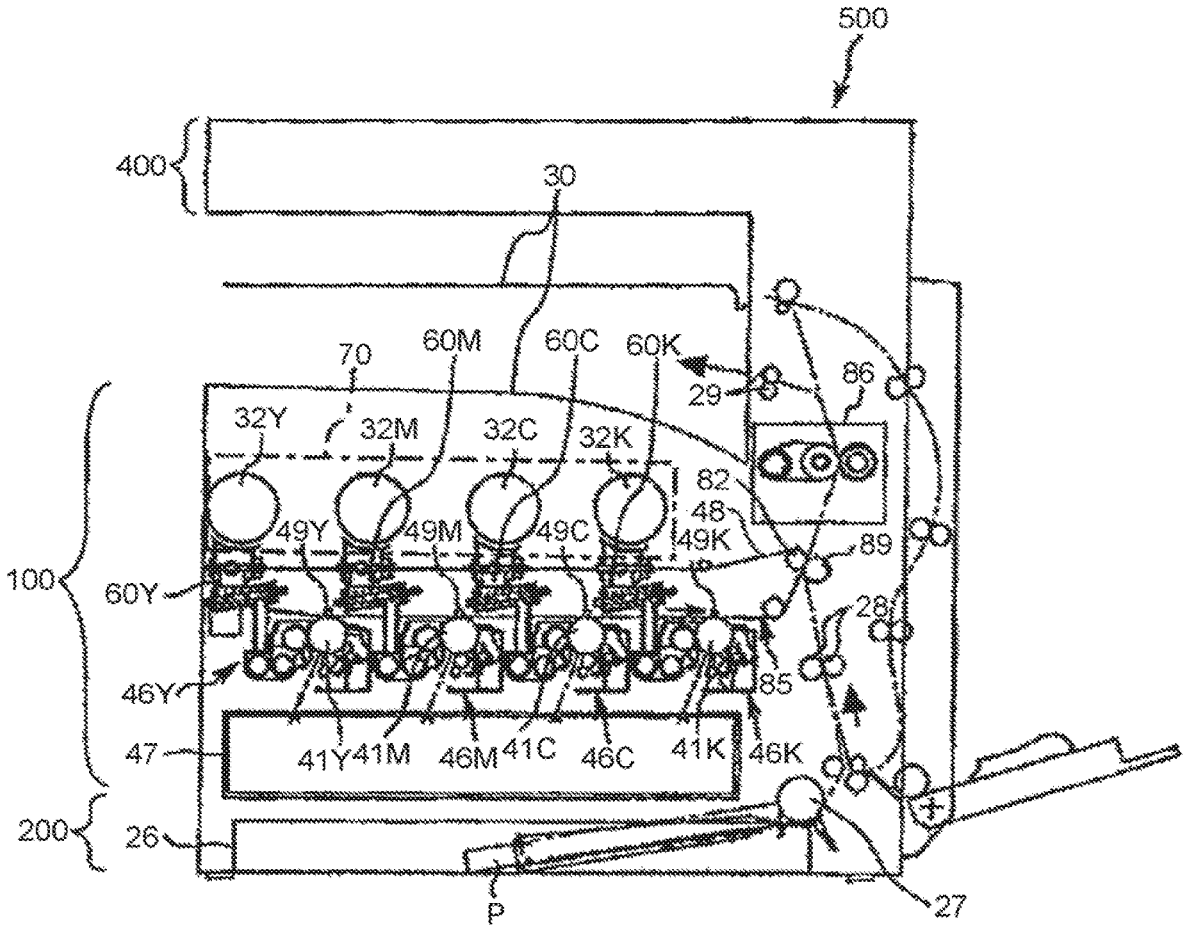
FIG. 2 is a diagram illustrating an example of an overall configuration of an image forming apparatus common to all of the embodiments.

FIG. 2 is an overall configuration diagram of a copier 500 serving as an image forming apparatus according to the embodiments. The copier 500 includes a printer 100, a feed table (hereinafter, referred to as a sheet feeder 200), and a scanner (hereinafter, referred to as a scanner section 400) mounted on the printer 100.

Four toner containers 32 (Y, M, C, K) serving as powder containers corresponding to different colors (yellow, magenta, cyan, black) are detachably (replaceably) attached to a toner container holder 70 serving as a container holding section provided in the upper side of the printer 100. An intermediate transfer device 85 is arranged below the toner container holder 70.

The intermediate transfer device 85 includes an intermediate transfer belt 48 serving as an intermediate transfer medium, four primary-transfer bias rollers 49 (Y, M, C, K), a secondary-transfer backup roller 82, multiple tension rollers, an intermediate-transfer cleaning device, and the like. The intermediate transfer belt 48 is stretched and supported by multiple roller members and endlessly moves in the arrow direction in FIG. 2 along with rotation of the secondary-transfer backup roller 82 that serves as one of the roller members.

In the printer 100, four image forming sections 46 (Y, M, C, K) corresponding to the respective colors are arranged in tandem so as to face the intermediate transfer belt 48. Four toner replenishing devices 60 (Y, M, C, K) serving as powder replenishing devices corresponding to the four toner containers 32 (Y, M, C, K) of the respective colors are arranged below the toner containers 32. The toner replenishing devices 60 (Y, M, C, K) respectively supply (replenish) toner that is powder developer contained in the toner containers 32 (Y, M, C, K) to developing devices of the image forming sections 46 (Y, M, C, K) for the respective colors.

As illustrated in FIG. 2, the printer 100 includes an exposing device 47 serving as a latent-image forming device below the four image forming sections 46. The exposing device 47 exposes and scans the surfaces of photoconductors 41 (Y, M, C, K) serving as image bearers (to be described later) with light based on image information of an original image read by the scanner section 400, so that electrostatic latent images are formed on the surfaces of the photoconductors. The image information may be input from an external apparatus, such as a personal computer, connected to the copier 500, instead of being read by the scanner section 400.

In the embodiment, a laser beam scanning system using a laser diode is employed as the exposing device 47. However, other configurations, such as a configuration including an LED array, may be employed as an exposing unit.

Figure 3:
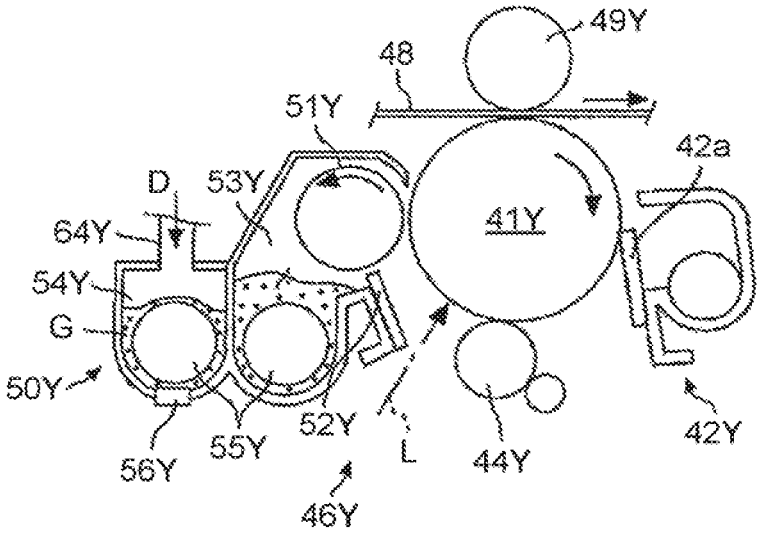
FIG. 3 is a schematic diagram illustrating a structure of an image forming section of the image forming apparatus illustrated in FIG. 2.

FIG. 3 is a schematic diagram illustrating an overall configuration of the image forming section 46Y for yellow.

The image forming section 46Y includes a drum-shaped photoconductor 41Y serving as an image bearer. The image forming section 46Y includes a charging roller 44Y serving as a charging unit, a developing device 50Y serving as a developing unit, a photoconductor cleaning device 42Y, and a neutralizing device, which are arranged around the photoconductor 41Y. Image forming processes (a charging process, an exposing process, a developing process, a transfer process, and a cleaning process) are performed on the photoconductor 41Y, so that a yellow toner image is formed on the photoconductor 41Y.

The other three image forming sections 46 (M, C, K) have almost the same configurations as the image forming section 46Y for yellow except that colors of toner to be used are different, and images corresponding to the respective toner colors are formed on the photoconductors 41 (M, C, K). Hereinafter, explanation of only the image forming section 46Y for yellow will be given, and explanation of the other three image forming sections 46 (M, C, K) will be omitted appropriately.

The photoconductor 41Y is rotated clockwise in FIG. 3 by a drive motor. The surface of the photoconductor 41Y is uniformly charged at a position facing the charging roller 44Y (charging process). Subsequently, the surface of the photoconductor 41Y reaches a position of irradiation with laser light L emitted by the exposing device 47, where an electrostatic latent image for yellow is formed through exposure scanning (exposing process). The surface of the photoconductor 41Y then reaches a position facing the developing device 50Y, where the electrostatic latent image is developed to form a yellow toner image (developing device).

The four primary-transfer bias rollers 49 (Y, M, C, K) of the intermediate transfer device 85 and the photoconductors 41 (Y, M, C, K) sandwich the intermediate transfer belt 48, so that primary transfer nips are formed. A transfer bias with polarity opposite to the polarity of toner is applied to the primary-transfer bias rollers 49 (Y, M, C, K).

The surface of the photoconductor 41Y, on which the toner image is formed through the developing process, reaches the primary transfer nip facing the primary-transfer bias roller 49Y across the intermediate transfer belt 48, and the toner image on the photoconductor 41Y is transferred to the intermediate transfer belt 48 at the primary transfer nip (primary transfer process). At this time, a slight amount of non-transferred toner remains on the photoconductor 41Y. The surface of the photoconductor 41Y, from which the toner image has been transferred to the intermediate transfer belt 48 at the primary transfer nip, reaches a position facing the photoconductor cleaning device 42Y. At this position, the non-transferred toner remaining on the photoconductor 41Y is mechanically collected by a cleaning blade 42*a* included in the photoconductor cleaning device 42Y (cleaning process). The surface of the photoconductor 41Y finally reaches a position facing the neutralizing device, where the residual potential on the photoconductor 41Y is removed. In this way, a series of image forming processes performed on the photoconductor 41Y is completed.

The above image forming processes are also performed on the other image forming sections 46 (M, C, K) in the same manner as the image forming section 46Y for yellow. Specifically, the exposing device 47 arranged below the image forming sections 46 (M, C, K) emits laser light L based on image information toward the photoconductors 41 (M, C, K) of the image forming sections 46 (M, C, K). More specifically, the exposing device 47 emits the laser light L from a light source and irradiates each of the photoconductors 41 (M, C, K) with the laser light L via multiple optical elements while performing scanning with the laser light L by a rotating polygon mirror. Subsequently, toner images of the respective colors formed on the photoconductors 41 (M, C, K) through the developing process are transferred to the intermediate transfer belt 48.

At this time, the intermediate transfer belt 48 moves in the arrow direction in FIG. 2 and sequentially passes through the primary transfer nips of the primary-transfer bias rollers 49 (Y, M, C, K). Therefore, the toner images of the respective colors on the photoconductors 41 (Y, M, C, K) are superimposed on the intermediate transfer belt 48 as primary transfer, so that a color toner image is formed on the intermediate transfer belt 48.

The intermediate transfer belt 48, on which the color toner image is formed by superimposing the toner images of the respective colors, reaches a position facing a secondary transfer roller 89. At this position, the secondary-transfer backup roller 82 and the secondary transfer roller 89 sandwich the intermediate transfer belt 48, so that a secondary transfer nip is formed. The color toner image formed on the intermediate transfer belt 48 is transferred to a recording medium P, such as a sheet of paper, conveyed to the position of the secondary transfer nip, due to, for example, the action of a transfer bias applied to the secondary-transfer backup roller 82. At this time, non-transferred toner which has not been transferred to the recording medium P remains on the intermediate transfer belt 48. The intermediate transfer belt 48 that has passed through the secondary transfer nip reaches the position of the intermediate-transfer cleaning device, where the non-transferred toner on the surface is collected. In this way, a series of transfer processes performed on the intermediate transfer belt 48 is completed.

Movement of the recording medium P will be explained below.

The recording medium P is conveyed to the secondary transfer nip from a feed tray 26 provided in the sheet feeder 200 arranged below the printer 100 via a feed roller 27, a registration roller pair 28, and the like. Specifically, multiple recording media P are stacked in the feed tray 26. When the feed roller 27 is rotated counterclockwise in FIG. 2, the topmost recording medium P is fed to a nip between two rollers of the registration roller pair 28.

The recording medium P conveyed to the registration roller pair 28 temporarily stops at the position of the nip between the rollers of the registration roller pair 28, the rotation of which is being stopped. The registration roller pair 28 is rotated to convey the recording medium P toward the secondary transfer nip in accordance with the timing at which the color toner image on the intermediate transfer belt 48 reaches the secondary transfer nip. Accordingly, a desired color image is formed on the recording medium P.

The recording medium P on which the color toner image is transferred at the secondary transfer nip is conveyed to the position of a fixing device 86. In the fixing device 86, the color toner image transferred on the surface of the recording medium P is fixed to the recording medium P by heat and pressure applied by a fixing belt and a pressing roller. The recording medium P that has passed through the fixing device 86 is discharged to the outside of the apparatus via a nip between rollers of a discharge roller pair 29. The recording medium P discharged to the outside of the apparatus by the discharge roller pair 29 is sequentially stacked, as an output image, on a stack section 30. In this way, a series of image forming processes in the copier 500 is completed.

A configuration and operation of the developing device 50 in the image forming section 46 will be explained in detail below. In the following, the image forming section 46Y for yellow will be explained by way of example. However, the image forming sections 46 (M, C, K) for the other colors have the same configurations and perform the same operation.

As illustrated in FIG. 3, the developing device 50Y includes a developing roller 51Y serving as a developer bearer, a doctor blade 52Y serving as a developer regulating plate, two developer conveying screws 55Y, a toner density sensor 56Y, and the like. The developing roller 51Y faces the photoconductor 41Y. The doctor blade 52Y faces the developing roller 51Y. The two developer conveying screws 55Y are arranged inside two developer accommodating parts (53Y, 54Y). The developing roller 51Y includes a magnet roller fixed inside thereof and a sleeve that rotates around the magnet roller. Two-component developer G formed of carrier and toner is stored in the first developer accommodating part 53Y and the second developer accommodating part 54Y. The second developer accommodating part 54Y communicates with a toner dropping passage 64Y via an opening formed in the upper side thereof. The toner density sensor 56Y detects toner density in the developer G stored in the second developer accommodating part 54Y.

The developer G in the developing device 50 circulates between the first developer accommodating part 53Y and the second developer accommodating part 54Y while being stirred by the two developer conveying screws 55Y. The developer G in the first developer accommodating part 53Y is supplied to and borne on the surface of the sleeve of the developing roller 51Y due to the magnetic field formed by the magnet roller in the developing roller 51Y while the developer G is being conveyed by one of the developer conveying screws 55Y. The sleeve of the developing roller 51Y rotates counterclockwise as indicated by an arrow in FIG. 3, and the developer G borne on the developing roller 51Y moves on the developing roller 51Y along with the rotation of the sleeve. At this time, the toner in the developer G electrostatically adheres to the carrier by being charged to the potential opposite to the polarity of the carrier due to triboelectric charging with the carrier in the developer G, and is borne on the developing roller 51Y together with the carrier that is attracted by the magnetic field formed on the developing roller 51Y.

The developer G borne on the developing roller 51Y is conveyed in the arrow direction in FIG. 3 and reaches a doctor section where the doctor blade 52Y and the developing roller 51Y face each other. The amount of the developer G on the developing roller 51Y is regulated and adjusted to an appropriate amount when the developer G passes through the doctor section, and then conveyed to a development area facing the photoconductor 41Y. In the development area, the toner in the developer G adheres to the latent image formed on the photoconductor 41Y by a developing electric field formed between the developing roller 51Y and the photoconductor 41Y. The developer G remaining on the surface of the developing roller 51Y that has passed through the development area reaches the upper side of the first developer accommodating part 53Y along with the rotation of the sleeve. At this position, the developer G is separated from the developing roller 51Y.

The toner density of the developer G in the developing device 50Y is adjusted to a predetermined range. Specifically, toner contained in the toner container 32Y is supplied to the second developer accommodating part 54Y via the toner replenishing device 60Y (to be described later) in accordance with the amount of toner consumed from the developer G in the developing device 50Y through the development. The toner supplied to the second developer accommodating part 54Y circulates between the first developer accommodating part 53Y and the second developer accommodating part 54Y while being mixed and stirred with the developer G by the two developer conveying screws 55Y.

The toner replenishing devices 60 (Y, M, C, K) will be explained below.

Figure 4:
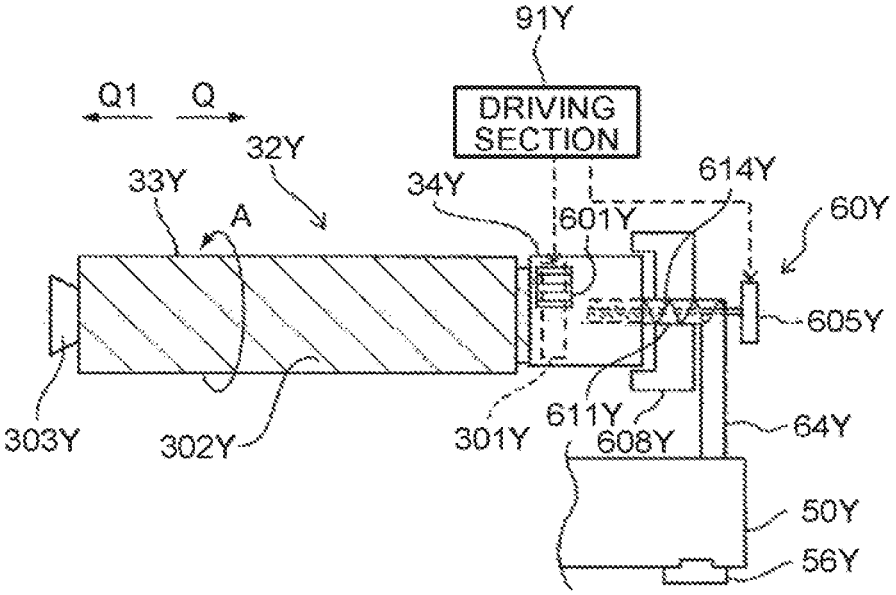
FIG. 4 is a schematic diagram illustrating a state in which the powder container is attached to the powder replenishing device of the image forming apparatus illustrated in FIG. 2.
Figure 5:
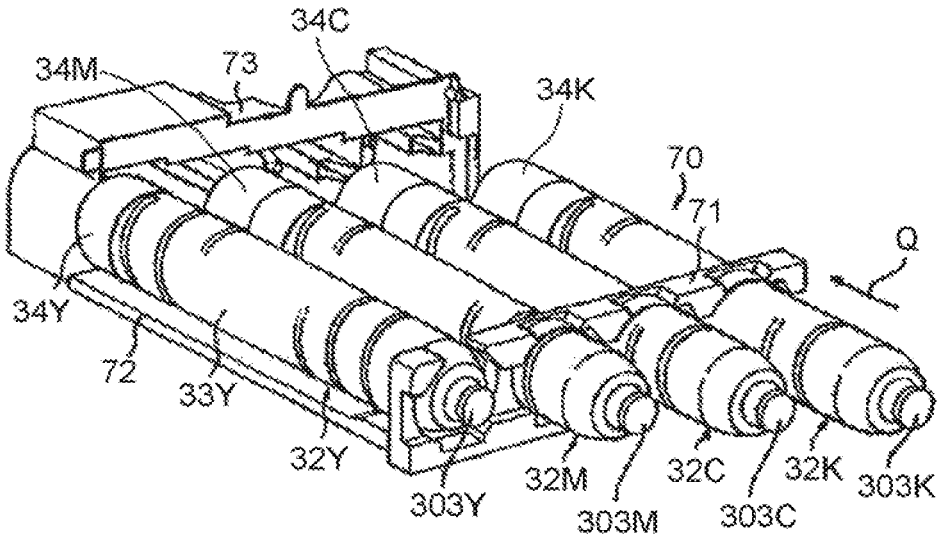
FIG. 5 is a schematic perspective view illustrating a state in which the powder container is attached to a container holding section.

FIG. 4 is a schematic diagram illustrating a state in which the toner container 32Y is attached to the toner replenishing device 60Y. FIG. 5 is a schematic perspective view illustrating a state in which the four toner containers 32 (Y, M, C, K) are attached to the toner container holder 70.

Toner contained in the toner containers 32 (Y, M, C, K) attached to the toner container holder 70 of the printer 100 is appropriately supplied to the developing devices 50 (Y, M, C, K) in accordance with the consumption of toner in the developing devices 50 (Y, M, C, K) for the respective colors as illustrated in FIG. 4. At this time, toner in the toner containers 32 (Y, M, C, K) is replenished by the toner replenishing devices 60 (Y, M, C, K) provided for the respective colors. The four toner replenishing devices 60 (Y, M, C, K) have almost the same configurations and the toner containers 32 (Y, M, C, K) have almost the same configurations, except that colors of toner used for the image forming processes are different. Therefore, only the toner replenishing device 60Y and the toner container 32Y for yellow will be explained below, and explanation of the toner replenishing devices 60 (M, C, K) and the toner containers 32 (M, C, K) for the other three colors will be omitted appropriately.

The toner replenishing device 60 (Y, M, C, K) includes the toner container holder 70, a conveying nozzle 611 (Y, M, C, K) serving as a conveying tube, a conveying screw 614 (Y, M, C, K) serving as a main body conveyor, the toner dropping passage 64 (Y, M, C, K), and a container driving section 91 (Y, M, C, K).

For convenience of explanation, in a direction in which the toner container 32Y is attached to the toner replenishing device 60Y, an opening 33*a* (container opening) side of a container body 33 serving as a powder storage (to be described later) is referred to as a container front end, and a side opposite to the opening 33*a* (a gripper 303Y side (to be described later)) is referred to as a container rear end. When the toner container 32Y is moved in the arrow Q direction in FIG. 4 and attached to the toner container holder 70 of the printer 100, the conveying nozzle 611Y of the toner replenishing device 60Y is inserted from the front end of the toner container 32Y along with the attachment operation. Consequently, the toner container 32Y and the conveying nozzle 611Y communicate with each other. A configuration for the communication along with the attachment operation will be described in detail later.

As an embodiment of the toner container, the toner container 32Y is a toner bottle in the form of an approximate cylinder. The toner container 32Y mainly includes a container front end cover 34Y serving as a container cover that is non-rotatably held by the toner container holder 70, and includes a container body 33Y serving as the powder storage integrated with a container gear 301Y. The container body 33Y is held so as to rotate relative to the container front end cover 34Y.

As illustrated in FIG. 5, the toner container holder 70 mainly includes a container cover receiving section 73, a container receiving section 72, and an insertion hole part 71. The container cover receiving section 73 is a section for holding the container front end cover 34Y of the toner container 32Y. The container receiving section 72 is a section for supporting the container body 33Y of the toner container 32Y. The insertion hole part 71 forms an insertion hole used in the attachment operation of the toner container 32Y. When a body cover arranged on the front side of the copier 500 (the front side in the direction normal to the sheet of FIG. 2) is opened, the insertion hole part 71 of the toner container holder 70 is exposed. Attachment/detachment operation of each of the toner containers 32 (Y, M, C, K) (attachment/detachment operation with the longitudinal direction of the toner containers 32 taken as an attachment/detachment direction) is performed from the front side of the copier 500 while each of the toner containers 32 (Y, M, C, K) is oriented with its longitudinal direction made parallel to the horizontal direction. A setting cover 608Y in FIG. 4 is a part of the container cover receiving section 73 of the toner container holder 70.

The container receiving section 72 is formed such that its longitudinal length becomes approximately the same as the longitudinal length of the container body 33Y. The container cover receiving section 73 is arranged on a container front end of the container receiving section 72 in the longitudinal direction (attachment/detachment direction) and the insertion hole part 71 is arranged on one end of the container receiving section 72 in the longitudinal direction. In FIG. 5, gutters, in other words, grooves, continuing from the insertion hole part 71 to the container cover receiving section 73 are formed just below the four toner containers 32, respectively, such that the longitudinal side goes along the axial direction of the container body 33. Sliding guides 361 as a pair (FIG. 7) are formed on the both lower sides of the container front end cover 34 so as to enable sliding movement while being engaged with the gutter. Sliding rails as a pair protrude on both sides of each of the gutters of the container receiving section 72. Sliding gutters 361*a*, that is, sliding grooves, parallel to the rotation axis of the container body 33 are formed on the sliding guides 361 so as to sandwich the pair of sliding rails from above and below. Furthermore, the container front end cover 34 includes container engaged portions 339 that are engaged with replenishing device engaging members 609 provided on the setting cover 608 when attached to the toner replenishing device 60.

Therefore, along with the attachment operation of the toner container 32Y, the container front end cover 34Y first passes through the insertion hole part 71, slides on the container receiving section 72 for a while, and is finally attached to the container cover receiving section 73.

Furthermore, the container front end cover 34 includes an integrated circuit (IC) tag 700 that is an IC chip or an information storage device for recording data, such as usage data, of the toner container 32. The container front end cover 34 also includes a color-specific rib 34*b* that is a color identifying protrusion for preventing the toner container 32 containing toner of a certain color from being attached to the setting cover 608 of a different color. The sliding guides 361 are engaged with the sliding rails of the container receiving section 72 at the time of attachment, so that the posture of the container front end cover 34 on the toner replenishing device 60 is determined. Therefore, the positioning between the container engaged portions 339 and the replenishing device engaging members 609 and the positioning between the IC tag 700 and a connector 800 of the main body can be performed smoothly.

Figure 8:
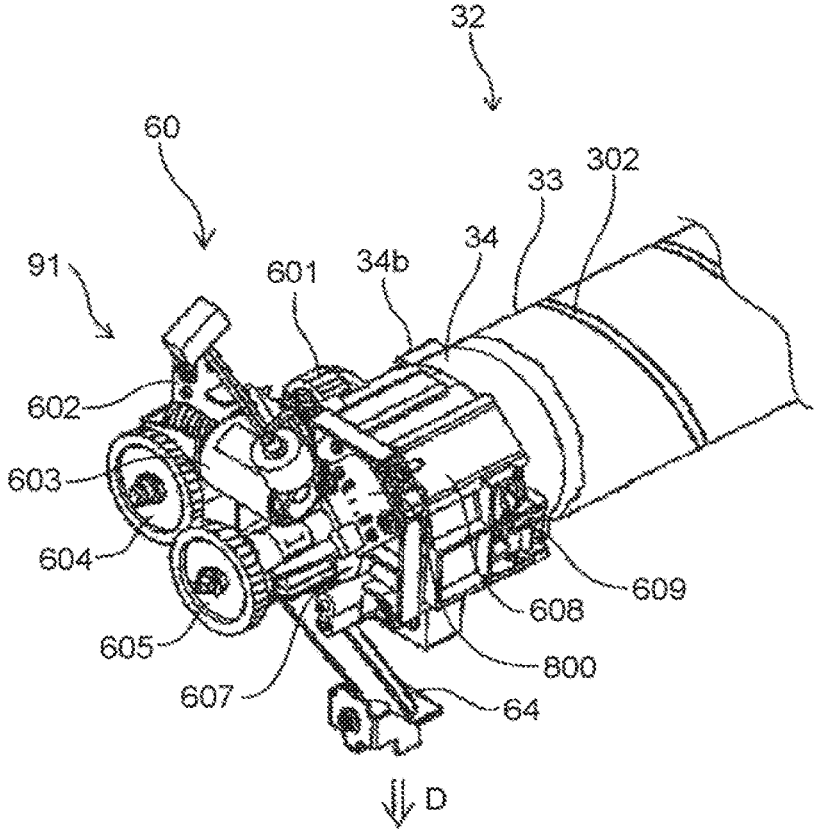
FIG. 8 is an explanatory perspective view of the powder replenishing device to which the powder container is attached and the powder container.

While the container front end cover 34Y is attached to the container cover receiving section 73, the container driving section 91Y including a driving motor 603, a driving gear, or the like as illustrated in FIG. 8 inputs rotation drive to the container gear 301Y (FIG. 10) provided in the container body 33Y via a container driving gear 601Y. Accordingly, the container body 33Y rotates in the arrow A direction in FIG. 4. With the rotation of the container body 33Y, a spiral rib 302Y serving as a rotary conveyor formed in a spiral shape on the inner surface of the container body 33Y rotates, so that toner stored in the container body 33Y is conveyed from one end located on the left side (the gripper 303 side) to the other end located on the right side (the opening 33*a* side) in FIG. 4 along the longitudinal direction of the container body. Consequently, the toner is supplied from the container front end cover 34Y side, which is on the other end of the container body 33, to the inside of the conveying nozzle 611Y. In other words, with the rotation of the spiral rib 302Y, the toner is supplied to the conveying nozzle 611Y inserted in a receiving opening 331Y serving as a nozzle insertion opening.

The conveying screw 614Y is arranged in the conveying nozzle 611Y. When the container driving section 91Y inputs rotation drive to a conveying screw gear 605Y, the conveying screw 614Y rotates and the toner supplied in the conveying nozzle 611Y is conveyed. A downstream end of the conveying nozzle 611Y in the conveying direction is connected to the toner dropping passage 64Y. The toner conveyed by the conveying screw 614Y falls along the toner dropping passage 64Y by gravity and is supplied to the developing device 50Y (the second developer accommodating part 54Y).

The toner containers 32 (Y, M, C, K) are replaced with new ones at the end of their lifetimes (when the container becomes empty because almost all of contained toner is consumed). The gripper 303 is arranged on one end of the toner container 32 opposite the container front end cover 34 in the longitudinal direction. When the toner container 32 is to be replaced, an operator can grip the gripper 303 to pull out and detach the attached toner container 32.

The toner replenishing device 60Y controls the amount of toner supplied to the developing device 50Y in accordance with the rotation frequency of the conveying screw 614Y. Therefore, toner that passes through the conveying nozzle 611Y is directly conveyed to the developing device 50Y via the toner dropping passage 64Y without controlling the supply amount of toner to the developing device 50Y. Even in the toner replenishing device 60Y configured to insert the conveying nozzle 611Y into the toner container 32Y as described in the embodiments, it may be possible to provide a temporary toner storage, such as a toner hopper.

Furthermore, while the toner replenishing device 60Y according to the embodiments includes the conveying screw 614Y for conveying the toner supplied in the conveying nozzle 611Y, the configuration for conveying the toner supplied in the conveying nozzle 611Y is not limited to the screw. It may be possible to apply a conveying force by using other than the screw, for example, by using a well-known powder pump for generating a negative pressure at the opening of the conveying nozzle 611Y.

The toner containers 32 (Y, M, C, K) and the toner replenishing devices 60 (Y, M, C, K) according to the embodiments will be explained in detail below. As described above, the toner containers 32 (Y, M, C, K) and the toner replenishing devices 60 (Y, M, C, K) have almost the same configurations except that colors of toner to be used are different. Therefore, in the following explanation, symbols Y, M, C, and K representing the colors of toner will be omitted.

Figure 6:
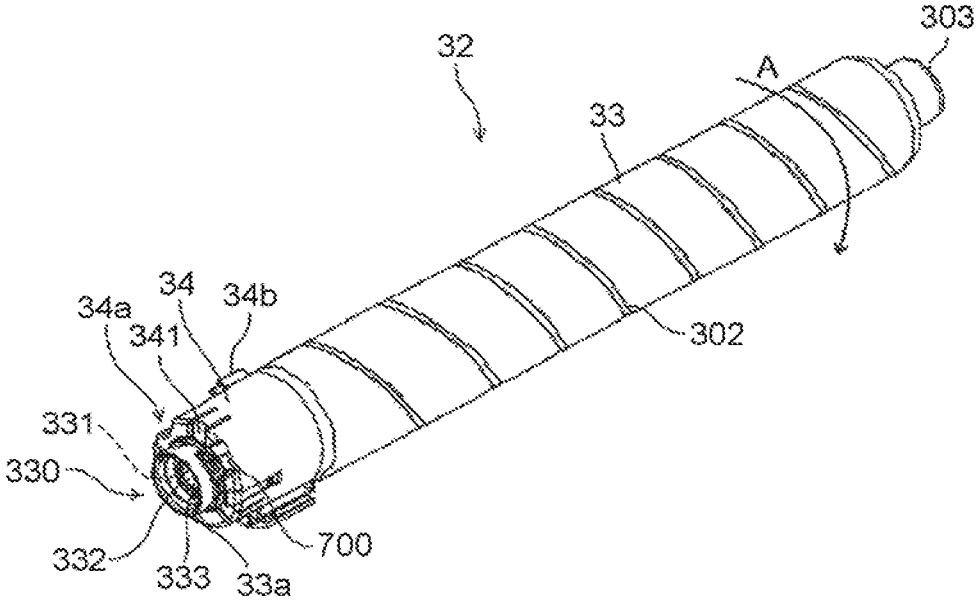
FIG. 6 is an explanatory perspective view illustrating a structure of the powder container common to all of the embodiments.
Figure 7:
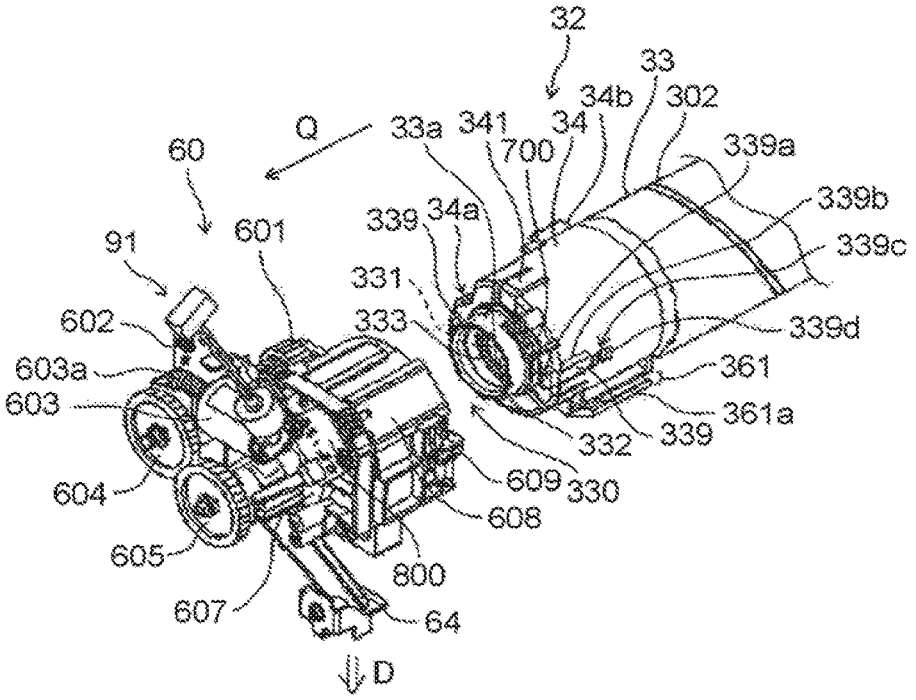
FIG. 7 is an explanatory perspective view of the powder replenishing device before the powder container is attached and the powder container.

FIG. 6 is an explanatory perspective view of the toner container 32. FIG. 7 is an explanatory perspective view of the toner replenishing device 60 before the toner container 32 is attached and a front end of the toner container 32. FIG. 8 is an explanatory perspective view of the toner replenishing device 60 to which the toner container 32 is attached and the front end of the toner container 32.

Figure 9:
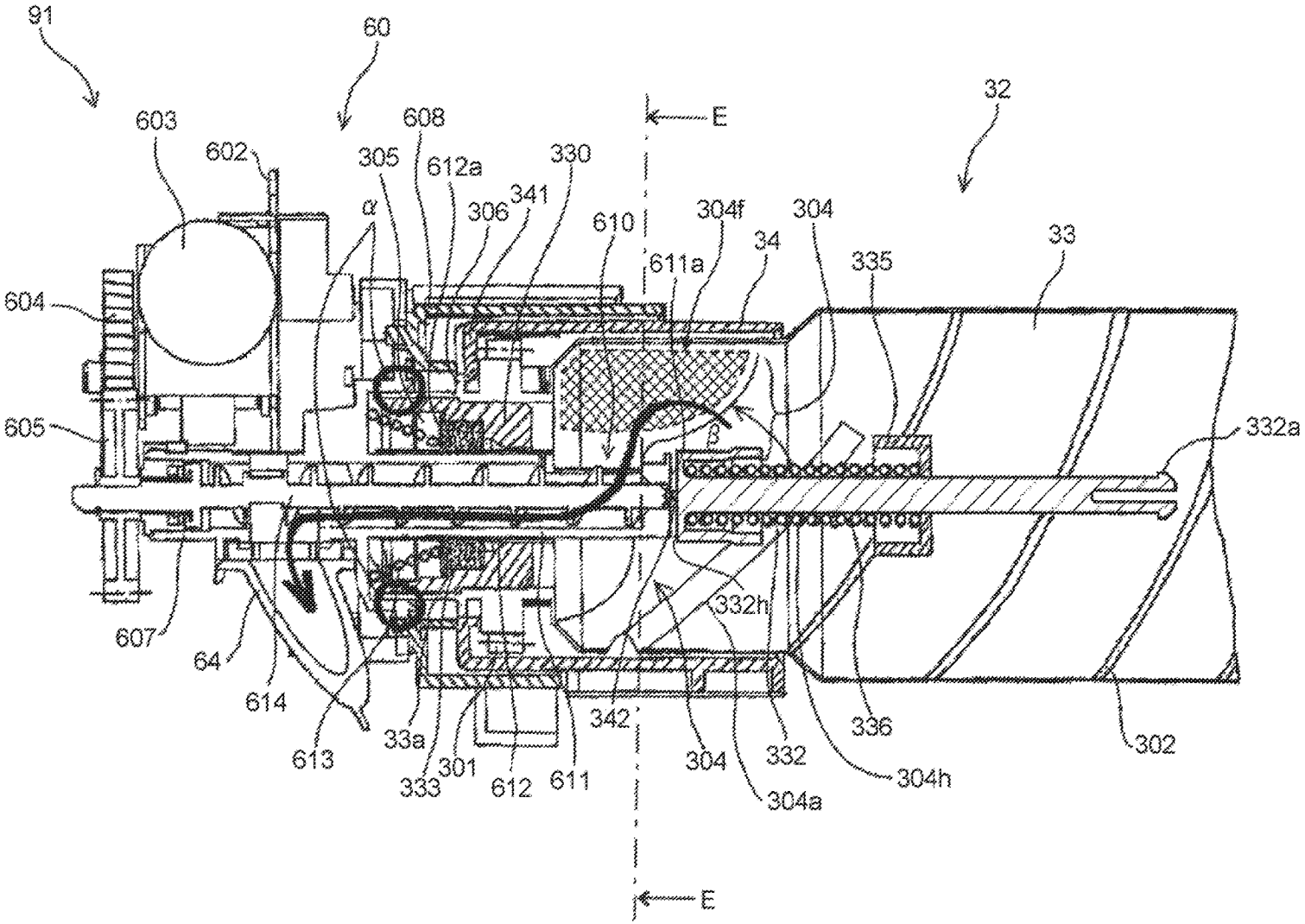
FIG. 9 is an explanatory cross-sectional view of the powder replenishing device to which the powder container is attached and the powder container.

FIG. 1 is an explanatory cross-sectional view of the toner replenishing device 60 before the toner container 32 is attached and the front end of the toner container 32. FIG. 9 is an explanatory cross-sectional view of the toner replenishing device 60 to which the toner container 32 is attached and the front end of the toner container 32.

The toner replenishing device 60 includes the conveying nozzle 611 inside which the conveying screw 614 is arranged, and also includes a nozzle shutter 612 serving as a nozzle opening/closing member. The nozzle shutter 612 closes a nozzle hole 610 formed on the conveying nozzle 611 at the time of detachment, which is before the toner container 32 is attached (in the states in FIG. 1 and FIG. 7), and opens the nozzle hole 610 at the time of attachment, which is when the toner container 32 is attached (in the states in FIG. 8 and FIG. 9). Meanwhile, a receiving opening 331, which serves as a nozzle insertion opening into which the conveying nozzle 611 is inserted at the time of attachment, is formed in the center of the front end of the toner container 32, and a container shutter 332, which serves as an opening/closing member that closes the receiving opening 331 at the time of detachment, is arranged.

The toner container 32 will be explained below.

Figure 10:
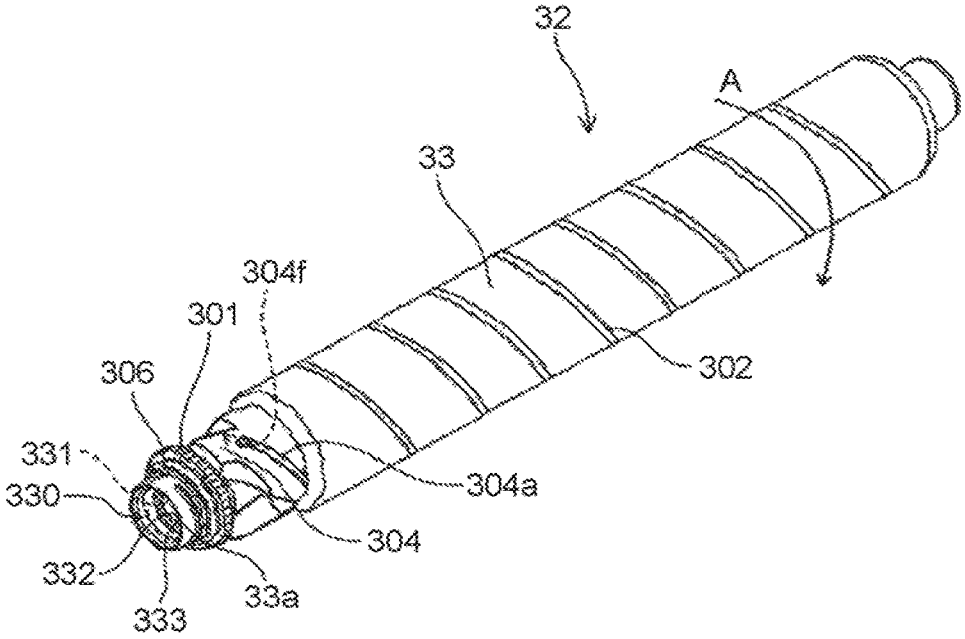
FIG. 10 is an explanatory perspective view of the powder container when a container front end cover is detached.

As described above, the toner container 32 mainly includes the container body 33 and the container front end cover 34. FIG. 10 is an explanatory perspective view of the toner container 32 when the container front end cover 34 is detached from the state illustrated in FIG. 6. The toner container 32 according to the embodiments is not limited to those that mainly include the container body 33 and the container front end cover 34. For example, if the functions of the sliding guides 361, the IC tag 700, and the like included in the container front end cover 34 are not to be provided, the toner container may be used without the container front end cover 34 as illustrated in FIG. 10. Furthermore, it may be possible to provide the functions of the sliding guides 361, the IC tag 700, and the like on the toner container so that the toner container may be used without the container front end cover.

Figure 11:
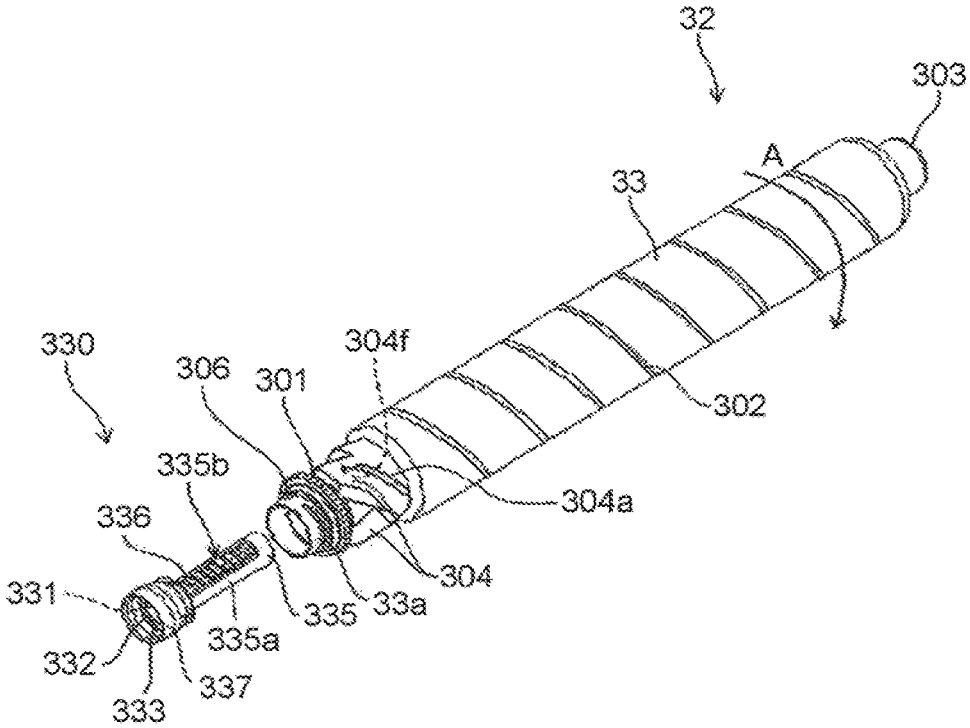
FIG. 11 is an explanatory perspective view of the powder container when a nozzle receiver is detached from a container body.
Figure 12:
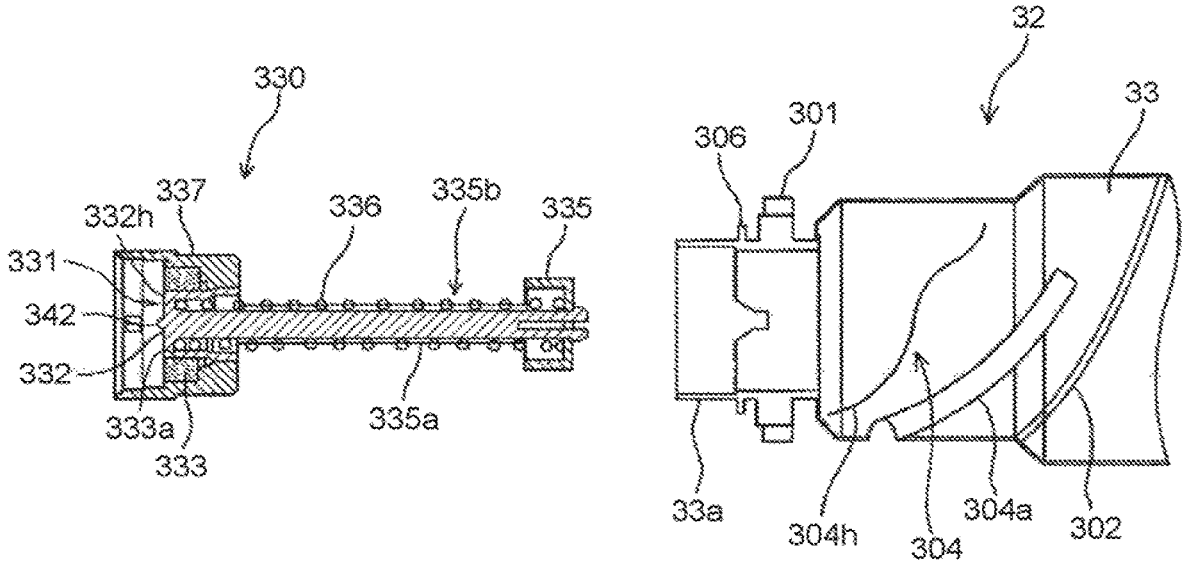
FIG. 12 is an explanatory cross-sectional view of the powder container when the nozzle receiver is detached from the container body.
Figure 13:
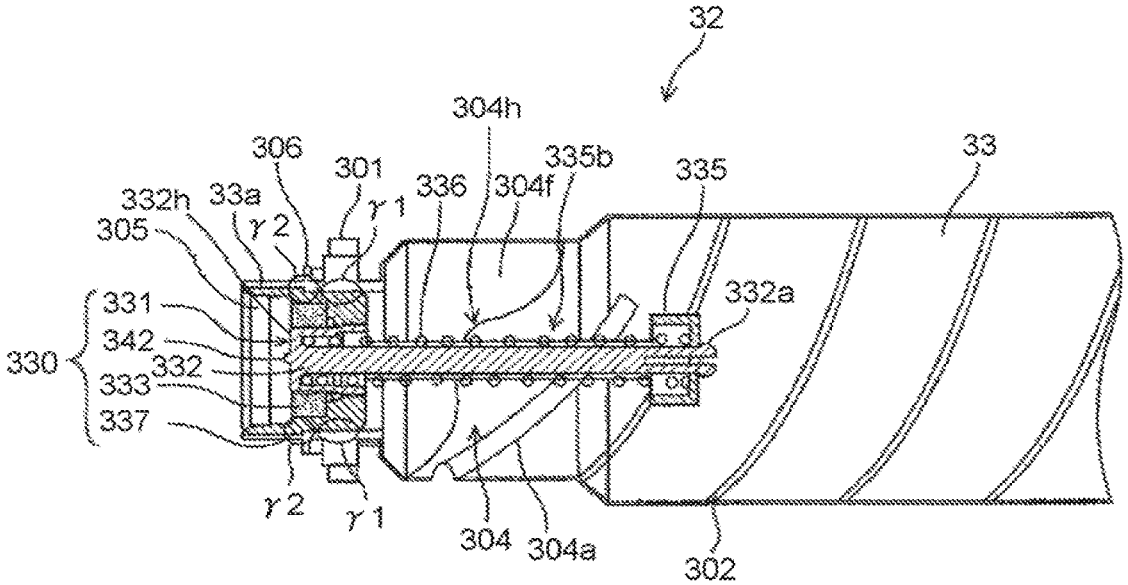
FIG. 13 is an explanatory cross-sectional view of the powder container when the nozzle receiver is attached to the container body from the state illustrated in FIG. 12.

FIG. 11 is an explanatory perspective view of the toner container 32 when a nozzle receiver 330 serving as a nozzle insertion member is detached from the container body 33 from the state illustrated in FIG. 10. FIG. 12 is an explanatory cross-sectional view of the toner container 32 when the nozzle receiver 330 is detached from the container body 33. FIG. 13 is an explanatory cross-sectional view of the toner container 32 when the nozzle receiver 330 is attached to the container body 33 from the state illustrated in FIG. 12 (the container front end cover 34 is detached from the toner container 32 similarly to FIG. 10).

As illustrated in FIG. 10 and FIG. 11, the container body 33 is in the form of an approximate cylinder and rotates about a central axis of the cylinder serving as a rotation axis. Hereinafter, a direction parallel to the rotation axis is referred to as "a rotation axis direction" and one side of the toner container 32 where the receiving opening 331 is formed (the side where the container front end cover 34 is arranged) in the rotation axis direction may be referred to as "a container front end". Furthermore, the other side of the toner container 32 where the gripper 303 is arranged (the side opposite the container front end) may be referred to as "a container rear end". The longitudinal direction of the toner container 32 described above is the rotation axis direction, and the rotation axis direction becomes a horizontal direction when the toner container 32 is attached to the toner replenishing device 60. The container rear end side of the container body 33 relative to the container gear 301 has a greater outer diameter than that of the container front end, and the spiral rib 302 is formed on the inner surface of the container rear end. When the container body 33 rotates in the arrow A direction in FIGS. 10 and 11, a conveying force for moving toner from one end (the container rear end) to the other end (the container front end) in the rotation axis direction is applied to the toner in the container body 33 due to the action of the spiral rib 302.

Scooping portions 304 are formed on the inner wall of the front end of the container body 33. The scooping portions 304 scoop up toner, which has been conveyed to the container front end by the spiral rib 302 along with the rotation of the container body 33 in the arrow A direction in FIGS. 10 and 11, along with the rotation of the container body 33. As illustrated in FIG. 13, each of the scooping portions 304 is formed of a convex **304*h* and a scooping wall surface 304*f*. The convex 304*h* rises inside the container body 33 so as to form a ridge toward the rotation center of the container body 33 in a spiral form. The scooping wall surface 304*f* is a downstream part of the wall surface of a portion continued from the convex 304*h* (i.e., ridge) to the inner wall of the container body 33 in the rotation direction of the container. When the scooping wall surface 304*f* is located in the lower side, the scooping wall surface 304*f* scoops up toner, which has been entered into an inner space facing the scooping portion 304 by the conveying force of the spiral rib 302, along with the rotation of the container body 33. Therefore, the toner can be scooped up and located above the inserted conveying nozzle 611**.

As illustrated in FIG. 1 and FIG. 10 for example, a scooping spiral rib **304*a* in a spiral shape is formed on the inner surface of each of the scooping portions 304 in order to convey toner inside the scooping portions 304, similarly to the spiral rib 302**.

The container gear 301 is formed on the container front end side relative to the scooping portion 304 of the container body 33. A gear exposing hole **34*a* is arranged on the container front end cover 34 so that a part of the container gear 301 (the back side of FIG. 6) can be exposed when the container front end cover 34 is attached to the container body 33. When the toner container 32 is attached to the toner replenishing device 60, the container gear 301 exposed from the gear exposing hole 34*a* is engaged with a container driving gear 601 of the toner replenishing device 60**.

The container opening **33*a* in the form of a cylinder is formed on the container front end side relative to the container gear 301 of the container body 33. A nozzle receiver fixing portion 337 of the nozzle receiver 330 is press fitted to the container opening 33*a* so that the nozzle receiver 330 can be fixed to the container body 33. A method to fix the nozzle receiver 330** is not limited to press fitting. Other methods including fixing with adhesive agent or fixing with screws may be applied.

The toner container 32 is configured such that the nozzle receiver 330 is fixed to the container opening **33*a* of the container body 33 after the container body 33 is filled with toner via the opening of the container opening 33*a***.

A cover hook stopper 306 serving as a cover hook regulator is formed beside the container gear 301 on the end of the container opening **33*a* of the container body 33. The container front end cover 34 is attached to the toner container 32 (the container body 33) in the state illustrated in FIG. 10 from the container front end side (from the bottom left side in FIG. 10). Consequently, the container body 33 penetrates through the container front end cover 34 in the rotation axis direction, and a cover hook 341 arranged on the front end of the container front end cover 34 is engaged with the cover hook stopper 306. The cover hook stopper 306 is formed so as to surround the outer surface of the container opening 33*a*, and when the cover hook 341 is engaged, the container body 33 and the container front end cover 34** are attached so as to rotate relative to each other.

The container body 33 is molded by a biaxial stretch blow molding method. The biaxial stretch blow molding method generally includes a two-stage process including a preform molding process and a stretch blow molding process. In the preform molding process, a test-tube shaped preform is molded with resin by injection molding. By the injection molding, the container opening **33*a*, the cover hook stopper 306, and the container gear 301** are formed at the opening of the test-tube shape preform. In the stretch blow molding process, the preform that is cooled after the preform molding process and detached from a mold is heated and softened, and then subjected to blow molding and stretching.

In the container body 33, the container rear end side relative to the container gear 301 is molded by the stretch blow molding process. Specifically, a portion, in which the scooping portions 304 and the spiral rib 302 are formed, and the gripper 303 are molded by the stretch blow molding process.

In the container body 33, each of the portions, such as the container gear 301, the container opening 33*a*, and the cover hook stopper 306, provided on the container front end side relative to the container gear 301 remains in the same form as in the preform generated by the injection molding; therefore, they can be molded with high accuracy. In contrast, the portion in which the scooping portions 304 and the spiral rib 302 are formed and the gripper 303 are molded by stretching through the stretch blow molding process after the injection molding; therefore, the molding accuracy is lower than that of the preform molded portions.

The nozzle receiver 330 fixed to the container body 33 will be explained below.

For convenience of explanation, with respect to the orientation of the nozzle receiver 330 attached to the toner container 32Y, one end in the same orientation as the container front end as described above is referred to as a container front end, and the other end in the same orientation as the container rear end as described above is referred to as a container rear end.

Figure 14:
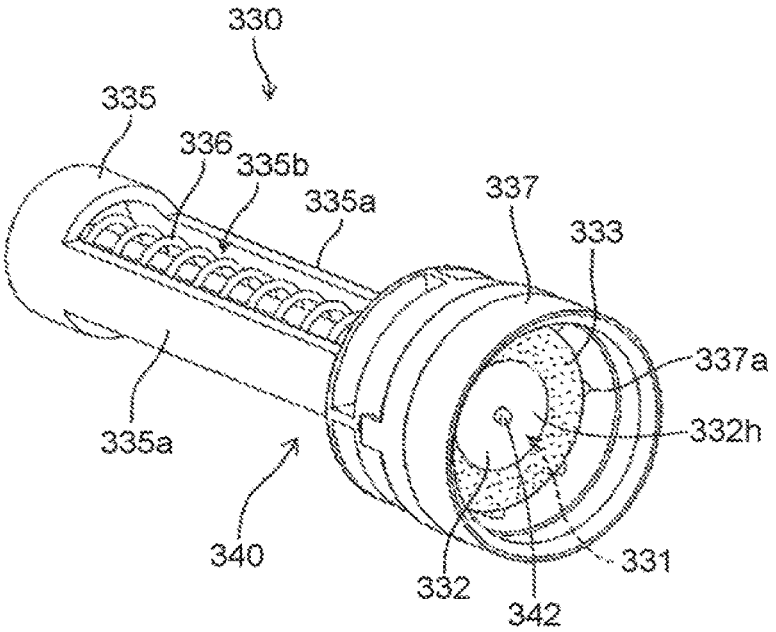
FIG. 14 is an explanatory perspective view of the nozzle receiver viewed from a container front end side.
Figure 15:
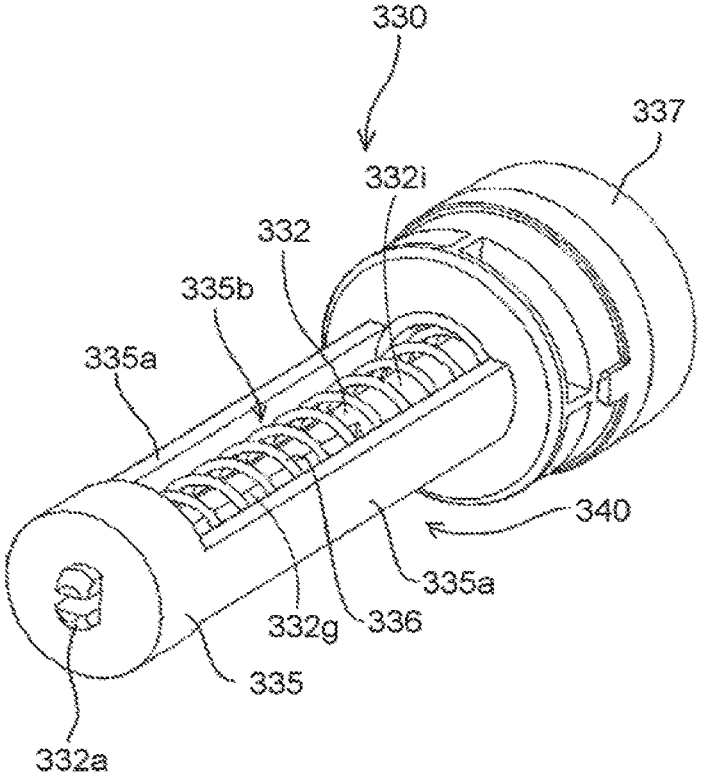
FIG. 15 is an explanatory perspective view of the nozzle receiver viewed from a container rear end side.
Figure 16:
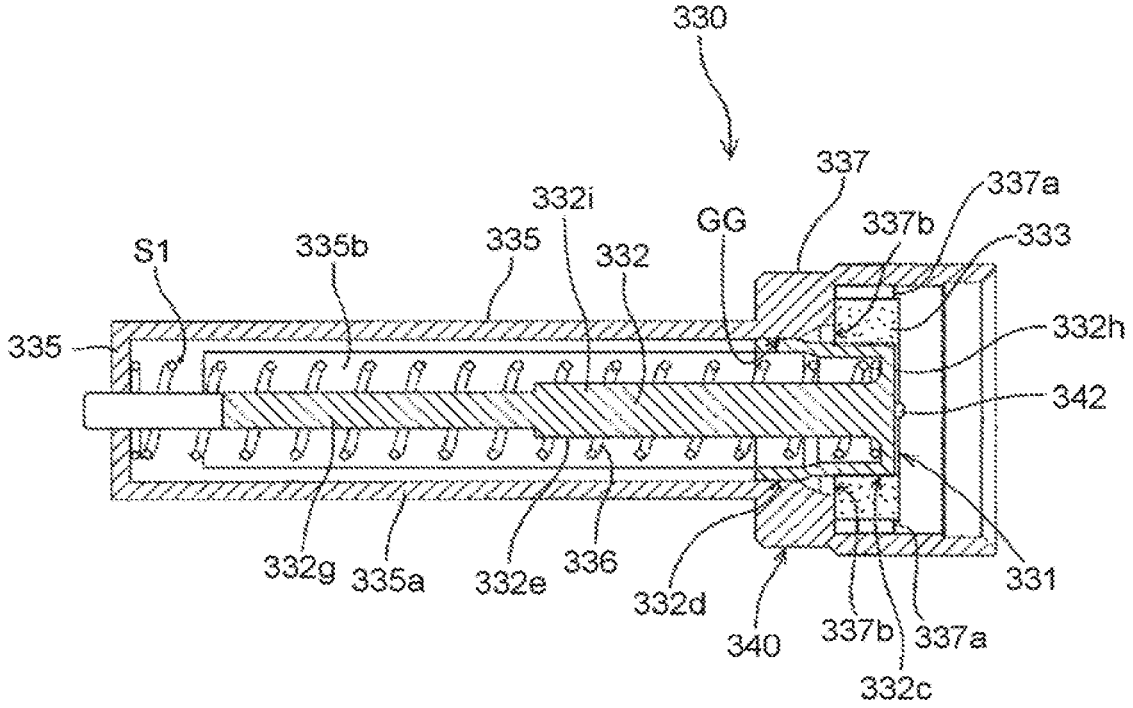
FIG. 16 is a top cross-sectional view of the nozzle receiver in the state illustrated in FIG. 13.
Figure 17:
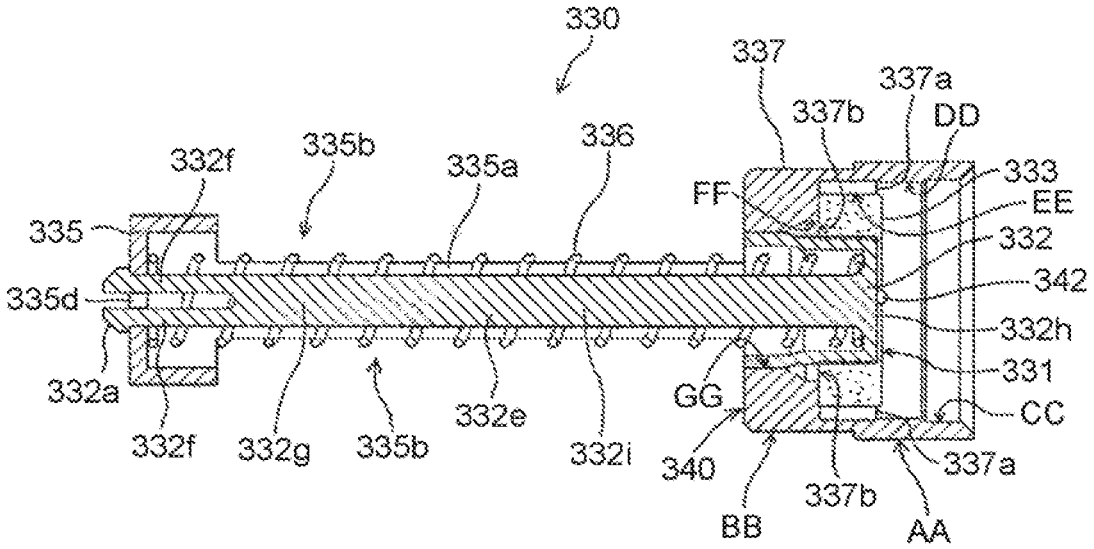
FIG. 17 is a transverse cross-sectional view of the nozzle receiver in the state illustrated in FIG. 13.
Figure 18:
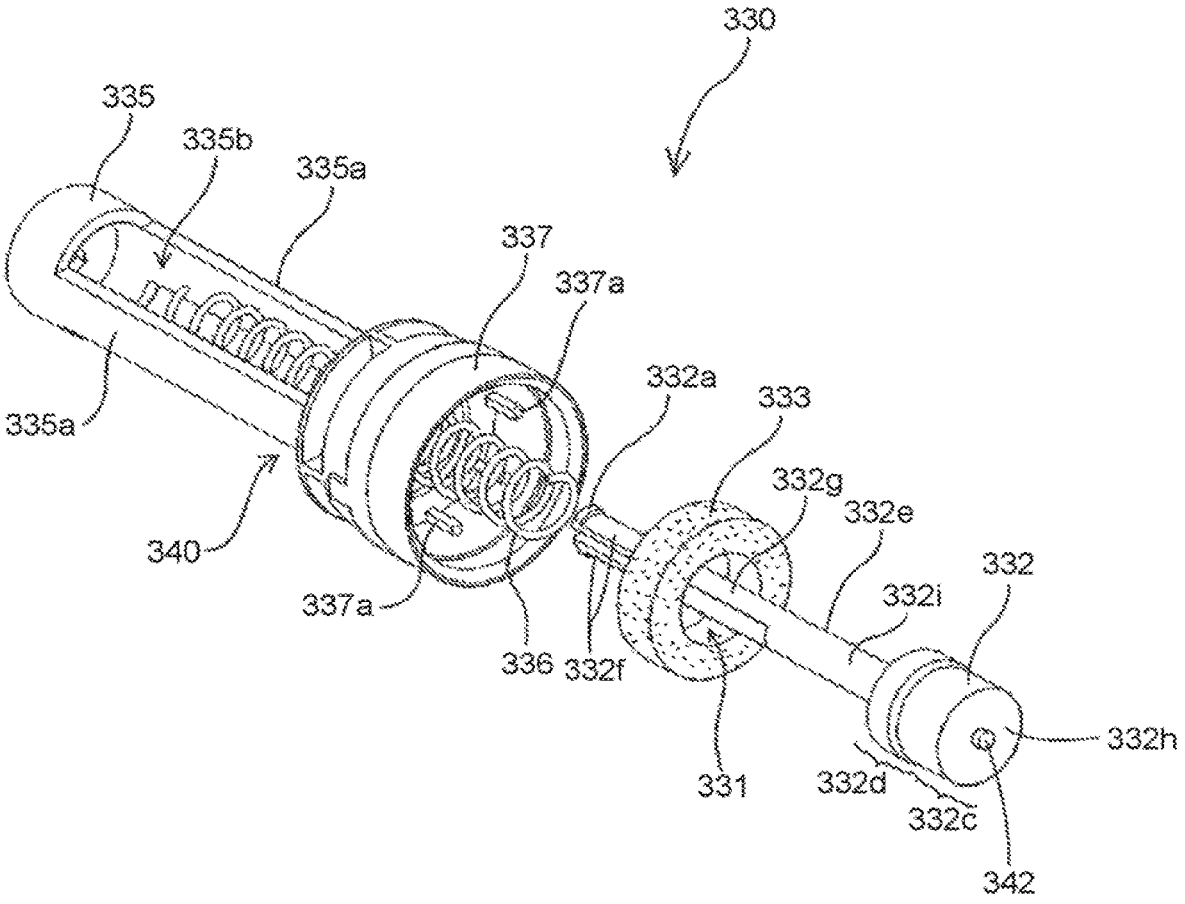
FIG. 18 is an exploded perspective view of the nozzle receiver.

FIG. 14 is an explanatory perspective view of the nozzle receiver 330 viewed from the container front end. FIG. 15 is an explanatory perspective view of the nozzle receiver 330 viewed from the container rear end. FIG. 16 is a top cross-sectional view of the nozzle receiver 330 viewed from above in the state illustrated in FIG. 13. FIG. 17 is a transverse cross-sectional view of the nozzle receiver 330 viewed from side (from the back side of FIG. 13) in the state illustrated in FIG. 13. FIG. 18 is an exploded perspective view of the nozzle receiver 330.

The nozzle receiver 330 includes a container shutter supporter 340 serving as a supporting member, the container shutter 332, a container seal 333 serving as a sealing member, a container shutter spring 336 serving as a biasing member, and the nozzle receiver fixing portion 337. The container shutter supporter 340 includes a shutter rear supporting portion 335 as a shutter rear portion, shutter side supporting portions 335*a* as shutter side portions, an opening 335*b* as a shutter side opening of the shutter supporting portions, and the nozzle receiver fixing portion 337. The container shutter spring 336 includes a coil spring.

The shutter side supporting portions 335*a* and the openings 335*b* of the shutter supporting portion on the container shutter supporter 340 are arranged adjacent to each other in the rotation direction of the toner container such that the two shutter side supporting portions 335*a* facing each other form a part of a cylindrical shape and the cylindrical shape is largely cut out at the openings 335*b* (two portions) of the shutter supporting portions. With this shape, it is possible to cause the container shutter 332 to move in the insertion direction of the conveying nozzle 611 in a cylindrical space S1 (FIG. 16), which is a space between the side supporting portions, formed inside the cylindrical shape, that is, it is possible to guide the container shutter 332 to move to an opening position to open the receiving opening 331 and to a closing position to close the receiving opening 331.

The nozzle receiver 330 fixed to the container body 33 rotates together with the container body 33 when the container body 33 rotates. At this time, the shutter side supporting portions 335*a* of the nozzle receiver 330 rotate around the conveying nozzle 611 of the toner replenishing device 60. Therefore, the shutter side supporting portions 335*a* and the opening 335*b* of the shutter supporting portion, which are being rotated, alternately pass a space just above the nozzle hole 610 formed in the upper side of the conveying nozzle 611. Consequently, even if toner is instantaneously accumulated above the nozzle hole 610, because the shutter side supporting portions 335*a* cross the accumulated toner and alleviate the accumulation, it becomes possible to prevent a cohesion of the accumulated toner in the unused state and prevent a toner conveying failure when the device is resumed. In contrast, when the shutter side supporting portions 335*a* are located on the side of the conveying nozzle 611 and the nozzle hole 610 and the opening 335*b* of the shutter supporting portions face each other, toner in the container body 33 passes through the opening 335*b* of the shutter supporting portions and is supplied to the conveying nozzle 611 as indicated by an arrow β in FIG. 9.

The container shutter 332 includes a front cylindrical portion 332*c* serving as a closure, a slide area 332*d*, a guiding rod 332*e*, and shutter hooks 332*a*. The front cylindrical portion 332*c* is a container front end portion to be fitted to a cylindrical opening (the receiving opening 331) of the container seal 333. The slide area 332*d* is a cylindrical portion, which is formed on the container rear end side relative to the front cylindrical portion 332*c*. The slide area 332*d* has an outer diameter slightly greater than the front cylindrical portion 332*c*, and slides on the inner surfaces of the shutter side supporting portions 335*a* as a pair.

The guiding rod 332*e* is a rod member serving as an elongated member, which stands from the inner side of the front cylindrical portion 332*c* toward the container rear end, and is for preventing the container shutter spring 336 from being buckled when the guiding rod 332*e* is inserted to the inside of the coil of the container shutter spring 336.

A flat guiding portion 332*g* serving as a cohesion preventing mechanism includes a pair of flat surfaces that are formed on both sides across the central axis of the guiding rod 332*e* from the middle of the cylindrical guiding rod 332*e*. The container rear end side of the flat guiding portion 332*g* is bifurcated into a pair of cantilevers 332*f*.

The shutter hooks 332*a* are a pair of hooks, which are provided on the end opposite the base where the guiding rod 332*e* stands and which are configured to prevent the container shutter 332 from coming out of the container shutter supporter 340.

As illustrated in FIG. 16 and FIG. 17, a front end of the container shutter spring 336 abuts against the inner wall of the front cylindrical portion 332*c*, and a rear end of the container shutter spring 336 abuts against the wall of the shutter rear supporting portion 335. At this time, the container shutter spring 336 is in a compressed state, so that the container shutter 332 receives a biasing force in a direction away from the shutter rear supporting portion 335 (to the right or toward the container front end in FIG. 16 and FIG. 17). However, the shutter hooks 332*a* formed on the container rear end of the container shutter 332 are engaged with an outer wall of the shutter rear supporting portion 335. Therefore, the container shutter 332 is prevented from moving farther in the direction away from the shutter rear supporting portion 335 than in the state illustrated in FIG. 16 and FIG. 17.

Due to the engaged state between the shutter hooks 332*a* and the shutter rear supporting portion 335 and the biasing force of the container shutter spring 336, the positioning is performed. Specifically, the positions of the front cylindrical portion 332*c* and the container seal 333, both of which implement a toner leakage preventing function of the container shutter 332, are determined relative to the container shutter supporter 340 in the axial direction. Therefore, it is possible to determine the positions such that the front cylindrical portion 332*c* and the container seal 333 are fitted to each other, enabling to prevent toner leakage.

The nozzle receiver fixing portion 337 is in the form of a cylinder whose outer diameter and inner diameter are reduced in a stepped manner toward the container rear end. The diameters are gradually reduced from the container front end to the container rear end. As illustrated in FIG. 17, two outer diameter portions (outer surfaces AA and BB located in this order from the container front end) are formed on the outer surface, and five inner diameter portions (inner surfaces CC, DD, EE, FF, and GG located in this order from the container front end) are formed on the inner surface. The outer surfaces AA and BB on the outer surface are connected by a tapered surface at their boundary. Similarly, the fourth inner diameter portion FF and the fifth inner diameter portion GG on the inner surface are connected by a tapered surface at their boundary. The inner diameter portion FF on the inner surface and the continued tapered surface correspond to a seal jam preventing space 337*b* to be described later, and the ridge lines of these surfaces correspond to sides of a pentagonal cross-section to be described later.

As illustrated in FIG. 16 to FIG. 18, a pair of the shutter side supporting portions 335*a*, which face each other and which have flake shapes obtained by cutting a cylinder in the axial direction, protrude from the nozzle receiver fixing portion 337 toward the container rear end. The ends of the two shutter side supporting portions 335*a* on the container rear end are connected to the shutter rear supporting portion 335 that has a cup shape with an opening in the center of the bottom. In the two shutter side supporting portions 335*a*, the cylindrical space S1 is formed, which is recognizable due to inner cylindrical surfaces of the shutter side supporting portions 335*a* facing each other and virtual cylindrical surfaces extending from the shutter side supporting portions 335*a*. The nozzle receiver fixing portion 337 includes the inner diameter portion GG, which is a fifth portion from the front end, as a cylindrical inner surface having an inner diameter that is the same as the diameter of the cylindrical space S1. The slide area 332*d* of the container shutter 332 slides on the cylindrical space S1 and the cylindrical inner surface GG. The third inner surface EE of the nozzle receiver fixing portion 337 is a virtual cylindrical surface that passes through longitudinal apexes of nozzle shutter positioning ribs 337*a* that serve as abutting portions or convex portions and that are equally spaced at 45°. The container seal 333 with a quadrangular cylindrical (cylindrical tube shaped) cross section (the cross section in the cross-sectional view in FIG. 16 and FIG. 17) is arranged so as to correspond to the inner surface EE. The container seal 333 is fixed to a vertical surface connecting the third inner surface EE and the fourth inner surface FF with adhesive agent or double-stick tape. The exposed surface of the container seal 333 opposite the attachment surface (the right side in FIG. 16 and FIG. 17) serves as an inner bottom of the cylindrical opening of the cylindrical nozzle receiver fixing portion 337 (the container opening).

As illustrated in FIG. 16 and FIG. 17, the seal jam preventing space 337*b* (a catch preventing space) is formed so as to correspond to the inner surface FF of the nozzle receiver fixing portion 337 and the continued tapered surface. The seal jam preventing space 337*b* is an annular sealed space enclosed by three different parts. Specifically, the seal jam preventing space 337*b* is an annular space enclosed by the inner surface (the fourth inner surface FF and the continued tapered surface) of the nozzle receiver fixing portion 337, the vertical surface on the attachment side of the container seal 333, and the outer surface continuing from the front cylindrical portion 332*c* to the slide area 332*d* of the container shutter 332. A cross section of the annular space (the cross section illustrated in FIG. 16 and FIG. 17) is in the form of a pentagon. The angle between the inner surface of the nozzle receiver fixing portion 337 and the end surface of the container seal 333 and the angle between the outer surface of the container shutter 332 and the end surface of the container seal 333 are 90°.

Functions of the seal jam preventing space 337*b* will be described below. When the container shutter 332 moves to the container rear end from the state where the receiving opening 331 is closed, the inner surface of the container seal 333 slides against the front cylindrical portion 332*c* of the container shutter 332. Therefore, the inner surface of the container seal 333 is pulled by the container shutter 332 and elastically deformed so as to move toward the container rear end.

At this time, if the seal jam preventing space 337*b* is not provided and the vertical surface (the attachment surface of the container seal 333) continued from the third inner surface is connected to the fifth inner surface GG in a direction perpendicular to each other, the following situation may occur. Specifically, the elastically-deformed portion of the container seal 333 may be caught between the inner surface of the nozzle receiver fixing portion 337 sliding against the container shutter 332 and the outer surface of the container shutter 332, resulting in causing a jam. If the container seal 333 is jammed in the portion where the nozzle receiver fixing portion 337 and the container shutter 332 slide against each other, that is, between the front cylindrical portion 332*c* and the inner surface GG, the container shutter 332 is firmly fixed to the nozzle receiver fixing portion 337, so that the receiving opening 331 may not be opened and closed.

In contrast, the seal jam preventing space 337*b* is formed on the inner area of the nozzle receiver 330 of the embodiments. The inner diameter of the seal jam preventing space 337*b* (the inner diameter of each of the inner surface EE and the continued tapered surface) is smaller than the outer diameter of the container seal 333. Therefore, the entire container seal 333 can hardly enter the seal jam preventing space 337*b*. Furthermore, an area of the container seal 333 to be elastically deformed by being pulled by the container shutter 332 is limited, and the container seal 333 can be restored by its own elasticity before the container seal 333 is brought to and jammed at the inner surface GG. With this action, it is possible to prevent a situation where the receiving opening 331 cannot be opened and closed because of the fixed state between the container shutter 332 and the nozzle receiver fixing portion 337.

As illustrated in FIG. 16 to FIG. 18, a plurality of the nozzle shutter positioning ribs 337*a* are formed so as to radially extend on the inner surface of the nozzle receiver fixing portion 337 that comes in contact with the outer circumference of the container seal 333. As illustrated in FIG. 16 and FIG. 17, when the container seal 333 is fixed to the nozzle receiver fixing portion 337, the vertical surface of the container seal 333 on the container front end side slightly protrudes relative to the front ends of the nozzle shutter positioning ribs 337*a* in the rotation axis direction.

As illustrated in FIG. 9, when the toner container 32 is attached to the toner replenishing device 60, a nozzle shutter flange 612*a*, which serves as an abutted part or a protrusion of the nozzle opening/closing member, of the nozzle shutter 612 of the toner replenishing device 60 presses and deforms the protruding portion of the container seal 333 by being biased by a nozzle shutter spring 613 serving as a biasing member. The nozzle shutter flange 612*a* further moves inward and abuts against the container front ends of the nozzle shutter positioning ribs 337*a*, thereby covering the front end surface of the container seal 333 and sealing the container from the outside. Therefore, it is possible to ensure the sealing performance in the periphery of the conveying nozzle 611 at the receiving opening 331 in the attached state, enabling to prevent toner leakage.

The back side of a biased surface 612*f* of the nozzle shutter flange 612*a* biased by the nozzle shutter spring 613 abuts against the nozzle shutter positioning ribs 337*a*, so that the position of the nozzle shutter 612 relative to the toner container 32 in the rotation axis direction is determined. Consequently, a positional relationship of the front end surface of the container seal 333, the front end surface of a front end opening 305 (an inner space of the cylindrical nozzle receiver fixing portion 337 arranged in the container opening 33*a* as will be described later), and the nozzle shutter 612 in the rotation axis direction is determined.

Figure 19A:
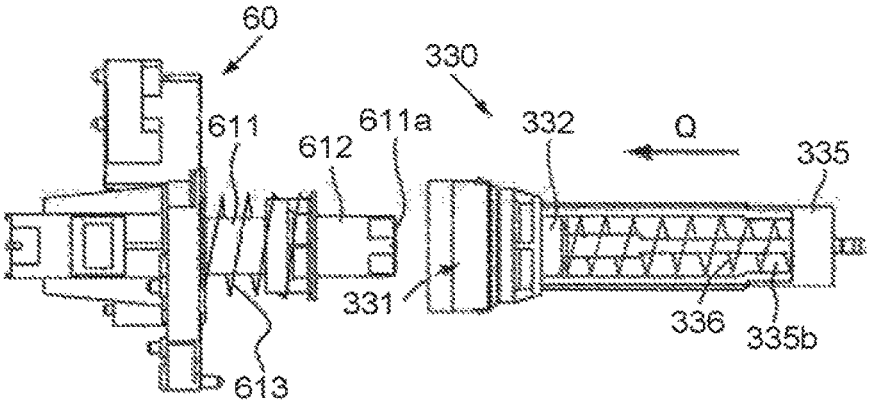
FIGS. 19A to 19D are plan views for explaining operation for attaching an opening/closing member and a conveying nozzle to each other.
Figure 19B:
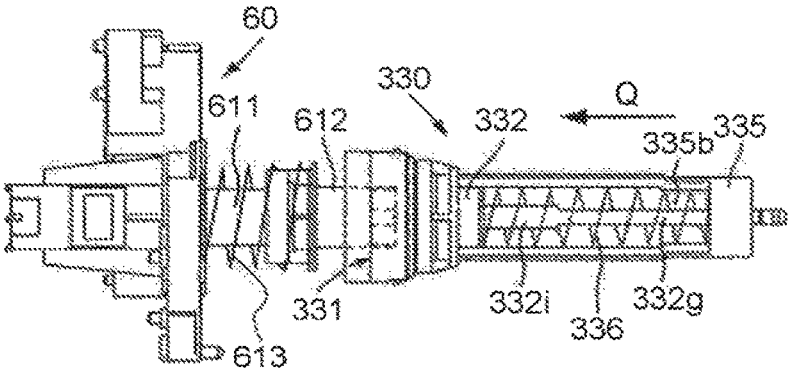
Figure 19C:
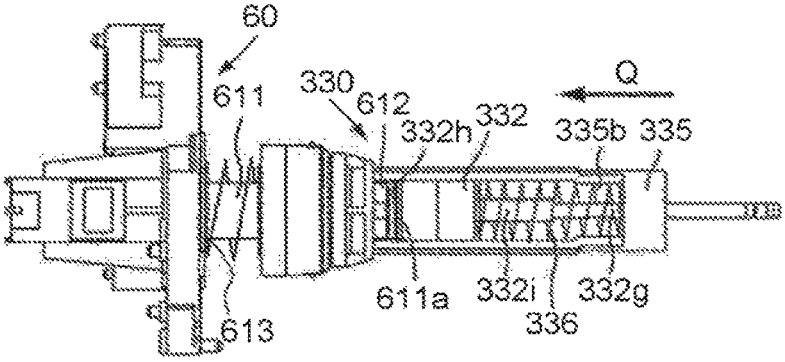
Figure 19D:
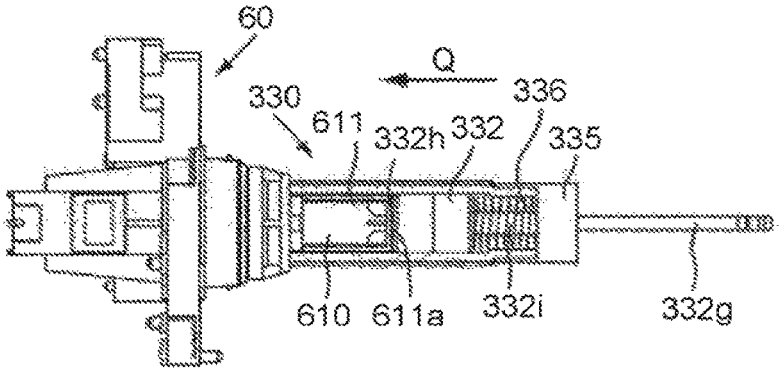

The operation of the container shutter 332 and the conveying nozzle 611 will be explained below with reference to FIG. 1, FIG. 9, and FIG. 19A to FIG. 19D. Before the toner container 32 is attached to the toner replenishing device 60, as illustrated in FIG. 1, the container shutter 332 is biased by the container shutter spring 336 toward the closing position to close the receiving opening 331. The appearance of the container shutter 332 and the conveying nozzle 611 at this time is illustrated in FIG. 19A. If the toner container 32 is attached to the toner replenishing device 60, as illustrated in FIG. 19B, the conveying nozzle 611 is inserted in the receiving opening 331. If the toner container 32 is further pushed into the toner replenishing device 60, an end surface 332*h* of the front cylindrical portion 332*c*, which serves as an end surface of the container shutter 332 (hereinafter, referred to as "the end surface 332*h* of the container shutter"), and a front end 611*a* as an end surface of the conveying nozzle 611 in the insertion direction (hereinafter, referred to as "the front end 611*a* of the conveying nozzle") come in contact with each other. If the toner container 32 is further pushed from the state as described above, the container shutter 332 is pushed inward relative to the toner container 32 as illustrated in FIG. 19C. Accordingly, the conveying nozzle 611 is inserted in the shutter rear supporting portion 335 from the receiving opening 331 as illustrated in FIG. 19D. Therefore, as illustrated in FIG. 9, the conveying nozzle 611 is inserted in the container body 33 and located at a setting position. At this time, as illustrated in FIG. 19D, the nozzle hole 610 is located at a position overlapping the opening 335*b* of the shutter supporting portion.

Subsequently, if the container body 33 is rotated, toner scooped up above the conveying nozzle 611 by the scooping portion 304 falls in the conveying nozzle 611 via the nozzle hole 610 and is introduced. The toner introduced into the conveying nozzle 611 is conveyed inside the conveying nozzle 611 toward the toner dropping passage 64 along with the rotation of the conveying screw 614, and falls in the developing device 50 through the toner dropping passage 64, so that the toner is supplied.

First Embodiment

When the toner container 32 is set at the setting position as illustrated in FIG. 19D, the end surface 332*h* of the container shutter is pressed by the front end 611*a* of the conveying nozzle within the nozzle hole 610. At this time, not only the nozzle hole 610 but also the front end 611*a* of the conveying nozzle and the end surface 332*h* of the container shutter are located below the scooping portion 304. Therefore, the toner scooped up above the conveying nozzle 611 falls toward not only the nozzle hole 610 but also a gap between the end surface 332*h* of the container shutter and the front end 611*a* of the conveying nozzle. Furthermore, the fallen toner may fly up and adhere to a gap between the container shutter 332 and the container shutter supporter 340.

Incidentally, if it is assumed that the end surface 332*h* of the container shutter and the front end 611*a* of the conveying nozzle are flat surfaces, the end surface 332*h* of the container shutter and the front end 611*a* of the conveying nozzle slide against each other while being in surface-to-surface contact with each other, so that a load is increased. Furthermore, it is difficult to achieve ideally perfect surface-to-surface sliding due to a mounting error or variation in components, and a slight gap may be generated. Therefore, in some cases, toner may enter the gap and may be rubbed along with the surface-to-surface sliding.

Moreover, a case will be described below that the toner flying in the toner container adheres to the gap between the container shutter 332 and the container shutter supporter 340. When the toner container 32 is attached to the toner replenishing device 60, the front cylindrical portion 332*c* of the container shutter 332 is pressed against the front end 611*a* of the conveying nozzle by the container shutter spring 336, so that a braking force is applied to the container shutter. Therefore, the container shutter 332 may not rotate with the container shutter supporter 340 that is fixed to the container body 33 and that rotates together with the spiral rib 302. In this case, toner in the gap between the container shutter 332 and the container shutter supporter 340 may be rubbed by the container shutter 332.

Accordingly, the toner, which is rubbed and to which a load is applied, may form a cohesion greater than the diameter of toner to which a load is not applied. If the cohesion is conveyed to the developing device 50 via the toner replenishing device 60, an unintended abnormal image, such as a black spot, may be formed. A phenomenon in which the cohesion is generated is likely to occur when low-melting-point toner, which enables to form images at a particularly low fixing temperature among various types of toner, is used.

Therefore, in the first embodiment, a cohesion preventing mechanism is provided that prevents toner cohesion that may occur with rotation of the container body 33, which will be explained below in first to sixth examples.

First Example

A cohesion preventing mechanism according to a first example will be explained. The cohesion preventing mechanism according to the first example is conceived to allow the container shutter 332 to rotate together with the container shutter supporter 340 even when the front cylindrical portion 332*c* of the container shutter 332 is pressed against the conveying nozzle 611 by the container shutter spring 336 in the longitudinal direction of the front cylindrical portion 332*c* and a braking force is generated due to the pressing. With this preventive action, a sliding load applied to toner between the container shutter 332 and the container shutter supporter 340 can be reduced. The rotation (relative rotation) together with another rotation is assumed as rotation of the container shutter 332 about an axis of the guiding rod 332*e*. The rotation of the container shutter 332 together with the container shutter supporter 340 means that both of them rotate together, in other words, the container shutter 332 does not rotate relative to the container shutter supporter 340. Furthermore, the gap between the container shutter 332 and the container shutter supporter 340 is assumed as a gap between the outer surface of the slide area 332*d* and the inner surface of the opening 335*b* of the shutter supporting portion and a gap between the flat guiding portion 332*g* and a rear end opening 335*d* serving as a through hole, a cohesion preventing mechanism, or an opening.

The sliding load applied to the toner by rotation about the axis is far greater than the sliding load applied by opening/closing operation of the container shutter 332 in the axial direction. This is because the opening/closing operation is performed only at the time of attachment and detachment of the toner container 32, whereas the rotation is performed at every replenishing operation. The present embodiment is conceived to reduce the sliding load on the toner due to the rotation.

Figure 20A:
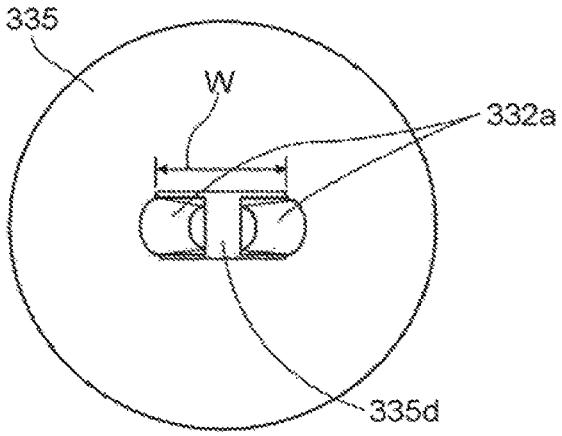
FIGS. 20A and 20B are enlarged views illustrating a relationship of a rear end opening, a shutter hook, and a flat guiding portion viewed from the container rear end side according to a first example of a first embodiment.
Figure 20B:
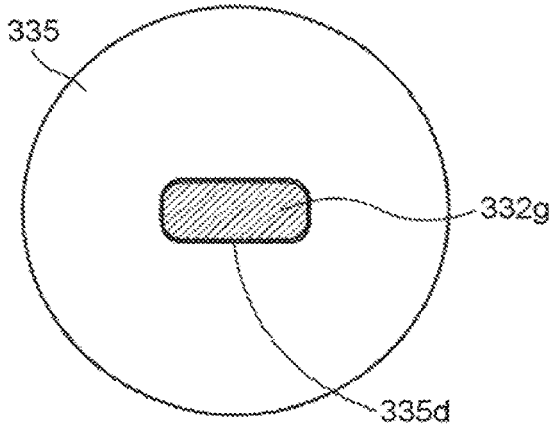

FIG. 20A is a plan view illustrating a relationship between the rear end opening 335*d*, which is a through hole arranged in the center of the opening/closing-member rear supporting portion, and the shutter hooks 332*a* viewed from the left side in FIG. 17 (from the container rear end side). FIG. 20B is a cross-sectional view of the flat guiding portion 332*g* for explaining a fitting relationship between the rear end opening 335*d* and the flat guiding portion 332*g* in the state illustrated in FIG. 19D.

The guiding rod 332*e* includes a cylindrical portion 332*i*, the flat guiding portion 332*g*, the cantilevers 332*f*, and the shutter hooks 332*a*. As illustrated in FIG. 17, the container rear end side of the guiding rod 332*e* of the container shutter 332 is bifurcated and a pair of the cantilevers 332*f* is formed. The shutter hooks 332*a* are arranged on the outer surfaces of the respective cantilevers. As illustrated in FIG. 17 and FIG. 20A, the shutter hooks 332*a* protrude outward from the outer edge of the rear end opening 335*d* with the longitudinal length W. The rear end opening 335*d* has a function to guide movement of the container shutter 332 while the cantilevers 332*f* and the flat guiding portion 332*g* slide against the rear end opening 335*d*. As illustrated in FIG. 20B, the flat guiding portion 332*g* has flat surfaces facing the top and bottom sides of the rear end opening 335*d*, and left and right sides thereof are formed as curved surfaces that fit the rear end opening 335*d*. The cylindrical portion 332*i* has a cylindrical shape whose width in the horizontal direction in FIG. 20B is the same as that of the flat guiding portion 332*g*. Furthermore, the fitting relationship is maintained such that the rear end opening 335*d* does not prevent movement of the cantilevers 332*f* and the flat guiding portion 332*g* when the container shutter 332 moves from the state in FIG. 19A to the state in FIG. 19D. As described above, the rear end opening 335*d* allows the cantilevers 332*f* and the flat guiding portion 332*g* to be inserted to guide the movement of the container shutter 332, and restricts rotation of the container shutter 332 about the rotation axis.

To mount the container shutter 332 on the container shutter supporter 340, the guiding rod 332*e* is inserted in the container shutter spring 336 and the pair of the cantilevers 332*f* of the guiding rod 332*e* are bent toward the center of the axis of the guiding rod 332*e* to allow the shutter hooks 332*a* to pass through the rear end opening 335*d*. Therefore, the guiding rod 332*e* is mounted on the nozzle receiver 330 as illustrated in FIGS. 15 to 17. At this time, the container shutter 332 is pressed by the container shutter spring 336 in a direction in which the receiving opening 331 is closed, and the container shutter is prevented from coming off by the shutter hooks 332*a*. Incidentally, it is preferable to mold the guiding rod 332*e* with resin, such as polystyrene, to ensure the elasticity that enables the cantilevers 332*f* to bend.

If the toner container 32 is set at the setting position, the flat guiding portion 332*g* passes through the rear end opening 335*d*, and, as illustrated in FIG. 19D and FIG. 20B, the flat portions of the flat guiding portion 332*g* serving as a drive transmitted portion and the sides of the rear end opening 335*d* serving as a drive transmitting portion are located so as to face each other and come in contact with each other. At this time, the inner surface of the shutter side supporting portion 335*a* face the outer surfaces of the front cylindrical portion 332*c* and the slide area 332*d*.

Therefore, even when the end surface 332*h* of the container shutter is pressed against the front end 611*a* of the conveying nozzle by the container shutter spring 336, because of the surface contact between the flat portions of the flat guiding portion 332*g* and the sides of the rear end opening 335*d*, relative rotation between the flat guiding portion 332*g* and the rear end opening 335 is restricted in the rotation direction about its longitudinal axis (which is the central axis of the guiding rod 332*e* and the central axis of the container body). Therefore, a rotational force is transmitted from the container shutter supporter 340 being rotated to the guiding rod 332*e* of the container shutter 332. The rotational force is greater than the breaking force as described above, so that the container shutter 332 can rotate with the rotation of the container shutter supporter 340. In other words, the container shutter 332 rotates together with the container shutter supporter 340 (at this time, relative rotation between them is restricted). Specifically, the flat guiding portion 332*g* and the rear end opening 335*d* serve as a drive transmitting mechanism that transmits a rotational force from the container shutter supporter 340 to the container shutter 332. At the same time, the flat guiding portion 332*g* and the rear end opening 335*d* function as the cohesion preventing mechanism according to the first example. The cohesion preventing mechanism can prevent toner between the container shutter 332 and the container shutter supporter 340 from being rubbed in the rotation direction about the axis of the guiding rod 332*e*, so that toner cohesion between the container shutter 332 and the container shutter supporter 340 due to the rotation of the container body 33 can be prevented.

Incidentally, the cohesion preventing mechanism according to the first example is not limited to the flat guiding portion 332*g*, and may be the cantilevers 332*f* In this case, it is preferable to determine the length and the position so that the cantilevers 332*f* can be located at the position of the rear end opening 335*d* when the toner container 32 is set at the setting position.

Figure 20C:
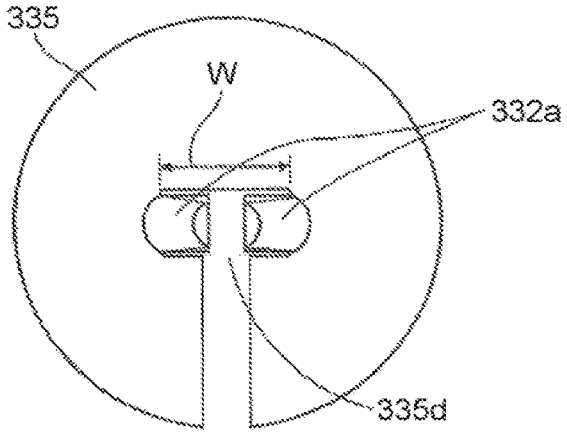
FIG. 20C is an enlarged view illustrating another example of the rear end opening.

Further, the shape of the rear end opening 335*d* is not limited to the example illustrated in FIG. 20A. As illustrated in FIG. 20C, the rear end opening 335*d* may be formed in shape having notch, which serves as a penetrated portion.

Figure 32A:
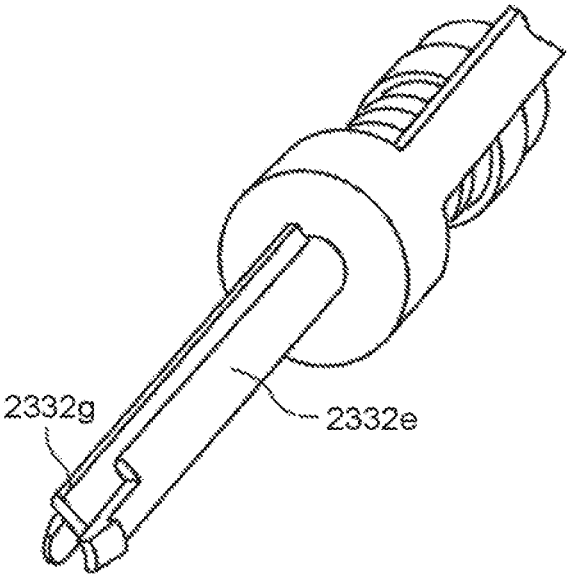
FIG. 32A is a perspective view of another example of the nozzle receiver according to the first example of the first embodiment.
Figure 32B:
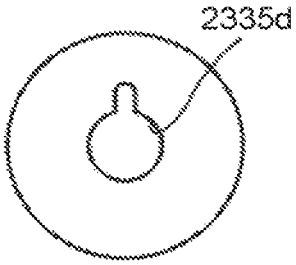
FIG. 32B illustrates a shape of a rear end opening of a shutter rear supporting portion.
Figure 33A:
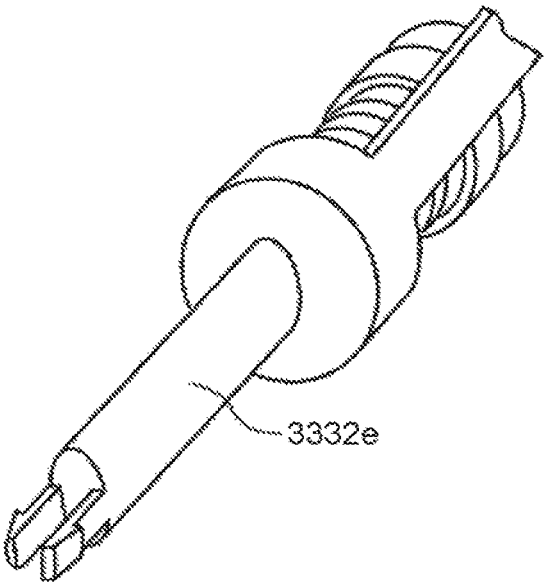
FIG. 33A is a perspective view of another example of the nozzle receiver according to the first example of the first embodiment.
Figure 33B:
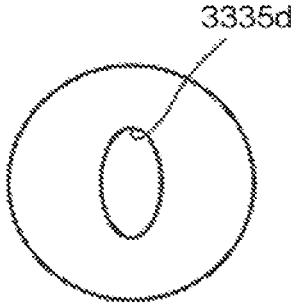
FIG. 33B illustrates a shape of a rear end opening of the shutter rear supporting portion.

Furthermore, the cohesion preventing mechanism according to the first example is not limited to the above example in which the drive is transmitted by the surface contact between the flat surfaces. FIG. 32A and FIG. 32B are perspective views illustrating a cylindrical guiding rod 2332*e*, a rib 2332*g* that serves as a flat guiding portion or a cohesion preventing mechanism and that is formed in a part of the guiding rod in the longitudinal direction, and a rear end opening 2335*d* that serves as a through hole or a cohesion preventing mechanism and that has a hole shape fitted to the rib 2332*g* and the guiding rod 2332*e*. FIG. 33A and FIG. 33B are perspective views illustrating a guiding rod 3332*e* with an elliptical cross-section and a rear end opening 3335*d* that serves as a through hole or a cohesion preventing mechanism and that has an elliptical hole shape fitted to the guiding rod 3332*e*. In FIG. 32A and FIG. 32B, the rib 2332*g* serves as the drive transmitted portion, and the rear end opening 2335*d*, which is a circular opening with a groove formed in a part thereof, corresponds to the drive transmitting portion. In FIG. 33A and FIG. 33B, the outer curved surface of the guiding rod 3332*e* with the elliptical cross-section serves as the drive transmitted portion, and the rear end opening 3335*d* that is an elliptical opening serves as the drive transmitting portion.

Second Example

First, problems to be solved by a cohesion preventing mechanism according to a second example will be explained below. When the container shutter 332 rotates together with the toner container 32 (the container body 33) in an integrated manner, the end surface 332*h* of the container shutter rotates relative to the front end 611*a* of the conveying nozzle. The front cylindrical portion 332*c* of the container shutter 332 is pressed against the conveying nozzle 611 by the container shutter spring 336 in the longitudinal direction. If the relative rotation is performed in the state as described above, a sliding load on the end surface 332*h* of the container shutter with respect to the front end 611*a* of the conveying nozzle extremely increases, so that toner cohesion may occur.

The second example is conceived to provide a cohesion preventing mechanism that prevents toner cohesion due to rotation of the container shutter 332 serving as the opening/closing member, and in particular, to provide a second cohesion preventing mechanism that prevents occurrence of toner cohesion in an area different from the first example. The cohesion preventing mechanism according to the second example reduces a sliding load on toner in a contact area of the front cylindrical portion 332*c* facing the front end 611*a* of the conveying nozzle.

As illustrated in FIG. 9 and FIG. 14, the end surface 332*h* of the container shutter includes a protrusion 342, as a cohesion preventing mechanism, that protrudes from the end surface 332*h* toward the front end 611*a* of the conveying nozzle 611 (or from the container front end to the outside) and that comes in contact with the front end 611*a* of the conveying nozzle 611 when the powder container is attached to the image forming apparatus. The protrusion 342 is a protruding portion that serves as the cohesion preventing mechanism according to the second example (the second cohesion preventing mechanism). The outer surface of the protrusion 342 is a circumferential surface coaxial with the rotation axis of the toner container 32, and the diameter thereof is reduced toward the front end 611*a* of the conveying nozzle (for example, a hemispherical shape). As illustrated in FIG. 9, a top portion of the hemisphere and the front end 611*a* of the conveying nozzle come in point contact with each other. Therefore, it becomes possible to perform rotation with a reduced sliding load when the protrusion 342 is in contact with the front end 611*a* of the conveying nozzle. Consequently, it becomes possible to greatly reduce the area of contact compared to a case where the end surface 332*h* of the container shutter and the front end 611*a* of the conveying nozzle are formed as flat surfaces. As a result, it becomes possible to reduce a sliding load applied to toner between the end surface 332*h* of the container shutter and the front end 611*a* of the conveying nozzle due to the rotation of the container body 33, enabling to prevent toner cohesion.

As a material of the protrusion 342, if the protrusion 342 is integrally molded with the container shutter 332, the same material as the container shutter 332, for example, polystyrene resin, may be used. The container shutter 332 is a component attached to the toner container 32, and therefore is replaced together with the toner container 32. Therefore, assuming that the replacement is to be performed, as the material of the protrusion 342 that rotates when in contact with the front end 611*a* of the conveying nozzle, it is preferable to employ a material softer than the material of the conveying nozzle 611 (the front end 611*a*) that is provided in the printer 100 and that is basically not replaced, in terms of durability.

Furthermore, as illustrated in FIG. 9 and FIG. 14, the protrusion 342 is arranged in the approximate center of the end surface 332*h* of the container shutter so as to be located on the central axis of rotation of the toner container 32, in other words, on the central axis of rotation of the container shutter 332. In this configuration, an ideal rotation trajectory of a front end of the protrusion 342 when the end surface 332*h* of the container shutter rotates relative to the front end 611*a* of the conveying nozzle becomes a single point. Given that separate components such as the toner container and the image forming apparatus are attached to each other, positional deviation within the allowable tolerance may be inevitable and variation due to mass production may occur; however, it is still possible to minimize the rotation trajectory even in consideration of the above conditions. Therefore, it becomes possible to prevent an increase in the area of contact between the end surface 332*h* of the container shutter and the front end 611*a* of the conveying nozzle similarly to the above, enabling to prevent toner cohesion due to the sliding load.

Figure 21:
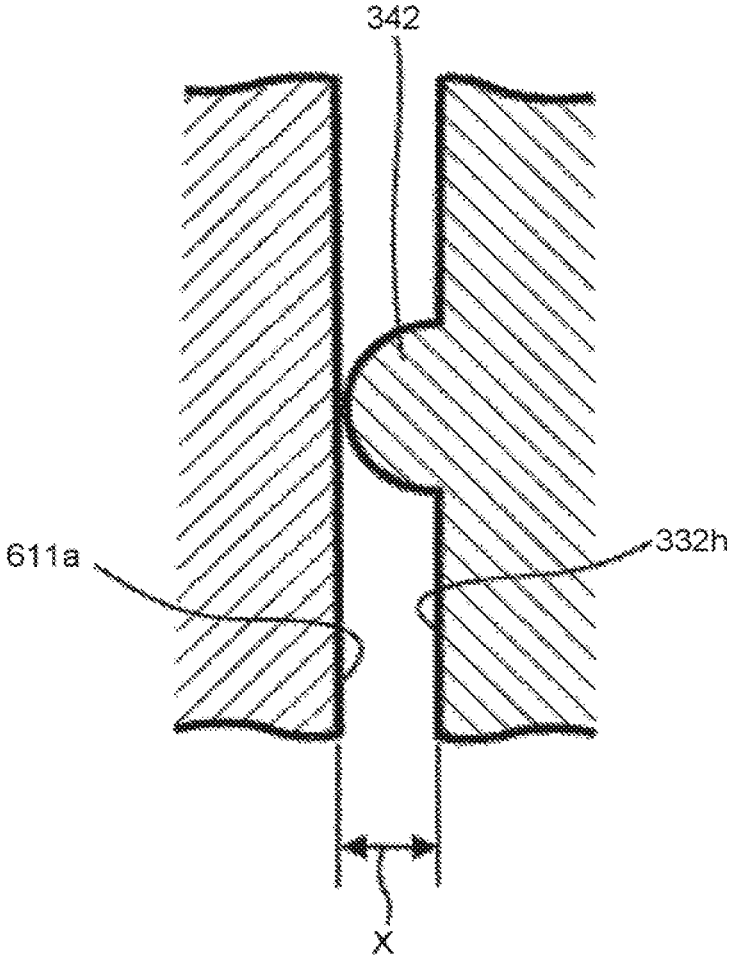
FIG. 21 is an enlarged cross-sectional view illustrating a contact state of the opening/closing member and the conveying nozzle according to a second example of the first embodiment.

A gap between the end surface 332*h* of the container shutter and the surface of the front end 611*a* of the conveying nozzle caused by the protrusion 342 will be explained below. As illustrated in FIG. 21, the gap is set by a height X of the protrusion 342 from the end surface 332*h* of the container shutter to the front end of the protrusion 342.

Figure 22:
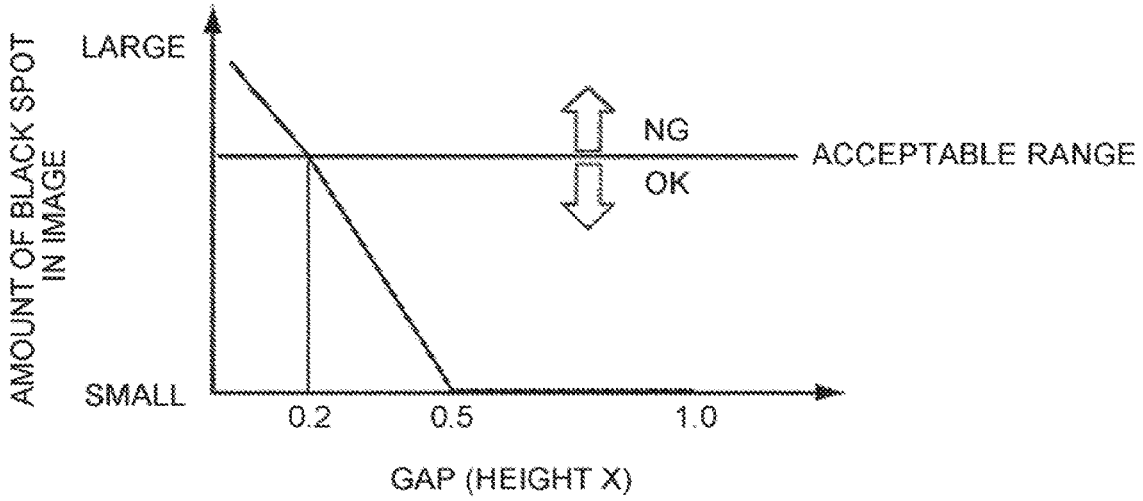
FIG. 22 is a diagram illustrating an expected relationship between the height of a cohesion preventing mechanism and a black spot that appears in an image according to the second example.

The inventors have examined a relationship between the height X of the protrusion and occurrence of a black spot in an image, that is, a relationship between the size of a sliding area in the contact area and occurrence of a black spot in an image, and have found a tendency as illustrated in FIG. 22. Specifically, in the embodiment, the height X of the protrusion (the gap between the surfaces) is set to 1 millimeter (mm). Therefore, a sliding load, which is a load due to sliding, on toner that has been entered into the gap between the surfaces can be reduced, and the toner easily falls out of the surfaces and is less likely to remain on the surfaces, so that a cohesion can hardly be generated. As described above, even when the toner is entered in the gap between the end surface 332*h* of the container shutter and the front end 611*a* of the conveying nozzle, the sliding load can be reduced, so that a load on the toner can be reduced. Therefore, it becomes possible to minimize the load on the toner, enabling to prevent generation of a cohesion and an abnormal image.

Furthermore, as illustrated in FIG. 22, it is satisfactory if the height X of the protrusion (the gap between the surfaces) is equal to or greater than 0.5 mm, and it is expected that a cohesion that can be recognized in output images is likely to occur if the height X becomes equal to or smaller than about 0.2 mm. Therefore, it is preferable to set the height X of the protrusion (the gap between the surfaces) to about 0.5 to 1 mm.

Figure 23:
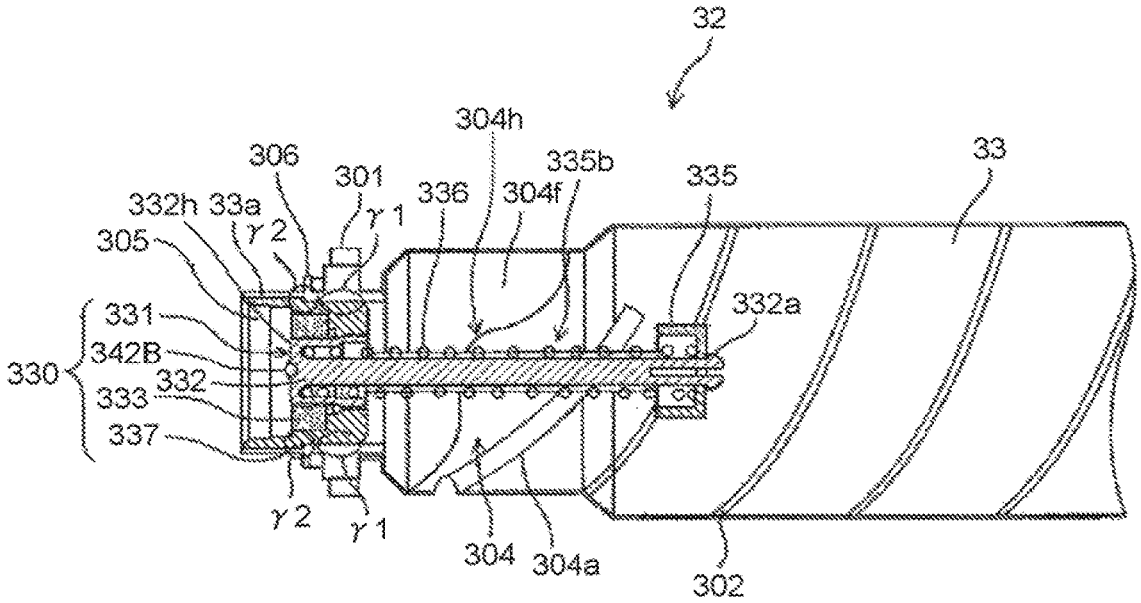
FIG. 23 is an enlarged view of another structure of the cohesion preventing mechanism according to the second example.

Incidentally, the cohesion preventing mechanism is not limited to the example in which the protrusion 342 and the container shutter 332 are integrated as illustrated in FIG. 21. For example, as illustrated in FIG. 23, a cohesion preventing mechanism may be separated from the container shutter 332. Even in this case, if the height X of the protrusion satisfies the conditions as described above, the same advantageous effects can be achieved. The cohesion preventing mechanism illustrated in FIG. 23 is a protrusion 342B that is a ball made of resin and arranged in the approximately center of the end surface 332*h* of the container shutter in a rolling manner.

Even in this configuration, the sliding load on the toner that has been entered into the gap between the end surface 332*h* of the container shutter and the surface of the front end 611*a* of the conveying nozzle can be reduced. Therefore, a cohesion can hardly be generated. As described above, even when the toner is entered into the gap between the end surface 332*h* of the container shutter and the surface of the front end 611*a* of the conveying nozzle, the sliding load can be reduced, so that a load on the toner can be reduced. Therefore, it becomes possible to minimize the load on the toner, enabling to prevent generation of a cohesion and an abnormal image.

Figure 24:
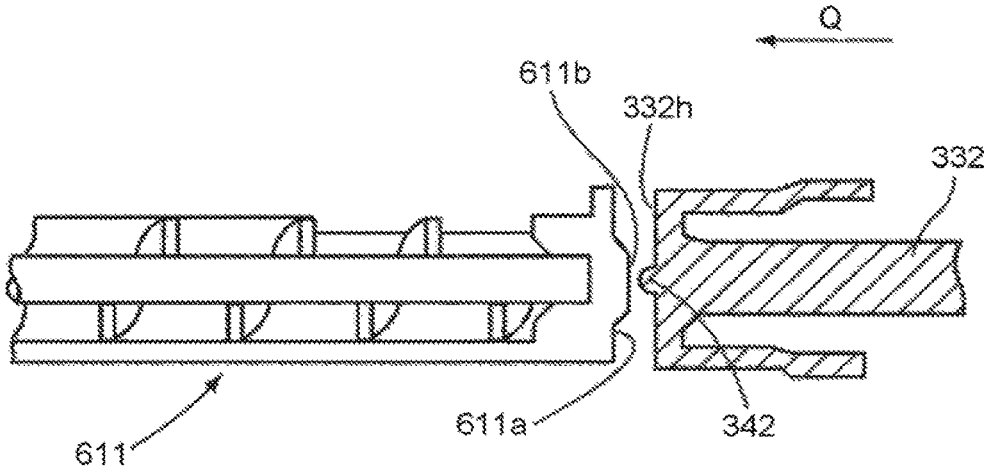
FIG. 24 is an enlarged view of a front end of the conveying nozzle according to a modification.

Furthermore, while the front end 611*a* of the conveying nozzle is formed as a flat end surface, the front end 611*a* may be formed such that, for example, only a part 611*b* of the front end 611*a* of the conveying nozzle facing the protrusion 342 protrudes toward the protrusion 342 side as illustrated in FIG. 24.

Third Example

A cohesion preventing mechanism according to a third example will be explained below.

In the second example, the cohesion preventing mechanism is arranged between the end surface 332*h* of the container shutter and the front end 611*a* of the conveying nozzle, which is particularly effective to prevent generation of a toner cohesion. However, when the toner container 32 is detached from the toner replenishing device 60, toner adhering to the gap between the surfaces may fall down inside the image forming apparatus or fall down to the floor, resulting in dirty stain.

To cope with this, in the third example, a seal 350 is arranged on the end surface 332*h* of the container shutter in a non-contact area R with respect to the front end 611*a* of the conveying nozzle. Therefore, it becomes possible to prevent toner from remaining between the end surface 332*h* of the container shutter and the surface of the front end 611*a* of the conveying nozzle.

Figure 25:
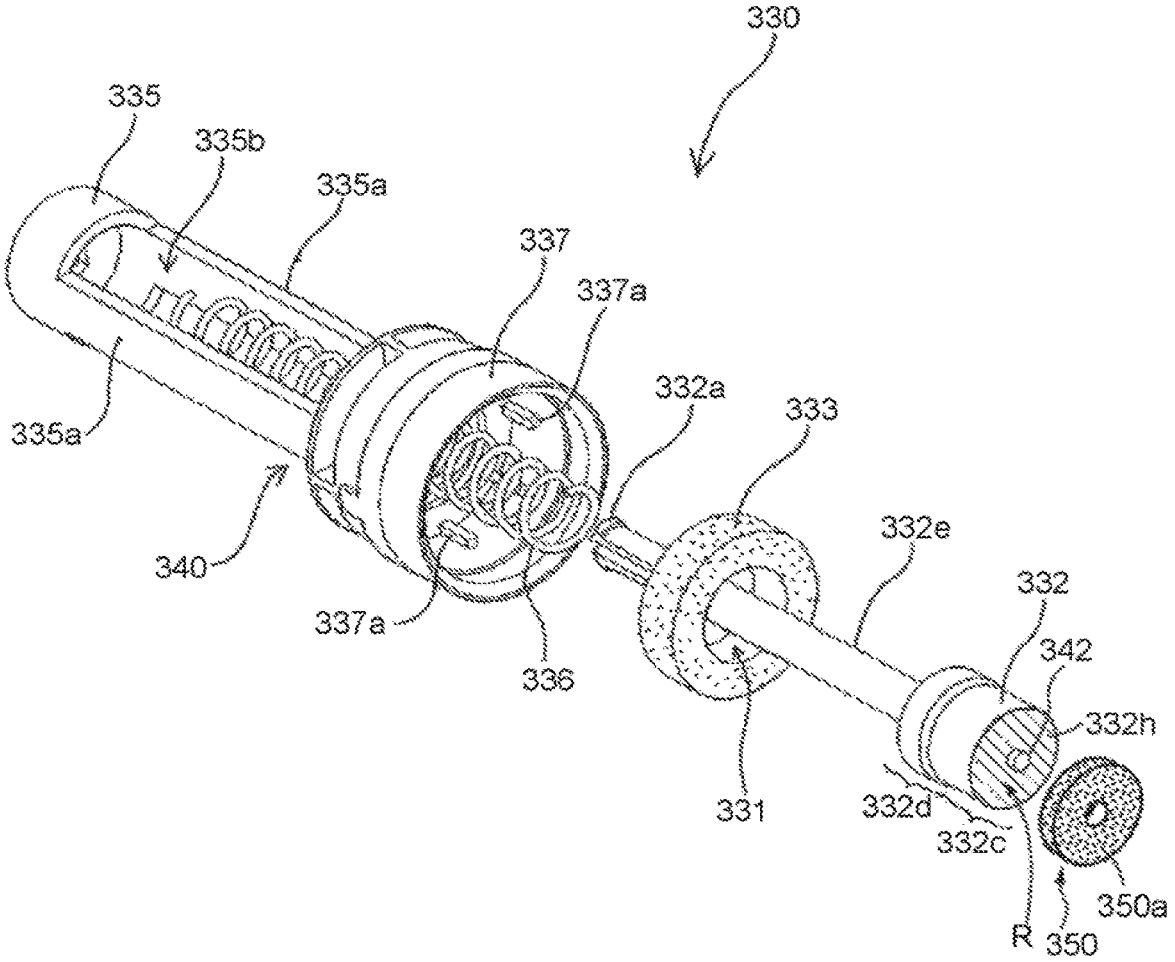
FIG. 25 is an enlarged perspective view illustrating a structure of main components according to a third example of the first embodiment.
Figure 26:
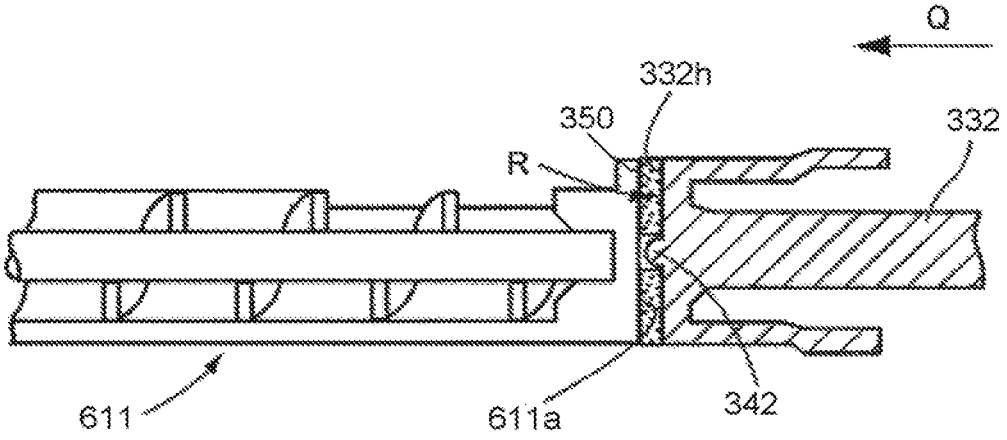
FIG. 26 is an enlarged cross-sectional view illustrating a contact state of the opening/closing member and the conveying nozzle according to the third example.
Figure 27:
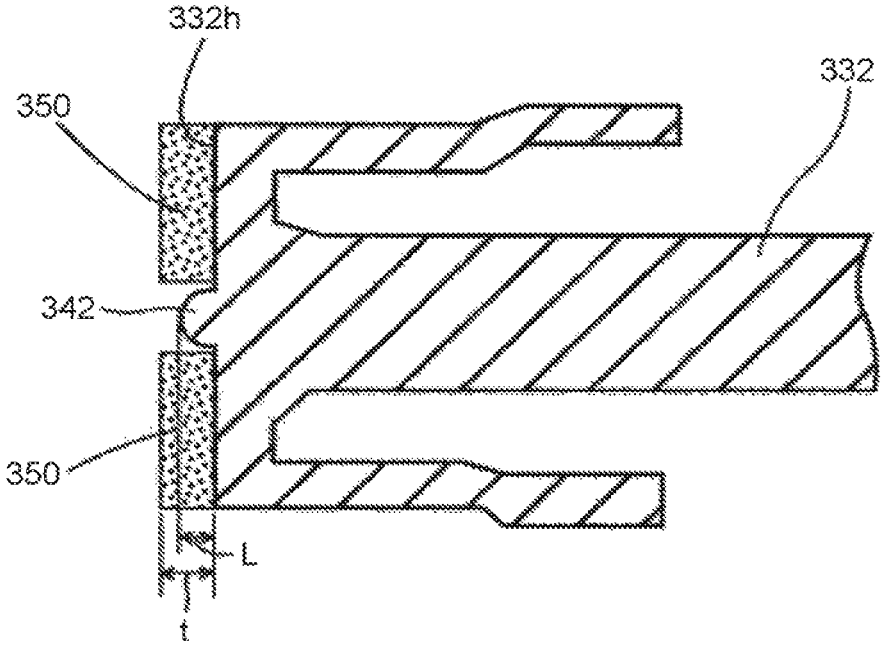
FIG. 27 is an enlarged cross-sectional view for explaining structures of a seal and the cohesion preventing mechanism arranged on an end surface of the opening/closing member according to the third example.

The seal 350 is made of an elastic material, such as expanded polyurethane. As illustrated in FIG. 25 and FIG. 26, the seal 350 is formed in an annular shape so as to be located outside the protrusion 342. The seal 350 is configured so as to be compressed by 0.1 to 0.5 mm in the thickness direction of the seal 350 when the container shutter 332 is located at an opening position at which the receiving opening 331 is opened due to insertion of the conveying nozzle 611 in the toner container 32. Specifically, as illustrated in FIG. 27, when the height X of the protrusion 342 is set to 1 mm, a thickness t of the seal 350 is set to 1.1 to 1.5 mm. The seal 350 is set so as to be compressed when a front surface 350*a* of the seal 350 and the front end 611*a* of the conveying nozzle come in contact with each other, to thereby bring the front end 611*a* of the conveying nozzle and the protrusion 342 into contact with each other.

If the seal 350 is arranged as described above, the front surface 350*a* of the seal 350 comes in contact with the front end 611*a* of the conveying nozzle as illustrated in FIG. 26 before the front end 611*a* of the conveying nozzle and the protrusion 342 come in contact with each other, so that toner is less likely to be entered into the gap between the surfaces. Therefore, when the toner container 32 is detached from the toner replenishing device 60, it becomes possible to prevent toner from falling down inside the image forming apparatus or falling down to the floor, enabling to prevent dirty stain.

Figure 29:
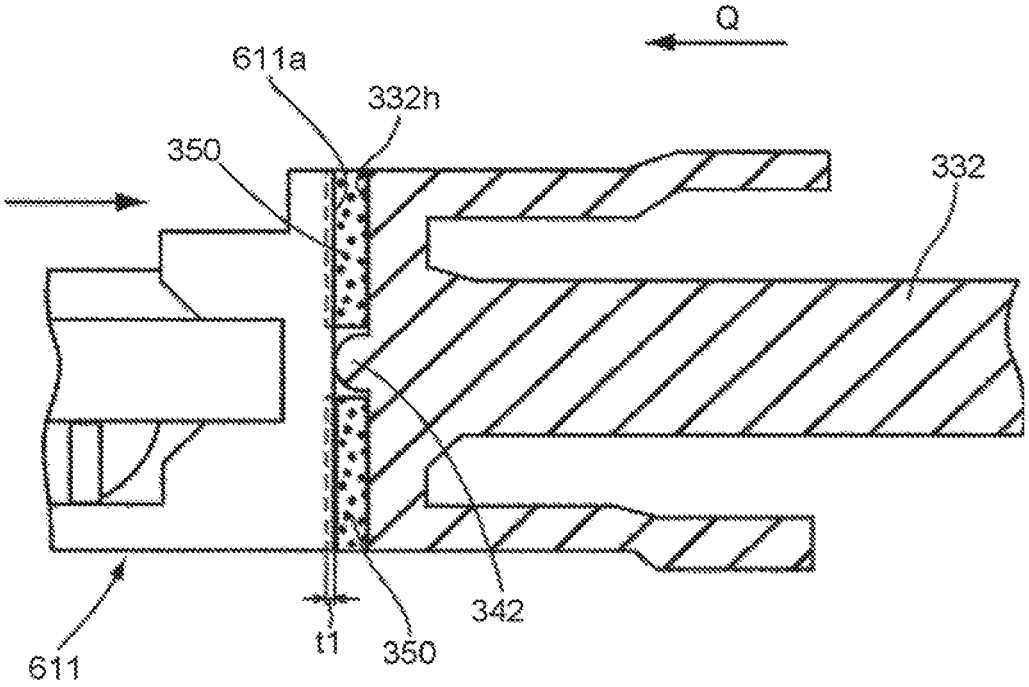
FIG. 29 is an enlarged cross-sectional view for explaining a deformation amount of the seal according to the third example.

Incidentally, as illustrated in FIG. 29, a deformation amount t1 of the seal 350 is set to about 0.1 to 0.5 mm. For example, according to observation, when the deformation amount was set to 1 mm or greater, the sliding load increased and a toner cohesion was likely to be generated between the front surface 350*a* of the seal 350 and the front end 611*a* of the conveying nozzle. Therefore, it is desirable to set the deformation amount t1 to 0.5 mm or smaller. In the present example, the deformation amount t1 is set to 0.2 mm. By setting the compression amount of the seal 350 to the minimum as described above, a rotational load of the toner container 32 (the container body 33) can be reduced. Furthermore, although toner that has adhered to the surface of the seal 350 may slightly be subjected to the compression action, the toner is not sandwiched between rigid bodies such as the end surface 332*h* of the container shutter and the front end 611*a* of the conveying nozzle 611, but is pressed against the front end 611*a* of the conveying nozzle 611 via the soft seal 350. Therefore, it is expected that the pressing force may be absorbed by the flexibility of the seal and the sliding load on the toner may be reduced.

By providing the seal 350, it becomes possible to prevent toner from being entered into the gap between the surfaces, so that it becomes possible to more reliably prevent generation of a cohesion due to the rotation of the container body 33.

Figure 28:
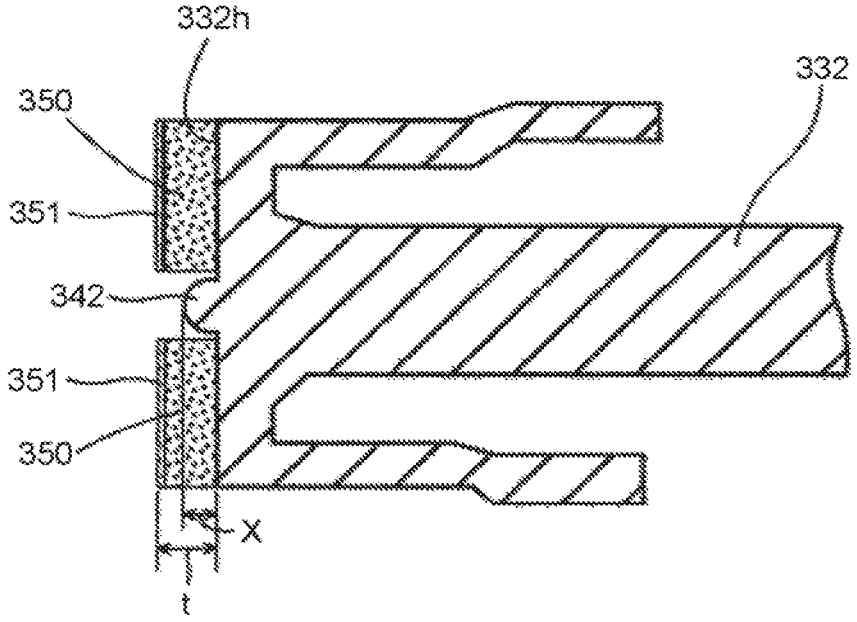
FIG. 28 is an enlarged cross-sectional view illustrating a structure of the seal according to the third example.

Furthermore, as illustrated in FIG. 26, the front surface 350*a* of the seal 350 rotates together with the container shutter 332 while being in press contact with the front end 611*a* of the conveying nozzle. Therefore, as illustrated in FIG. 28, it may be possible to bond a sheet 351 made of, for example, a high molecular polyethylene sheet or a polyethylene terephthalate (PET) material to the front surface 350*a* of the seal 350 so that the surface facing the front end 611*a* of the conveying nozzle becomes a low-friction surface. If the front surface 350*a* facing the front end 611*a* of the conveying nozzle is formed as the low-friction surface, it becomes possible to reduce a load applied to the toner due to the sliding against the front end 611*a* of the conveying nozzle.

Fourth Example

Figure 30:
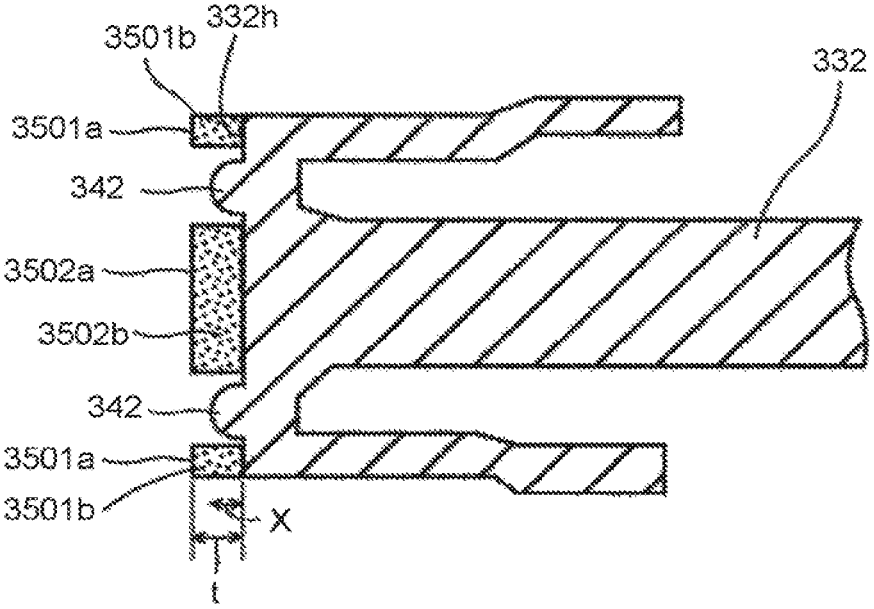
FIG. 30 is an enlarged cross-sectional view of structures of a seal and the cohesion preventing mechanism arranged on the end surface of the opening/closing member according to a fourth example of the first embodiment.

A cohesion preventing mechanism according to a fourth example will be explained below. The cohesion preventing mechanism according to the fourth example includes the protrusions 342 formed in the annular shape on the end surface 332*h* of the container shutter, an annular seal 3501*b* arranged on the outer side of the protrusion 342, and a cylindrical seal 3502*b* arranged on the inner side of the protrusions 342. As illustrated in FIG. 30, the cross-sections of the protrusions 342 have semicircular shapes. Furthermore, the sheet 351 explained in the third example may be applied to each of the front surfaces of seals 3501*a* and 3502*a*. Moreover, the height X of the protrusions and the material of the seal explained in the second and third examples are also employed in the fourth example.

Even in this configuration, similarly to the third example, it is possible to prevent toner from being entered into the gap between the end surface 332*h* of the container shutter and the surface of the front end 611*a* of the conveying nozzle and to reduce the sliding load applied to the toner due to the rotation of the container body 33, so that toner cohesion can be prevented. Furthermore, when the toner container 32 is detached from the toner replenishing device 60, it is possible to prevent the toner from falling down inside the image forming apparatus or falling down to the floor, enabling to prevent dirty stain.

Moreover, because the protrusions are formed in the annular shape, it becomes possible to distribute the pressing force of the front end 611*a* of the conveying nozzle, so that abrasion resistance of the protrusions can be improved compared to the third example.

Incidentally, while the configuration including both of the seal 3501*b* and the seal 3502*b* is explained in the present example, it may be possible to provide only one of them, or it may be possible not to provide the seal similarly to the second example.

Fifth Example

Figure 31:
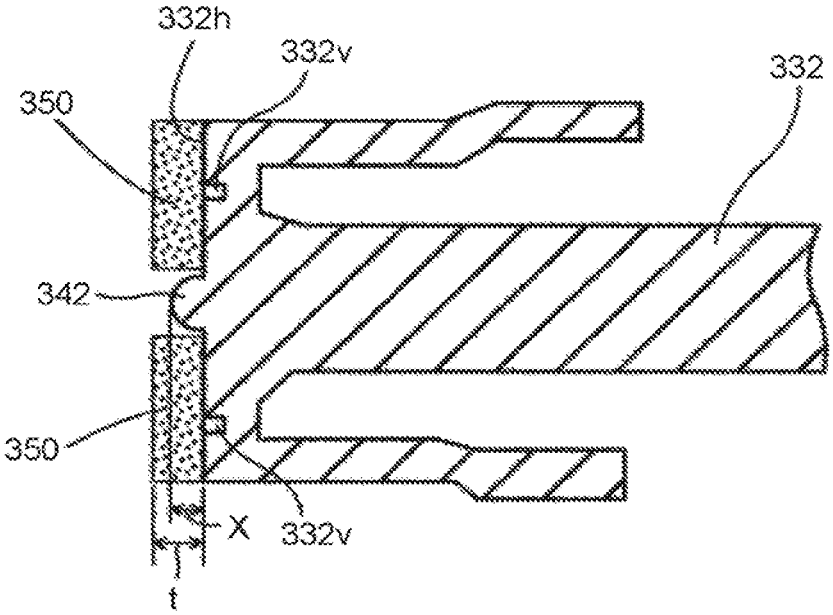
FIG. 31 is an enlarged cross-sectional view of structures of a concave, the seal, and the cohesion preventing mechanism arranged on the end surface of the opening/closing member according to a fifth example of the first embodiment.

A cohesion preventing mechanism according to a fifth example will be explained below. The container shutter 332 is a resin component that is integrally formed by injection molding. In this case, resin is injected into a mold via a nozzle, a sprue, and a runner. At this time, a gate mark (concaves 332*v*) of a gate may remain on the container shutter 332. In the container shutter 332 according to the present example, resin is homogeneously injected into the mold; therefore, as illustrated in FIG. 31, gates are formed at three portions that are equally divided into three with respect to the center of the end surface 332*h* of the container shutter. Therefore, the concaves 332*v* may remain as a gate mark.

When the gate mark is formed as the concaves 332*v*, and if the end surface 332*h* of the container shutter is exposed as in the second example, toner is likely to be accumulated in the concaves 332*v*. Accordingly, when the toner container 32 is detached from the toner replenishing device 60, the amount of toner adhering to the gap between the surfaces is greater than the second example, so that the toner may fall down inside the toner replenishing device 60 and may result in dirty stain.

Therefore, as illustrated in FIG. 31, the seal 350 covers the concaves 332*v*. With this configuration, it becomes possible to prevent toner from being entered into the concaves 332*v*. Therefore, when the toner container 32 is detached from the toner replenishing device 60, it becomes possible to prevent the toner from falling down inside the image forming apparatus or falling down to the floor, enabling to prevent dirty stain.

Therefore, it is possible to prevent toner from being entered into the gap between the end surface 332*h* of the container shutter and the surface of the front end 611*a* of the conveying nozzle.

Incidentally, it may be possible to perform post processing to fill in the concaves 332*v* instead of using the seal 350. For example, it may be possible to inject resin in the concaves 332*v* and solidify the resin. Alternatively, it may be possible to fit corresponding parts into the concaves 332*v* or to attach a tape to close the concaves 332*v*. With this configuration, even when the seal 350 is not provided, it becomes possible to prevent accumulation of toner in the concaves 332*v*, enabling to achieve the same advantageous effects as described in the second example.

Sixth Example

While component costs increase compared to the toner container 32 illustrated in FIG. 1, a configuration described below may be employed, in which the container body 33 is formed as a cylindrical member made of resin (in the following, described as a container body 1033 to distinguish it from the container body of the other examples) and a scooping function is provided in a part of an inner conveyor. In the following, an explanation will be given of a configuration in which the cohesion preventing mechanism (the drive transmitting mechanism) of the first example and the cohesion preventing mechanism (the protrusion and the seal) of the third example are mounted on the above-described structure.

Figure 34A:
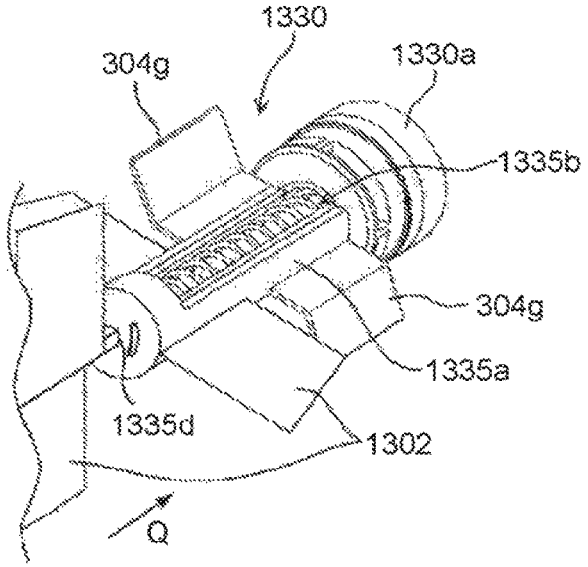
FIG. 34A is an explanatory perspective view of a nozzle receiver provided with scooping ribs serving as scooping portions according to a sixth example of the first embodiment.
Figure 34B:
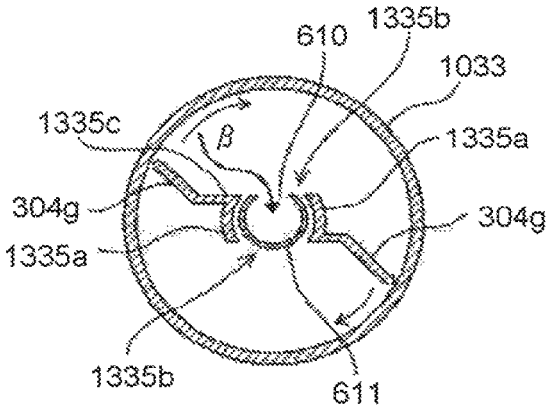
FIG. 34B is an explanatory cross-sectional view of a state in which the nozzle receiver illustrated in FIG. 34A is mounted on a container body.
Figure 34C:
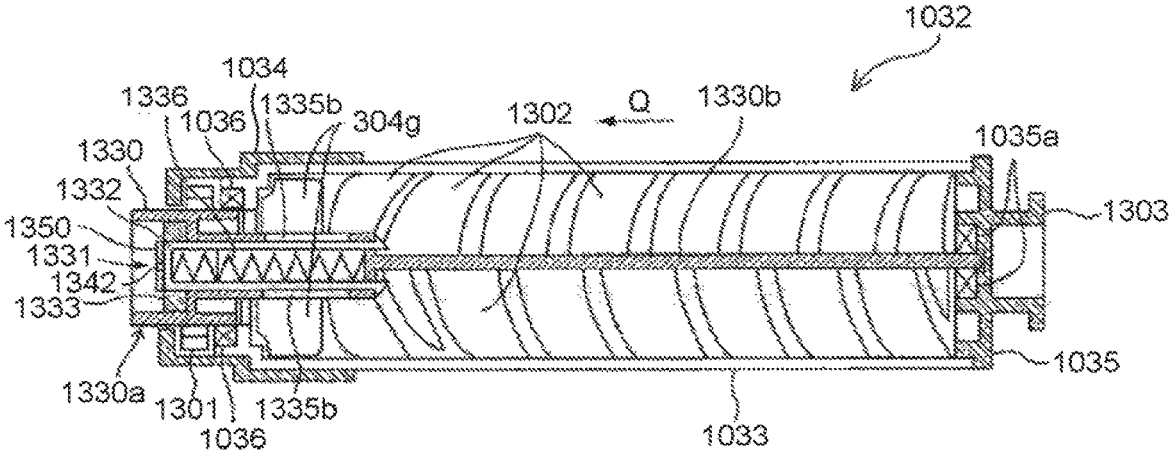
FIG. 34C is an explanatory lateral cross-sectional view of the entire powder container on which the nozzle receiver illustrated in FIG. 34A is mounted.
Figure 34D:
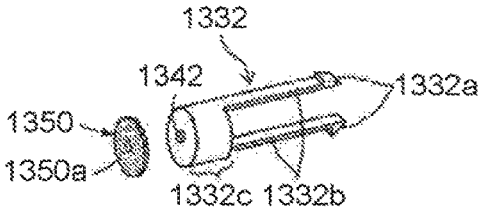
FIG. 34D is a perspective view of a container shutter of the powder container illustrated in FIG. 34C.

FIG. 34A is a perspective view of the nozzle receiver 330 integrated with scooping ribs 304*g* corresponding to the scooping wall surfaces 304*f* (hereinafter, the nozzle receiver is referred to as a nozzle receiver 1330 serving as a nozzle insertion member). FIG. 34B is a cross-sectional view illustrating arrangement of the nozzle receiver 1330 illustrated in FIG. 34 inside the container body 1033, and a relationship with respect to the conveying nozzle 611. FIG. 34C is an explanatory lateral cross-sectional view of an entire toner container 1032, which serves as a powder container and on which the nozzle receiver 1330 illustrated in FIG. 34A is mounted. FIG. 34D is a perspective view of a container shutter 1332, which serves as an opening/closing member and which is a part of the toner container 1032.

The nozzle receiver 1330 illustrated in FIGS. 34A to 34D includes the scooping ribs 304*g* as described above, and is integrated with a conveying blade holder 1330*b* to which conveying blades 1302 made of a flexible material, such as a resin film, are fixed. The rotary conveying blades 1302 and the conveying blade holder 1330*b* serve as a rotary conveyor.

Furthermore, the nozzle receiver 1330 illustrated in FIGS. 34A to 34D includes a container seal 1333 serving as a sealing member, a receiving opening 1331 serving as a nozzle insertion opening, the container shutter 1332, and a container shutter spring 1336 serving as a biasing member. The container seal 1333 is a seal including a front surface that faces and comes in contact with the nozzle shutter flange 612*a* of the nozzle shutter 612 held by the conveying nozzle 611 when the toner container 1032 is attached to the main body of the copier 500. The receiving opening 1331 is an opening in which the conveying nozzle 611 is inserted. The container shutter 1332 is a shutter member that opens and closes the receiving opening 1331. The container shutter spring 1336 is a biasing member that biases the container shutter 1332 to a position at which the receiving opening 1331 is closed.

Moreover, in the configuration illustrated in FIGS. 34A to 34D, the nozzle receiver 1330 includes an outer surface 1330*a* that is slidably fitted to an inner surface of a container setting section 615 of the main body of the copier 500. A container gear 1301 formed as a separate body is fixed to the nozzle receiver 1330 such that drive can be transmitted.

As described above, it is possible to integrate the structures, such as a scooping inner wall surface, a bridging portion, and openings 1335*b* as shutter side openings of the shutter supporting portion, for introducing toner to the nozzle hole 610.

Detailed configurations for mounting the nozzle receiver 1330 and the container shutter 1332 will be explained below.

As illustrated in FIG. 34D, the container shutter 1332 includes a front cylindrical portion 1332*c*, which serves as a closure and which comes in contact with the conveying nozzle 611, and includes a pair of guiding pieces 1332*b* having different shapes from the guiding rod 332*e* of the first example. The guiding pieces 1332*b* extend from the front cylindrical portion 1332*c* in the longitudinal direction of the container body 1033, and include a pair of shutter hooks 1332*a* that prevent the container shutter 1332 from coming out of the nozzle receiver 1330 due to the bias by the container shutter spring 1336. The guiding pieces 1332*b* are formed to include the shutter hooks 1332*a* serving as stoppers (hooks) at respective ends that are shaped as if they are remained after a cylinder is cut in the axial direction. Therefore, the outer surfaces of the guiding pieces 1332*b* and the inner surfaces of the guiding pieces 1332*b* facing the container shutter spring 1336 are curved surfaces.

In contrast, a shutter rear supporting portion 1335 serving as a shutter rear portion illustrated in FIG. 34A includes a rear end opening 1335*d* serving as a through hole or a cohesion preventing mechanism such that the guiding pieces 1332*b* can move in the longitudinal direction. The shapes of the guiding pieces 1332*b* and the rear end opening 1335*d* viewed in the axial direction are approximately the same as those illustrated in FIG. 20B. Therefore, the guiding pieces 1332*b* can move relative to the shutter rear supporting portion 1335 in the longitudinal direction, but cannot rotate relative to the shutter rear supporting portion 1335. Therefore, the container shutter 1332 rotates with rotation of the nozzle receiver 1330, and the shutter rear supporting portion 1335 and the guiding pieces 1332*b* implement the same functions as the drive transmitting mechanism of the first example (the first cohesion preventing mechanism).

Furthermore, as illustrated in FIG. 34D, a protrusion 1342 serving as a cohesion preventing mechanism and a seal 1350, which are the same as those illustrated in FIG. 25, are provided on a container front end side of the container shutter 1332. These structures enable the same operation and achieve the same advantageous effects as those of the third example.

The toner container 1032 including the scooping ribs 304*g* will be described in detail below.

As illustrated in FIG. 34C, the toner container 1032 includes a container front end cover 1034 serving as a container cover, the container body 1033, a rear cover 1035 serving as a rear cap, the nozzle receiver 1330, and the like. The container front end cover 1034 is arranged on the front end of the toner container 1032 in the attachment direction with respect to the main body of the copier 500. The container body 1033 has an approximately cylindrical shape. The rear cover 1035 is arranged on the rear end of the toner container 1032 in the attachment direction. The nozzle receiver 1330 is rotatably held by the approximately cylindrical container body 1033 as described above.

A gear exposing hole 1034*a* (a hole similar to the gear exposing hole 34*a*) is arranged on the container front end cover 1034 in order to expose the container gear 1301 fixed to the nozzle receiver 1330. The approximately cylindrical container body 1033 holds the nozzle receiver 1330 so that the nozzle receiver 1330 can rotate. The container front end cover 1034 and the rear cover 1035 are fixed to the container body 1033 (by a well-known method, such as thermal welding or adhesive agent). The rear cover 1035 includes a rear side bearing 1035*a* that supports one end of the conveying blade holder 1330*b*, and includes a gripper 1303 that a user can grip when he/she attaches and detaches the toner container 1032 to and from the copier 500.

A method to assemble the container front end cover 1034, the rear cover 1035, and the nozzle receiver 1330 on the container body 1033 will be explained below.

The nozzle receiver 1330 is first inserted in the container body 1033 from the container rear end side, and positioning is performed such that the nozzle receiver 1330 is rotatably supported by a front side bearing 1036 arranged on the front end of the container body 1033. Subsequently, positioning is performed such that one end of the conveying blade holder 1330*b* of the nozzle receiver 1330 is rotatably supported by the rear side bearing 1035*a* arranged on the rear cover 1035, and the rear cover 1035 is fixed to the container body 1033. Thereafter, the container gear 1301 is fixed to the nozzle receiver 1330 from the container front end side. After the container gear 1301 is fixed, the container front end cover 1034 is fixed to the container body 1033 so as to cover the container gear 1301 from the container front end side.

Incidentally, the fixation between the container body 1033 and the container front end cover 1034, the fixation between the container body 1033 and the rear cover 1035, and the fixation between the nozzle receiver 1330 and the container gear 1301 are performed by appropriately using a well-known method (for example, thermal welding, adhesive agent, or the like).

A configuration for conveying toner from the toner container 1032 to the nozzle hole 610 will be explained below.

The scooping ribs 304*g* protrude so as to come closer to the inner surface of the container body 1033 such that rib surfaces are continued from downstream ends 1335*c*, which are on the downstream side in the rotation direction, of shutter side supporting portions 1335*a* serving as shutter side portions. The rib surfaces are bent once in the middle portions so as to resemble curved surfaces. However, the configuration is not limited to this example depending on the compatibility with toner. For example simple flat ribs without bend may be used. With this configuration, it becomes not necessary to form a bulged portion in the container body 1033. Furthermore, because the scooping ribs 304*g* stand from the opening 1335*b* of the shutter supporting portion in an integrated manner, it becomes possible to obtain the same bridging function and advantageous effects as those obtained by fitting the shutter side supporting portion 335*a* and the convex 304*h*. Specifically, when the nozzle receiver 1330 rotates while the toner container 1032 is attached to the main body of the image forming apparatus, the conveying blades are rotated, so that toner contained in the toner container 1032 is conveyed from the rear end side to the front end side where the nozzle receiver 1330 is arranged. Subsequently, the scooping ribs 304*g* receive the toner conveyed by the conveying blades 1302, scoop up the toner from bottom to top along with the rotation, and introduce the toner into the nozzle hole 610 by using the rib surfaces as slides.

While the first example and the second to sixth examples are explained separately, the present invention is not limited to these examples and may be embodied in various forms. For example, a container shutter may be configured by combining the first example and any of the second to fifth examples, a nozzle insertion member may include this container shutter, a toner container may include this nozzle insertion member, and an image forming apparatus may include this toner container.

Second Embodiment

A second embodiment will be explained below with reference to drawings. The configurations common to all of the embodiments and the same components or components with the same functions as those of the first embodiment are denoted by the same reference numerals and symbols, and the same explanation will not be repeated. The descriptions below are mere examples and do not limit the scope of the appended claims. In the drawings, Y, M, C, and K are symbols appended to components corresponding to yellow, magenta, cyan, and black, respectively, and will be omitted appropriately.

First, problems to be solved will be explained below.

The toner container disclosed in Japanese Patent Application Laid-open No. 2012-133349 includes a shutter to move to the inside and outside of the toner container while being in contact with a nozzle that moves inward or outward from an image forming apparatus side, and includes a nozzle receiver that holds the shutter. When the toner container is set in the image forming apparatus, the nozzle enters the toner container and then the toner container is rotated, so that toner is supplied inside the toner container. Furthermore, when the toner container is left alone (for example, when the toner container is detached from the image forming apparatus or the toner container is left before being attached to the image forming apparatus), the shutter is located at a position at which an opening of the toner container is closed, and a seal serving as a sealing member is arranged on the circumference of the shutter.

It is desirable that the seal can increase the adhesion with respect to the shutter and prevent toner leakage when the toner container is left alone, and the seal can reduce heat generation due to sliding with the nozzle when the toner container is attached to the image forming apparatus.

An object of the second embodiment is to provide a sealing member that prevents toner leakage and reduces heat generation due to sliding with the nozzle, a powder container including the sealing member, and an image forming apparatus including the powder container.

The nozzle receiver 330 fixed to the toner container 32 according to the second embodiment will be explained below.

Figure 35:
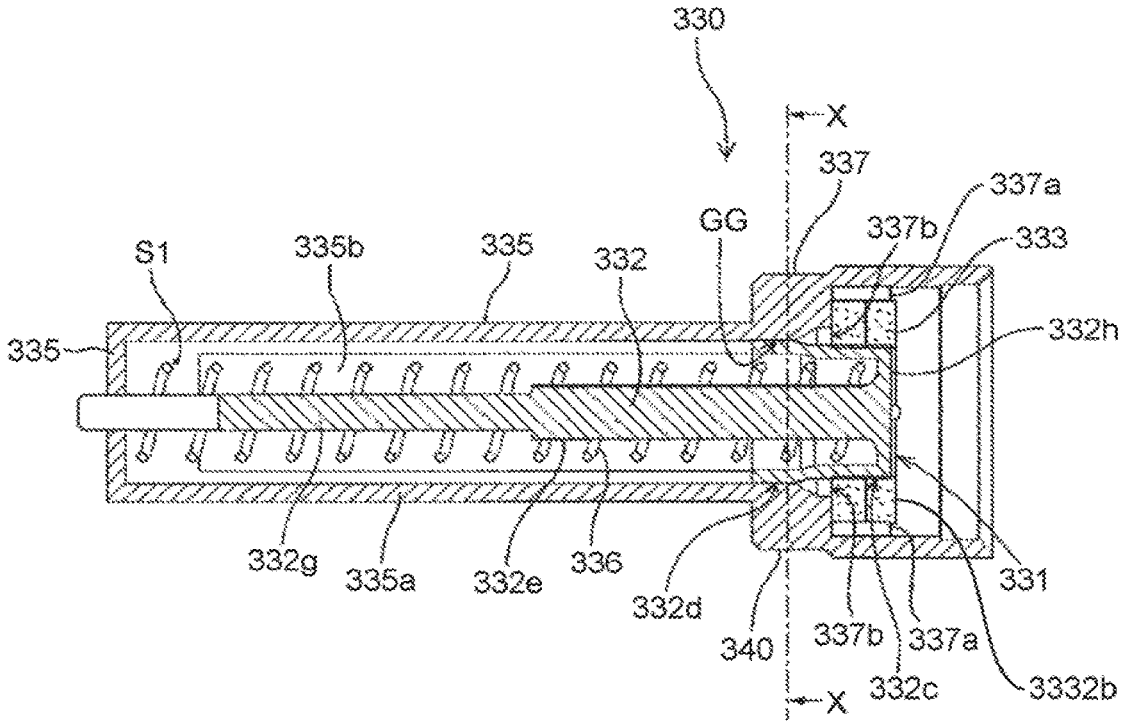
FIG. 35 is a top cross-sectional view of a nozzle receiver according to a second embodiment.
Figure 36:
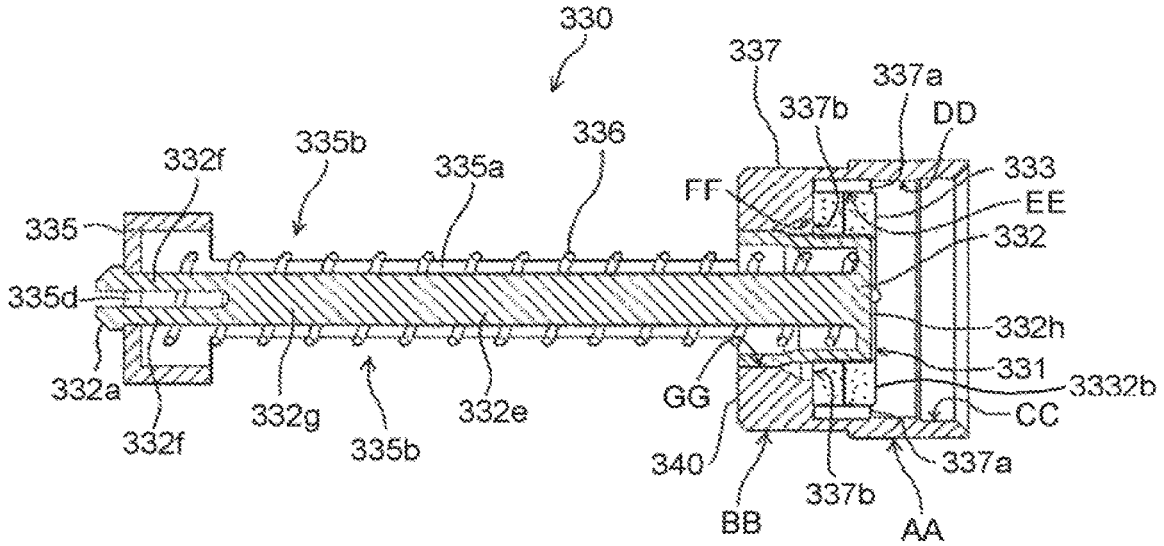
FIG. 36 is a transverse cross-sectional view of the nozzle receiver according to the second embodiment.
Figure 37:
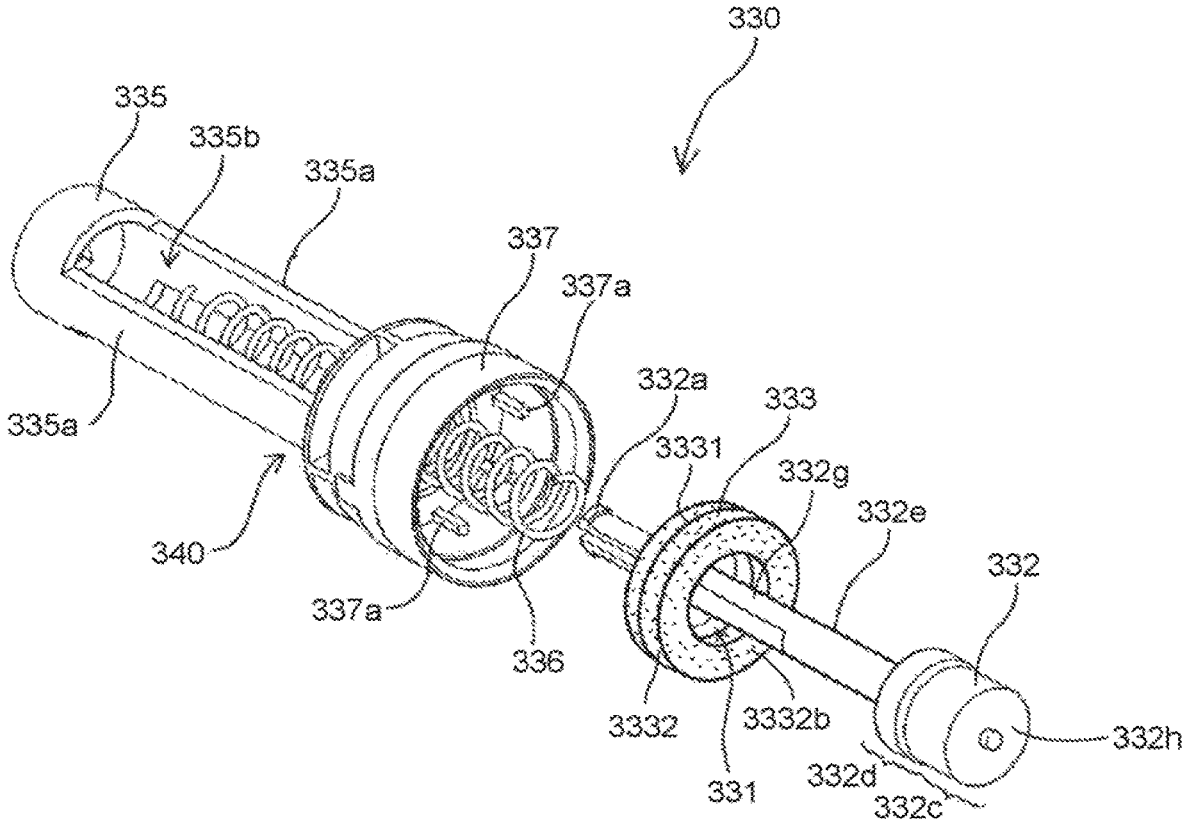
FIG. 37 is an exploded perspective view of the nozzle receiver according to the second embodiment.

As illustrated in FIG. 35 to FIG. 37, a plurality of the nozzle shutter positioning ribs 337*a* are formed so as to radially extend on the inner surface of the nozzle receiver fixing portion 337 that comes in contact with the outer circumference of the container seal 333. As illustrated in FIG. 35 and FIG. 36, when the container seal 333 is fixed to the nozzle receiver fixing portion 337, a vertical surface (that is, a front surface 3332*b*) of the container seal 333 on the container front end side (in a first moving direction Q1 as explained below) slightly protrudes relative to the front ends of the nozzle shutter positioning ribs 337*a* in the rotation axis direction. The front surface 3332*b* serves as an abutting surface that abuts against the nozzle shutter flange 612*a* serving as a protrusion of the nozzle opening/closing member when the toner container 32 is attached to the toner replenishing device 60.

As illustrated in FIG. 9, when the toner container 32 is attached to the toner replenishing device 60, the nozzle shutter flange 612*a* of the nozzle shutter 612 of the toner replenishing device 60 presses and deforms the protruding portion of the container seal 333 in the first moving direction Q1 by being biased by the nozzle shutter spring 613. The nozzle shutter flange 612*a* further moves inward and abuts against the container front ends of the nozzle shutter positioning ribs 337*a*, thereby covering the front end surface of the container seal 333 and sealing the container from the outside. Therefore, it is possible to ensure the sealing performance in the periphery of the conveying nozzle 611 at the receiving opening 331 in the attached state, enabling to prevent toner leakage.

Next, the container seal 333 serving as the sealing member according to the second embodiment will be explained in detail below.

Figure 38A:
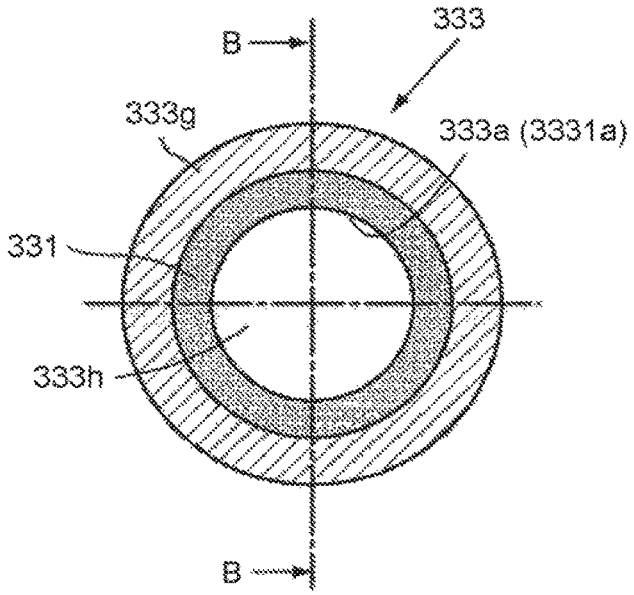
FIG. 38A is a plan view of a sealing member according to the second embodiment.
Figure 38B:
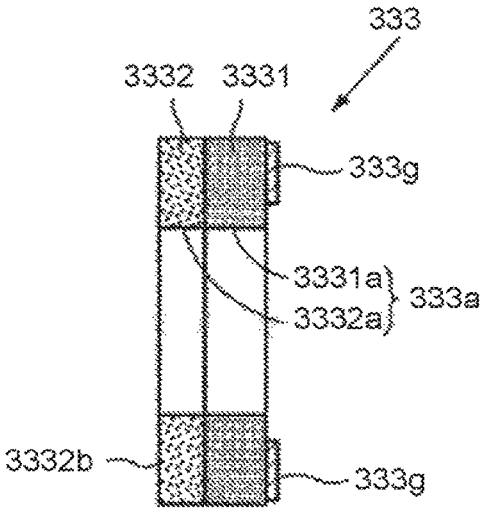
FIG. 38B is a cross-sectional view of the sealing member taken along B-B in FIG. 38A.

As illustrated in FIG. 38B, the container seal 333 includes two layers, in particular, a first layer 3331 and a second layer 3332 that are made of materials with different foam densities.

The container seal 333 includes, as illustrated in FIG. 38A, an annular through hole 333*h* as a circular penetrated portion in the center thereof. The first layer 3331 side of the container seal 333 is attached to the nozzle receiver 330 with a double-sided tape 333*g*. As a method to attach the container seal 333 to the nozzle receiver 330, a well-known method may be used appropriately. Incidentally, in the present embodiment, the through hole 333*h* is formed by punching the first layer 3331 and the second layer 3332 in the thickness direction (overlapping direction) after the first layer 3331 and the second layer 3332 are attached to each other; however, it is not limited thereto. For example, through holes with the same diameters may be formed in both of the first layer 3331 and the second layer 3332 and thereafter the first layer 3331 and the second layer 3332 may be attached to each other.

Figure 38C:
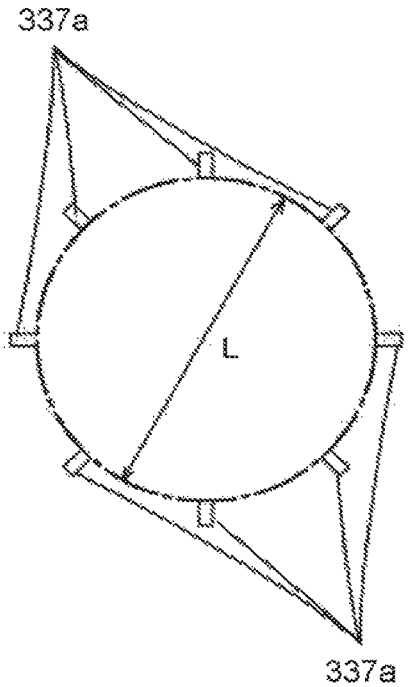
FIG. 38C is an explanatory diagram illustrating a virtual diameter of a nozzle shutter positioning rib.
Figure 38D:
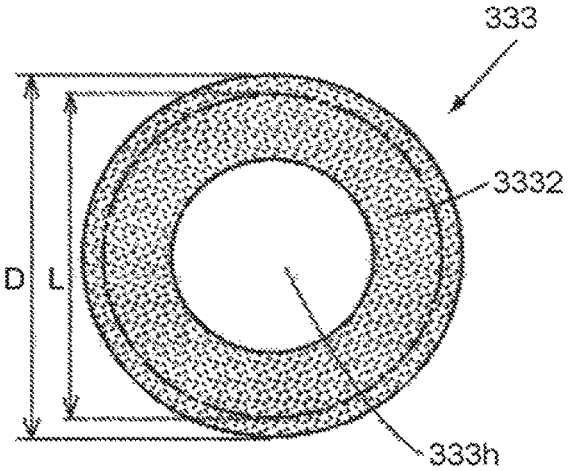
FIG. 38D is an explanatory diagram illustrating a relationship between the virtual diameter of the nozzle shutter positioning rib and the outer diameter of the sealing member.

As illustrated in FIGS. 38C and 38D, a plurality of the nozzle shutter positioning ribs 337*a* serving as abutting portions or convex portions of the nozzle receiver 330 are in contact with the circumference of the container seal 333 in the radial direction. A diameter L of a virtual circle, which is formed by connecting the inner surfaces EE of the nozzle shutter positioning ribs 337*a* (FIG. 36), is set to be slightly smaller than an outer diameter D of the container seal 333. Therefore, when the container seal 333 is attached to the nozzle receiver 330, the container seal 333 is slightly compressed in the radial direction.

Figure 39A:
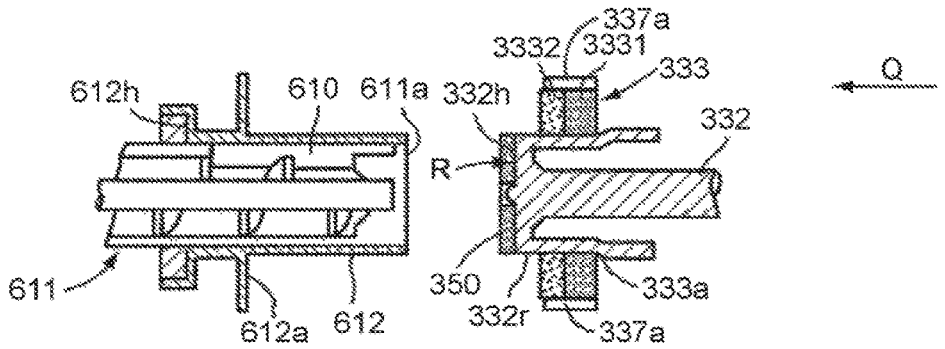
FIG. 39A is a cross-sectional view of main components around the sealing member before the conveying nozzle comes in contact with the opening/closing member in a process of attaching a powder container according to the second embodiment.
Figure 39B:
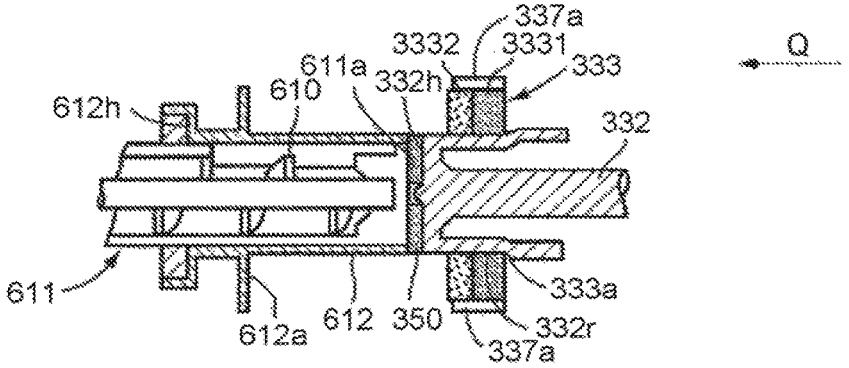
FIG. 39B is a cross-sectional view of the main components around the sealing member when the conveying nozzle comes in contact with a front end of the opening/closing member in the process of attaching the powder container.
Figure 39C:
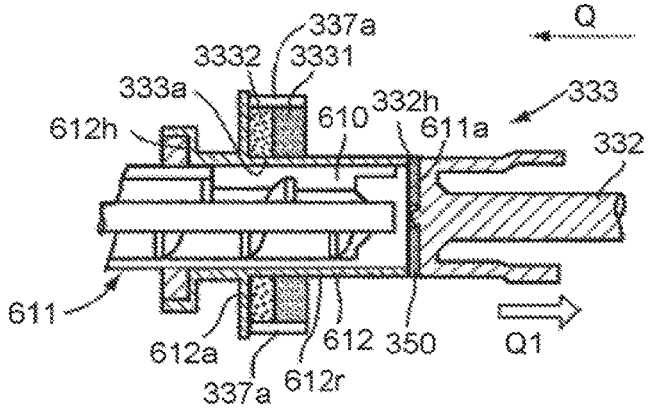
FIG. 39C is a cross-sectional view of the main components around the sealing member when a flange of a nozzle opening/closing member comes in contact with a front end of the sealing member in the process of attaching the powder container.
Figure 39D:
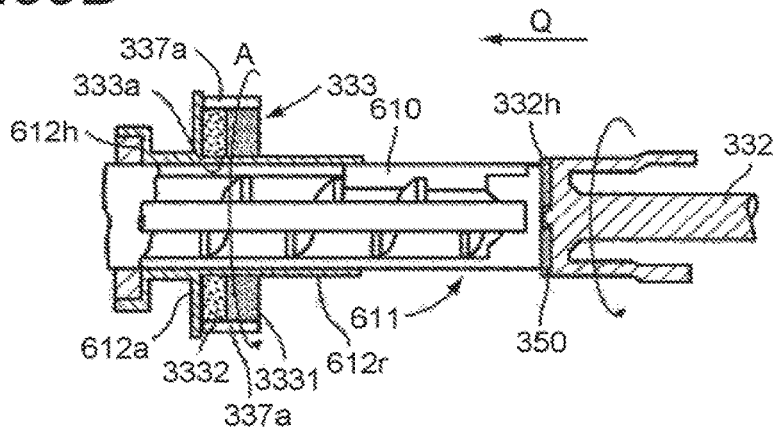
FIG. 39D is a cross-sectional view of the main components around the sealing member when the powder container is attached.

FIG. 39A is a cross-sectional view of the components around the container seal 333 before the conveying nozzle 611 comes in contact with the container shutter 332 in a process of attaching the toner container 32 to the image forming apparatus. FIG. 39B is a cross-sectional view of the components around the container seal 333 when the conveying nozzle 611 comes in contact with the seal 350 arranged on the front end (the container front end side) of the container shutter 332 in the process of attaching the toner container 32 to the image forming apparatus. FIG. 39C is a cross-sectional view of the components around the container seal 333 when the flange 612*a* of the nozzle shutter 612 comes in contact with the front end of the container seal 333 in the process of attaching the toner container 32 to the image forming apparatus. FIG. 39D is a cross-sectional view of the components around the container seal 333 when the toner container 32 is attached to the image forming apparatus.

In the following, a moving direction in which the container shutter 332 moves from the closing position at which the through hole 333*h* of the container seal 333 is sealed as illustrated in FIGS. 39A and 39B to the opening position on the inner side of the toner container 32 as illustrated in FIG. 39C via the through hole 333*h* of the container seal 333 is referred to as the first moving direction and is denoted by Q1.

As illustrated in FIG. 39A, the receiving opening 331 (that is, the through hole 333*h* of the container seal 333) is sealed with the nozzle shutter 612 until the conveying nozzle 611 is attached to the toner container 32. Furthermore, the diameter of the through hole 333*h* serving as an inner surface 333*a*, which is a sliding-contact surface or an inner surface of the nozzle insertion opening, of the container seal 333 and the diameter of an outer surface 332*r* of the front cylindrical portion 332*c* of the container shutter 332 are set so that a close-fitting state can be achieved. Specifically, as illustrated in FIG. 42, assuming that the diameter (inner diameter) of the through hole 333*h* is denoted by W1, the diameter (outer diameter) of an outer surface 612*r* of the nozzle shutter 612 is denoted by W2, and the diameter (outer diameter) of the outer surface 332*r* of the front cylindrical portion 332*c* of the container shutter 332 is denoted by W3, W1<W2<W3 is satisfied.

More specifically, W1=13.7 mm, W2=15 mm, and W3=15.9 mm. Furthermore, a symbol W4 in FIG. 40 indicates the diameter (outer diameter) of an outer surface 332*u* of the slide area 332*d* that is continued from an inclined surface 332*t* that extends outward from the front cylindrical portion 332*c* of the container shutter 332.

The through hole 333*h* serves as at least a part of the receiving opening 331. The first layer 3331 of the container seal 333 is attached to the nozzle receiver fixing portion 337 (the nozzle receiver 330) such that the first layer 3331 is oriented on the inner side of the toner container 32 (on the downstream side in the first moving direction Q1) and the second layer 3332 is oriented on the outer side of the toner container 32. Specifically, the container seal 333 includes the first layer 3331 on the downstream side in the first moving direction Q1 and includes the second layer 3332 on the upstream side in the same direction. The first layer 3331 includes an inner surface 3331*a* and the second layer 3332 includes an inner surface 3332*a*. The inner surfaces 3331*a* and 3332*a* form the inner surface 333*a* of the container seal 333 when the first layer 3331 and the second layer 3332 are bonded and integrated together.

As a layered structure of the container seal 333, if the first layer 3331 with a higher foam density is formed on the downstream side rather than on the upstream side in the first moving direction Q1, it becomes possible to prevent toner leakage and toner scattering in the more inner side where the toner is stored, as compared to a structure in which the second layer 3332 with a lower foam density is formed on the downstream side in the first moving direction Q1. Specifically, when the toner container 32 is not attached to the image forming apparatus, the inner surface 3331*a* of the first layer 3331 is fit to the outer surface 332*r* of the container shutter 332, so that toner does not move outward from the first layer 3331 (in the direction of arrow Q in the drawings). Therefore, for example, even if the toner container 32 unexpectedly falls down while the toner container 32 is being shipped, and the inertial force due to the drop impact acts on the container shutter 332 to cause the container shutter 332 to be deviated from the container seal 333, toner scattering can be prevented.

More specifically, the container seal 333 can improve the adhesion with respect to the outer surface 332*r* at a position on the most inner side of the inner surface 3331*a* with respect to the toner container, so that the effect to prevent the toner scattering can further be improved.

As illustrated in FIG. 39A, in the present embodiment, the seal 350 made of an elastic material, such as expanded polyurethane, is arranged in a non-contact area R of the end surface 332*h* of the container shutter 332 with respect to the front end 611*a* of the conveying nozzle. As illustrated in FIG. 39B, when the front end 611*a* of the conveying nozzle and the seal 350 come in contact with each other, the seal 350 is compressed and deformed and therefore fills the gap between the front end 611*a* of the conveying nozzle and the end surface 332*h* of the container shutter. Therefore, in FIG. 39D, it becomes possible to lower the possibility that the toner is entered into the gap between the front end 611*a* of the conveying nozzle and the end surface 332*h* of the container shutter.

As illustrated in FIG. 39C, when the toner container 32 is further moved in the setting direction Q in which the toner container is set on the image forming apparatus, the container shutter 332 comes in contact with the conveying nozzle 611 and moves inward with respect to the toner container (to the downstream side in the first moving direction Q1). At this time, the conveying nozzle 611 is inserted in the toner container together with the nozzle shutter 612 that covers the outer side of the conveying nozzle 611. Specifically, the conveying nozzle 611 and the nozzle shutter 612 are inserted in the through hole 333*h* of the container seal 333 along with the movement of the container shutter 332 while the contact state between the seal 350 arranged on the end surface 332*h* of the container shutter 332 and the front end 611*a* of the conveying nozzle is maintained. Furthermore, according to the relationship as illustrated in FIG. 42, the outer surface 612*r* of the nozzle shutter 612 and the inner surface 333*a* of the container seal 333 are fitted such that toner does not leak from the gap between the surfaces.

When the toner container 32 is further moved in the setting direction Q with respect to the image forming apparatus, the nozzle shutter flange 612*a* as an abutted part comes in contact with the front ends of the nozzle shutter positioning ribs 337*a* (the upstream side in the first moving direction Q1). A plurality of the nozzle shutter positioning ribs 337*a* are arranged on the inner surface of the front end opening 305 that is a cylindrical inner space of the nozzle receiver 330.

When the toner container 32 is further moved in the setting direction Q with respect to the image forming apparatus, the container shutter 332 further moves inward (to the downstream side in the first moving direction Q1) with respect to the toner container 32 because the end surface 332*h* is in contact with the front end 611*a* of the conveying nozzle 611 via the seal 350. Furthermore, the nozzle shutter flange 612*a* of the nozzle shutter 612 comes in contact with the nozzle shutter positioning ribs 337*a* of the nozzle receiver 330. Therefore, the nozzle shutter 612 moves toward a base end (in the setting direction Q) of the conveying nozzle 611 along with the movement of the toner container 32. With the movement of the nozzle shutter 612, the nozzle hole 610 of the conveying nozzle 611 is opened. Subsequently, the container opening 33*a* of the toner container 32 reaches the container setting section 615 of the image forming apparatus and is rotatably held, so that the setting of the toner container 32 on the image forming apparatus is completed (FIG. 39D).

In contrast, when the toner container 32 is detached from the setting section of the image forming apparatus, operation reverse to the attachment operation is performed. That is, the state in FIG. 39D first changes to the state in FIG. 39C, and then changes to the states in FIG. 39B and FIG. 39A in sequence, so that the toner container 32 is detached from the image forming apparatus.

Specifically, in the change from the state in FIG. 39D to the state in FIG. 39C, the toner container 32 moves in the opposite direction (the first moving direction Q1) of the setting direction Q, so that the container seal 333 attached to the nozzle receiver 330 fixed to the container body 33 moves in the opposite direction (the first moving direction Q1) of the setting direction Q. With this movement, the nozzle shutter 612 also moves in the opposite direction of the setting direction Q. Then, the conveying nozzle 611 and the container shutter 332 move, with respect to the toner container 32, in a direction (pull-out direction) in which they are pulled out of the through hole 333*h* of the container seal 333.

Subsequently, in the change from the state in FIG. 39C to the state in FIG. 39B, the toner container 32 further moves in the opposite direction of the setting direction Q, so that the container seal 333 attached to the nozzle receiver 330 fixed to the container body 33 further moves in the opposite direction of the setting direction Q. When the nozzle shutter 612 moves in the pull-out direction as described above, the outer surface 612*r* of the nozzle shutter and the inner surface 333*a* of the container seal 333 come in sliding-contact with each other, so that toner that has adhered to the outer surface 612*r* while the toner container 32 has been set on the image forming apparatus is wiped out by the container seal 333. In particular, the inner surface 3332*a* of the second layer 3332 of the container seal 333 has a cleaning function as described above. The container shutter 332 then reaches the closing position at which the through hole 333*h* of the container seal 333 is sealed.

Subsequently, in the change from the state in FIG. 39B to the state in FIG. 39A, the toner container 32 further moves in the opposite direction of the setting direction Q, so that the seal 350 arranged on the end surface 332*h* of the container shutter is separated from the front end 611*a* of the conveying nozzle. As described above, the toner container 32 is detached from the setting section of the image forming apparatus.

Incidentally, if the toner container 32 is rotated in the set state in which the setting of the toner container 32 is completed, the container seal 333 rotates relative to the nozzle shutter 612, so that the inner surface 333*a* of the container seal 333 and the outer surface 612*r* of the nozzle shutter 612 come in sliding-contact with each other. Namely, the inner surface 333*a* of the container seal 333 serves as a sliding-contact surface. It is preferable that, even when the toner container 32 is rotating, the inner surface 333*a* of the container seal 333 and the outer surface 612*r* of the nozzle shutter 612 are fitted to each other in order to prevent toner leakage. However, in some cases, heat is generated between the inner surface 333*a* of the container seal 333 and the outer surface 612*r* of the nozzle shutter 612 due to the sliding.

Figure 51A:
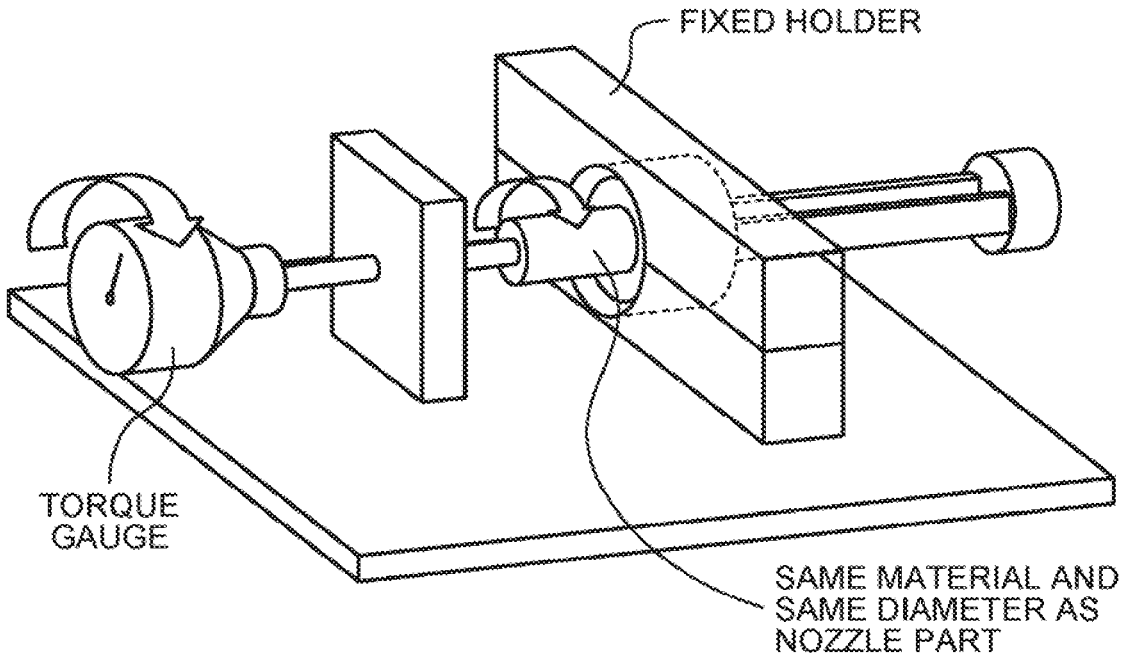
FIGS. 51A and 51B are views for explaining methods of measuring load torque.

To cope with this, the container seal 333 was configured such that the inner surface 333*a* serving as the sliding-contact surface had a lower frictional force on the upstream side in the first moving direction Q1 than that of the downstream side. In this configuration, it was possible to cope with heat due to the sliding. Therefore, in the present embodiment, the container seal 333 is formed of two layers as described above, that is, the first layer 3331 and the second layer 3332, made of materials with different friction coefficients such that the inner surface 3331*a* of the first layer and the inner surface 3332*a* of the second layer come in sliding-contact with the outer surface 612*r* of the nozzle shutter 612. Incidentally, the frictional force can be specified based on a measurement result obtained by measuring, as illustrated in FIG. 51A, load torque with a torque gauge when the toner container rotates in the state in FIG. 39D.

Figure 51B:
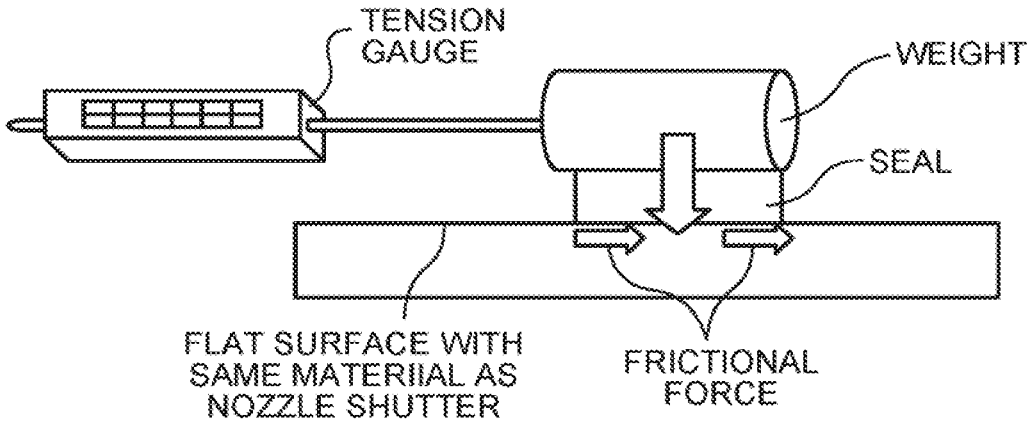

Meanwhile, the measurement result may be obtained by measurement as illustrated in FIG. 51B. Specifically, a flat surface is first generated with the same material as the nozzle shutter 612 (for example, the same material as the nozzle shutter 612 is attached to a board or the like). Then, the first layer 3331 or the second layer 3332 of container seal 333 is placed on the flat surface, and an appropriate amount (for example, 100 grams (g)) of weight is placed on and bonded to the first layer 3331 or the second layer 3332.

Subsequently, a tension gauge is connected to the weight, the first layer 3331 or the second layer 3332 is pulled on the flat surface via the tension gauge, and the tension (kilogram-weights (kgw)) at the time the first layer 3331 or the second layer 3332 bonded to the weight starts moving (sliding) on the flat surface is measured.

The first layer 3331 is preferably made with microcellular polymer, such as PORON (registered trademark) (manufactured by INOAC Corporation), which is high-density urethane foam with extremely fine and homogeneous cell structure and excellent slidability. The first layer 3331 forms a slide layer. PORON has a low expansion ratio (i.e., high foam density) and each cell is independent of the other cells, so that sealing performance with respect to toner is ensured but heat is less likely to be released. Incidentally, the expansion ratio indicates the volume of a certain amount of a cellular plastic compared to the volume of the same amount of a solid plastic (which is obtained by dividing the apparent density of the cellular plastic by the density of the unexpanded plastic).

The second layer 3332 is preferably made with expanded polyurethane (a so-called sponge material including, for example, polyester polyurethane foam), such as Moltpren (registered trademark) (manufactured by INOAC Corporation), which has a lower friction coefficient than that of the first layer. The second layer 3332 forms a low frictional layer. Moltpren has a high expansion ratio (i.e., low foam density) and each cell is connected to the other cells, so that heat is easily released. Furthermore, Moltpren has an advantage with respect to heat because of a small contact area with the nozzle shutter 612. The first layer 3331 and the second layer 3332 can be attached to each other by appropriately using a well-known method. For example, in the embodiment, the first and the second layers are attached with adhesive agent.

Therefore, it becomes possible to reduce heat generation at the sliding-contact surface compared to a single-layer seal structure, in which the entire width (entire layer thickness) of the container seal 333 is made with, for example, only the first layer 3331 (PORON layer). Specifically, it becomes possible to reduce heat generation at the inner surface 333*a* serving as a sliding-contact surface by reducing the width of the first layer 3331 (layer thickness) within the entire width (entire layer thickness) of the container seal 333 so that a sliding area between the inner surface 3331*a* of the first layer 3331 and the outer surface 612*r* of the nozzle shutter 612 can be reduced.

Incidentally, to further reduce heat generation at the inner surface 333*a* (the sliding-contact surface) of the container seal 333 while the toner container 32 is rotating, it is effective to further reduce the width of the first layer 3331 (thickness) and the width of the second layer 3332 (thickness) of the container seal 333. However, if the width of the first layer 3331 (thickness) is reduced too much, it may become difficult to adequately exert the effect to prevent toner scattering by the fitting between the outer surface 332*r* of the container shutter 332 and the inner surface 3331*a* of the first layer 3331 during shipment.

Therefore, further studies and examinations were performed regarding the width of the first layer 3331 (thickness), the width of the second layer 3332 (thickness), a deformation amount of the container seal 333, and a seal form of the container seal 333. The examination result is illustrated in FIG. 40.

Figure 41:
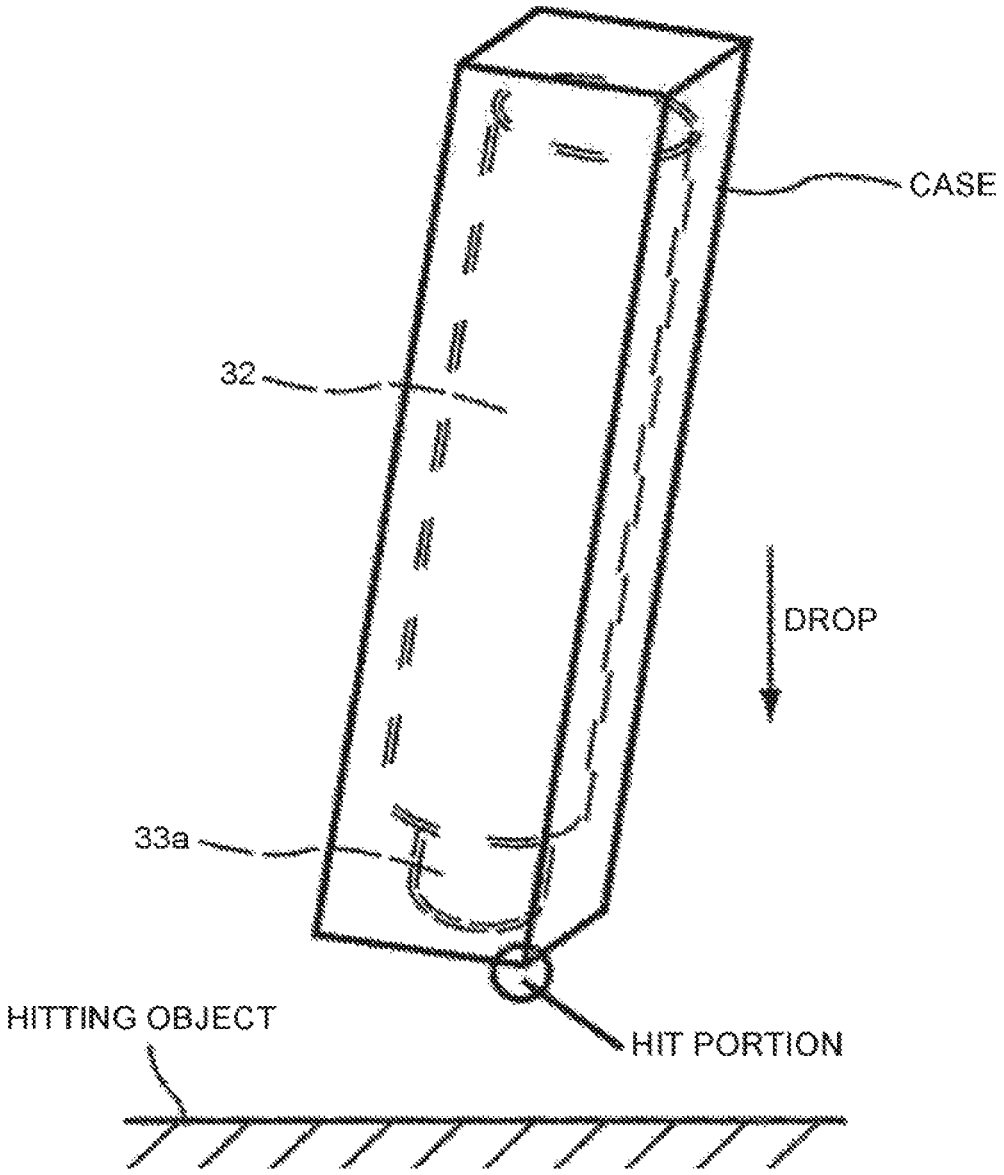
FIG. 41 is a diagram illustrating details of the powder container drop test.

FIG. 40 is an evaluation table of a drop test that was performed on toner containers configured with different parameters including the seal form of the container seal 333, the deformation amount of the container seal 333, and the thicknesses (ratio) of the first layer 3331 and the second layer 3332. In FIG. 40, fourteen types of toner containers were formed with respective sets of parameters each listed in a row. The drop test was performed such that, as illustrated in FIG. 41, the toner container 32 of each type was housed in a storage case and toner leakage was evaluated. As drop conditions of the drop test, the toner container 32 was set in the storage case with the container shutter 332 side face down from the height of 90 centimeters (cm), each of the toner containers was dropped ten times such that a corner of the storage case hits a hitting object, and toner leakage by the hitting was visually checked. When the container body 33 was housed in the storage case, the container front end cover 34 was attached to the container body 33.

Seal Form in FIG. 40

In FIG. 40, the seal form is a cross-section taken along X-X in FIG. 35 and indicates a contact state between the inner surface GG of the nozzle receiver fixing portion 337 and the slide area 332*d* of the container shutter 332. Furthermore, an outer circle of each of the X-X cross-sections of the seal form represents the inner surface GG.

"Entire surface contact" captioned below the cross-sections indicates a state in which the inner surface GG of the nozzle receiver fixing portion 337 and the slide area 332*d* of the container shutter 332 are in surface contact with each other in the entire area in the circumferential direction. Incidentally, an inner circle adjacent to the outer circle representing the inner surface GG represents an outer circumference of the slide area 332*d*. In actuality, the inner surface GG and the slide area 332*d* almost overlap each other in a slidable manner; however, a space in the radial direction is illustrated for convenience of explanation. Incidentally, the slide area 332*d* in the case of the entire surface contact is the same as illustrated in FIG. 37. The slide area 332*d* is formed along the inner surface GG.

"Point contact" captioned below the cross-sections indicates a state in which the shape of the cross-section and the outer diameter of the slide area 332*d* of the container shutter 332 differ from those of the entire surface contact, and four ribs arranged on the outer circumference of the slide area 332*d* as illustrated in the drawing and the inner surface GG of the nozzle receiver fixing portion 337 come in point-contact with each other at four points (marked with "●" in the table). Each of the ribs has an approximately semicircular cross-section and is arranged in a direction normal to the sheet of the drawing. Incidentally, it is assumed that the outer circumference of the slide area 332*d* is smaller than the outer shape of the slide area 332*d* of the entire surface contact.

"Partial surface contact" captioned below the cross-sections indicates a state in which the shape of the slide area 332*d* of the container shutter 332 differs from those of the entire surface contact and the point contact, and outer surfaces of two fan-shaped ribs arranged on the outer circumference of the slide area 332*d* as illustrated in the drawing and the inner surface GG of the nozzle receiver fixing portion 337 come in surface-contact with each other. Specifically, the outer surfaces of the two fan-shaped ribs are formed along the inner surface GG. Incidentally, it is assumed that the outer shape of a portion where the outer surfaces are not formed in the slide area 332*d* is smaller than the outer shape of the slide area 332*d* of the entire surface contact.

As described above, a relationship of the area of contact between the slide area 332*d* of the container shutter 332 and the inner surface GG of the nozzle receiver fixing portion 337 becomes such that "entire surface contact">"partial surface contact">"point contact".

Inner Diameter of the Seal in FIG. 40

Figure 42A:
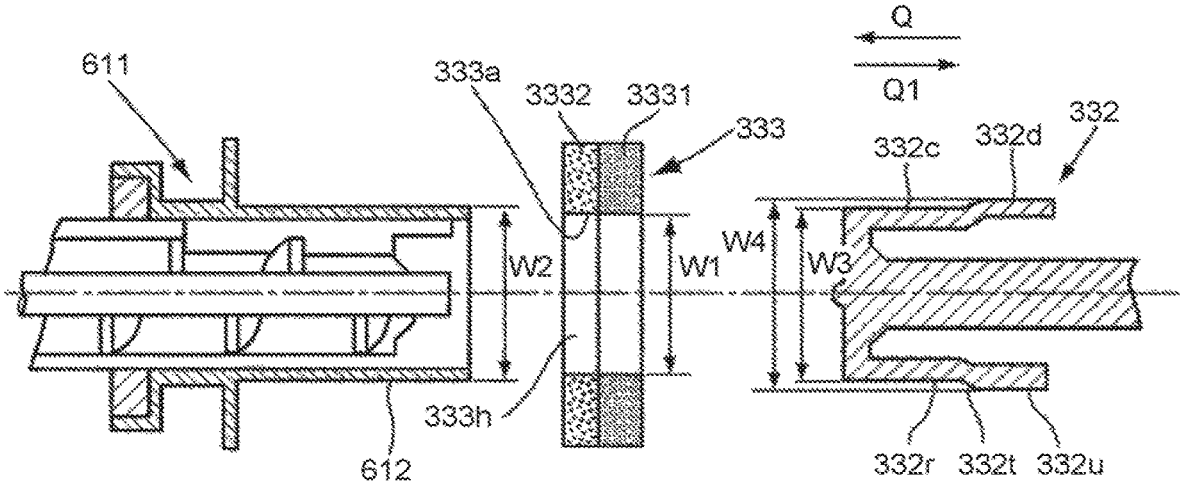
FIG. 42A is an enlarged cross-sectional view for explaining a relationship between the outer diameter of the nozzle opening/closing member, the inner diameter of a through hole of the sealing member according to the second embodiment, and the outer diameter of the opening/closing member.
Figure 42B:
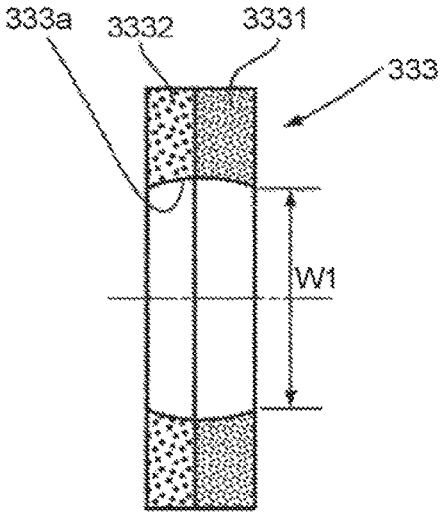
FIG. 42B is an enlarged cross-sectional view of the sealing member according to the second embodiment.

An inner diameter of the seal illustrated in FIG. 40 is, as illustrated in FIGS. 42A and 42B, a diameter (inner diameter) W1 of the through hole 333*h* of the container seal 333. If the through hole 333*h* is formed by punching the first layer 3331 and the second layer 3332 in the thickness direction (overlapping direction) after the first layer 3331 and the second layer 3332 are attached to each other as described above, the inner surface 333*a* is curved as illustrated in FIG. 42B. In this case, the minimum diameter of the inner surface is used as W1.

Front Diameter of the Shutter in FIG. 40

A front diameter of the shutter is a diameter (outer diameter) W3 of the outer surface 332*r* of the front cylindrical portion 332*c* of the container shutter 332 illustrated in FIG. 42A.

Deformation Amount of the Seal in FIG. 40

The deformation amount of the seal illustrated in FIG. 40 is a difference between the diameter (inner diameter) W1 of the through hole 333*h* and the front diameter W3 of the shutter, and indicates the deformation amount of the container seal 333 with respect to the through hole 333*h* in the radial direction of the container seal.

PORON Thickness and Moltpren Thickness in FIG. 40

A PORON thickness illustrated in FIG. 40 is a thickness of PORON used for the first layer 3331 (the thickness in the Q direction in FIG. 42A). A Moltpren thickness illustrated in FIG. 40 is a thickness of Moltpren used for the second layer 3332 (the thickness in the Q direction in FIG. 42A). In this example, the total thickness of the container seal 333 in the axis direction was set to 7 mm, and the thicknesses of the first layer 3331 and the second layer 3332 in the axis direction were changed within the thickness of 7 mm. As combinations of the thicknesses, two combinations were employed, in one of which the first layer 3331 was set to 2 mm and the second layer 3332 was set to 5 mm, and in the other one of which the first layer 3331 was set to 3 mm and the second layer 3332 was set to 4 mm.

Toner Leakage in FIG. 40

In FIG. 40, as evaluations of toner leakage, ◎ (double circle) indicates that no toner leakage occurred, ○ (circle) indicates that toner leakage did not occur in the drop test but slight toner leakage occurred when environmental conditions, such as a temperature or humidity, were changed (over time), Δ (triangle) indicates that slight toner leakage occurred in the drop test, and x (cross mark) indicates that toner leaked out of the container front end cover 34 in the drop test. As the evaluations, ◎, ○, and Δ are acceptable and x is not acceptable.

Sliding Heat in FIG. 40

As evaluations of sliding heat, a thermocouple was disposed inside the conveying nozzle 611, rotation operation for rotating the toner container 32 for 0.9 second and then stopping the toner container 32 for 0.1 second was repeated for 100 seconds, and a temperature at that time was checked. If the temperature was lower than a temperature at which the toner is solidified or melted, the state was evaluated as ○. At the evaluation, the conveying screw in the conveying nozzle 611 was not rotated and toner was not contained in the toner container 32.

Examination Result As illustrated in FIG. 40, when the second layer (Moltpren layer) 3332 was thicker than the first layer (PORON layer) 3331 such that the thicknesses was in the range from 2 mm:5 mm to 3 mm:4 mm, a failure due to the sliding heat did not occur. This may be because sliding resistance was reduced by reducing the ratio of the first layer (PORON layer) 3331 compared to the container seal 333 formed of only the first layer (PORON layer) 3331.

An explanation will be given below with reference to FIG. 43 to FIG. 46 to verify a relationship between the predetermined parameters based on the examination result in FIG. 40.

Figure 43:
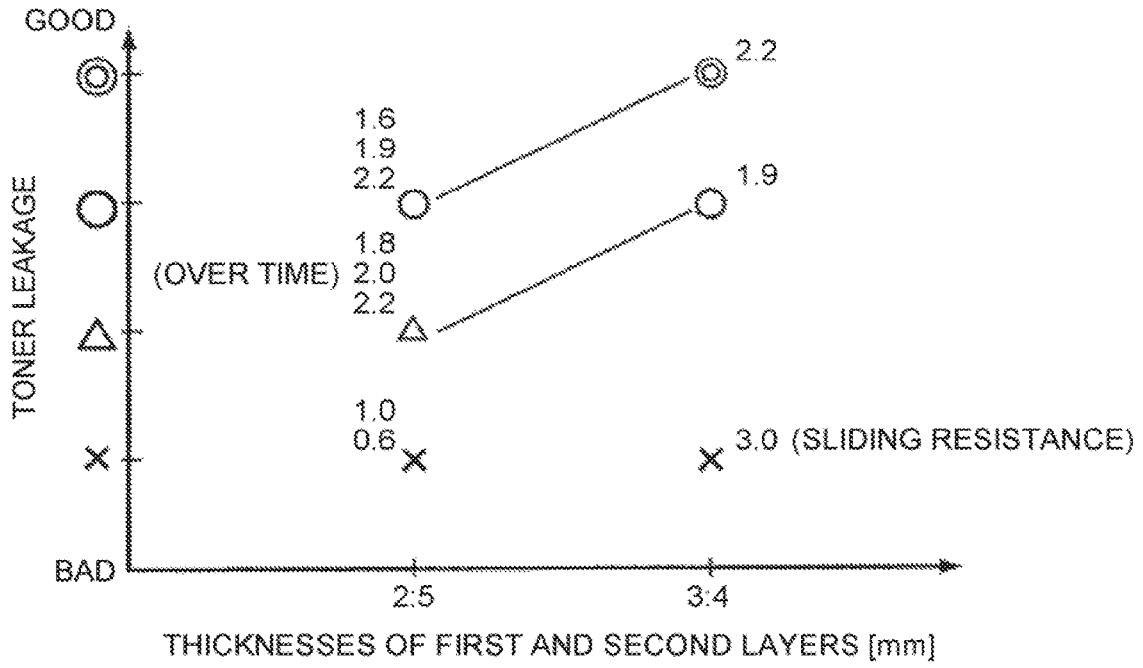
FIG. 43 is a plot of the correlation between the thicknesses of first and second layers and toner leakage extracted from the evaluation result illustrated in FIG. 40.

FIG. 43 is a plot of the correlation between the thicknesses of the first layer 3331 and the second layer 3332 and toner leakage with different deformation amounts of the seal extracted from the examination result in FIG. 40. Numbers shown at plotted points are the deformation amounts of the seal.

As illustrated in FIG. 43, as for the toner leakage, even when the relationship between the thicknesses of the first layer (PORON layer) 3331 and the second layer (Moltpren layer) 3332 was in the range from 2 mm:5 mm to 3 mm:4 mm, if the deformation amount of the seal was other than 0.6 mm and 1.0 mm, the results were acceptable. When the deformation amount of the seal was 0.6 mm or 1.0 mm, toner leakage occurred probably because a gap was generated between the through hole 333*h* and the container shutter 332 when the container seal 333 moved due to the drop impact.

While not shown in the table in FIG. 40, "3.0" in FIG. 43 indicates that the deformation amount of the seal was set to 3 mm. In this case, toner leakage did not occur but the sliding resistance of the container seal 333 against the outer surface 332*r* of the container shutter 332 was increased and the container shutter 332 could not be closed by itself. As described above, when the toner container 32 is left alone, a biasing force of the container shutter spring 336 acts on the container shutter 332, and when the toner container 32 is attached to the apparatus, a biasing force of the nozzle shutter spring 613 for biasing the nozzle shutter 612 also acts on the container shutter 332 in addition to the biasing force of the container shutter spring 336. To maintain the toner container 32 at the setting position (attached state) in the image forming apparatus, the image forming apparatus includes the replenishing device engaging members 609 having a holding force that acts against the two biasing forces of the container shutter spring 336 and the nozzle shutter spring 613.

After the attached state is obtained, when the toner container 32 is detached, the container shutter 332 needs to be closed by itself with the aid of the biasing force of the container shutter spring 336.

If only the toner container 32 in the separated state is simply assumed, it may be sufficient to increase the biasing force of the container shutter spring 336. However, if the biasing force of the container shutter spring 336 is increased, a retracting force increases due to a reaction force generated in the first moving direction Q1 when the container shutter spring 336 is compressed during the attachment operation for moving the toner container 32 in the setting direction Q. Accordingly, the holding force needed in the image forming apparatus side to hold the toner container 32 at the setting position (attached state) in the image forming apparatus also increases. Therefore, it is not preferable to increase the biasing force of the container shutter spring 336 in consideration of container attachablity and container holdability.

In view of the above, it is desirable to set the upper limit of the deformation amount of the seal in the radial direction of the container seal 333 to be smaller than 3 mm.

In the present embodiment, the biasing force of the container shutter spring 336 was 5±0.5 Newton (N) and the biasing force of the nozzle shutter spring 613 was 3.8±0.4 N.

Figure 44:
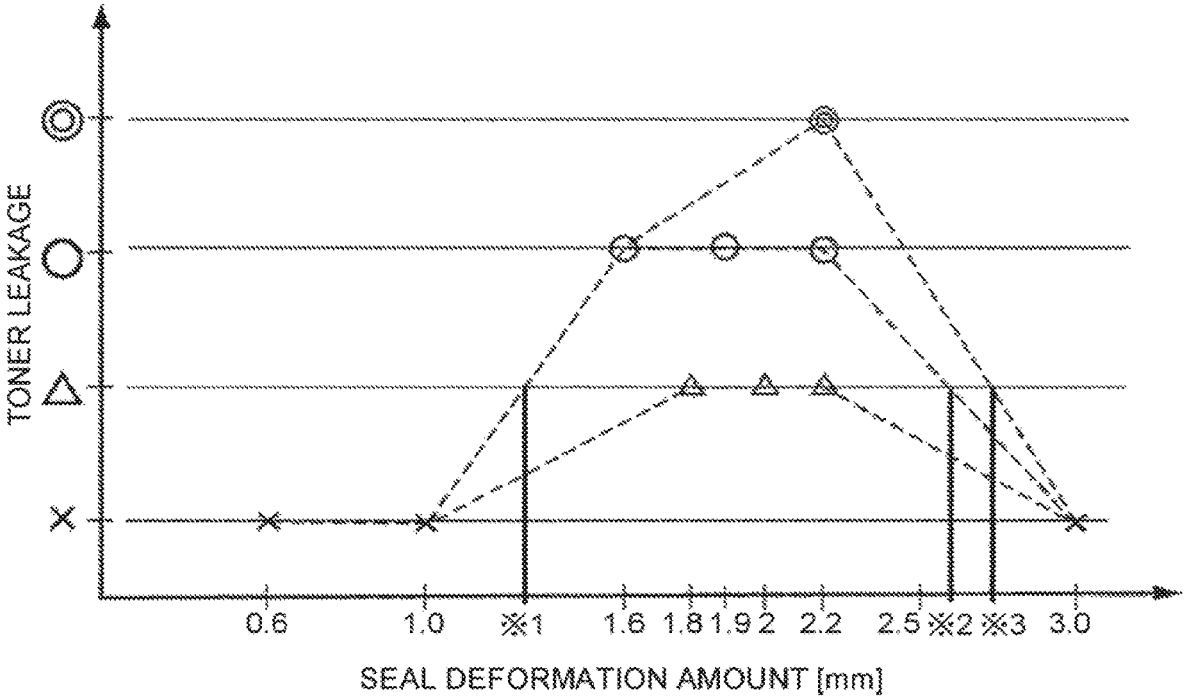
FIG. 44 is a plot of the correlation between the deformation amount of the sealing member and toner leakage extracted from the evaluation result illustrated in FIG. 40.

Next, FIG. 44 is a plot of the correlation between the deformation amount of the container seal 333 and toner leakage extracted from the evaluation result illustrated in FIG. 40.

In FIG. 44, when the deformation amount of the container seal 333 was 2.2 mm, the result was ◎ indicating least toner leakage. When the deformation amount was 1.6 mm or 1.8 mm, the result was ○, and when 1.8 mm or 2 mm, the result was Δ. Furthermore, when the deformation amount was 0.6 mm, 1.0 mm, or 3.0 mm, the result was x indicating unacceptable deformation amounts.

Incidentally, if it is assumed that the deformation amount of the seal and the toner leakage have a proportional relationship, it is expected that a value *3 that satisfies the toner leakage state denoted by Δ is present between the deformation amount of 2.2 mm corresponding to the state denoted by ◎ indicating least toner leakage and the deformation amount of 3.0 mm corresponding to the state denoted by x indicating an unacceptable amount. Therefore, it may be possible to set the maximum acceptable value of the deformation amount of the seal to the value *3.

Furthermore, similarly to the above, it is expected that a value *2 that satisfies the toner leakage state denoted by Δ is present between the deformation amount of 2.2 mm corresponding to the state denoted by ○ indicating less toner leakage and the deformation amount of 3.0 mm corresponding to the state denoted by x indicating an unacceptable amount. Therefore, it may be possible to set the maximum acceptable value of the deformation amount of the seal to the value *2.

Moreover, in FIG. 44, it is expected that a value *1 that satisfies the toner leakage state denoted by Δ is present between the deformation amount of the seal 1.6 mm corresponding to the state denoted by ○ indicating less toner leakage and the deformation amount of 1.0 mm corresponding to the state denoted by x indicating occurrence of toner leakage. Therefore, it may be possible to set the minimum acceptable value of the deformation amount of the seal to the value *1. Namely, a range of the deformation amount is from *1 or more to less than *2 or *3 (that is, equal to or grater than 1.0 mm and smaller than 3.0 mm), and more preferably, from 1.6 mm or more to less than 2.2 mm.

Furthermore, if the layer thickness of the first layer 3331 is too thick, the sliding resistance increases, and if the layer thickness is too thin, it becomes difficult to ensure the sealing performance. Therefore, an appropriate deformation amount of the seal of the first layer 3331 is 1 to 4 mm. As illustrated in FIG. 39C, the container seal 333 is attached to the nozzle shutter 612 when set in the image forming apparatus; therefore, it is desirable to set the length of the container seal 333 so as not to close the nozzle hole 610 in the attached state. In the present embodiment, it is assumed that a range from 4 to 30 mm is appropriate for the length of the container seal 333 in consideration of the above.

Figure 45:
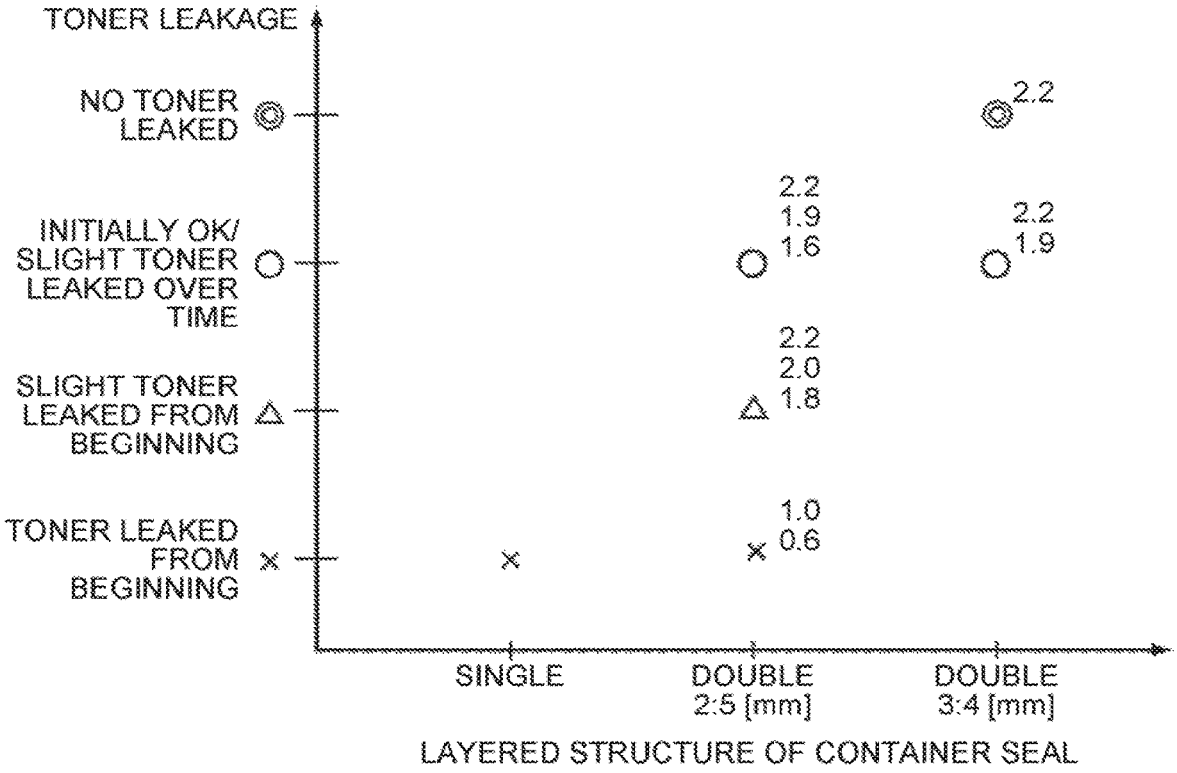
FIG. 45 is a plot of the correlation between a layered structure of the sealing member and toner leakage extracted from the evaluation result illustrated in FIG. 40.

Next, FIG. 45 is a plot of the correlation between a layered structure of the container seal 333 formed of the first layer 3331 and the second layer 3332 and toner leakage extracted from the examination result in FIG. 40. In FIG. 45, a "single" indicates a conventional single-layered container seal made of a single type of material, a "double 2:5" indicates the container seal 333 of the embodiment formed of the first layer 3331 of 2 mm and the second layer 3332 of 5 mm, and a "double 3:4" indicates the container seal 333 of the embodiment formed of the first layer 3331 of 3 mm and the second layer 3332 of 4 mm.

It can be seen from FIG. 45 that, as the structure of the container seal, the sealing performance with respect to toner is improved with the double structure compared to the single structure (single layer), and the sealing performance is further improved when the layer thickness of the first layer 3331 is increased in the double structure.

Figure 46:
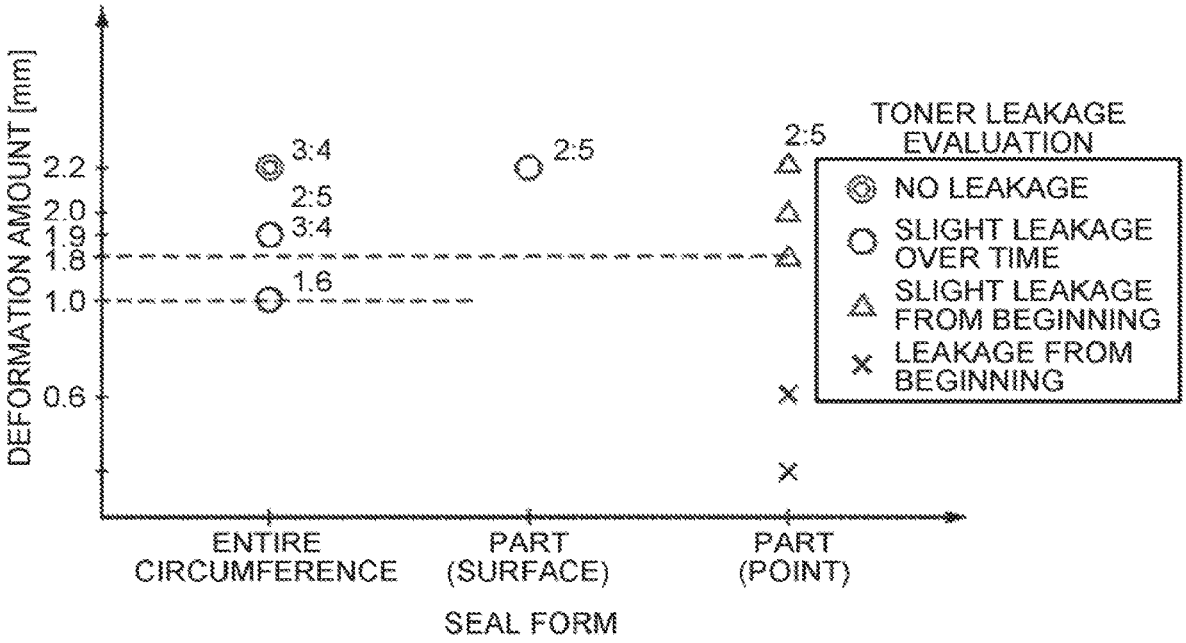
FIG. 46 is a plot of the correlation among a seal form of the sealing member, the deformation amount of the sealing member, and toner leakage extracted from the evaluation result illustrated in FIG. 40.

Next, FIG. 46 is a plot of the correlation between the seal form and the deformation amount extracted from the examination result in FIG. 40. In FIG. 46, an "entire circumference" indicates the seal form of the entire surface contact, a "part (surface)" indicates the seal form of the partial surface contact, and a "part (point)" indicates the seal form of the point contact.

In FIG. 46, if the deformation amount of the container seal 333 is equal to or greater than 1.6 mm, the rank of the toner leakage is an acceptable rank (Δ, ○, or ◎) regardless of the seal form. Furthermore, the evaluation rank of the toner leakage with the seal form of the entire surface contact is greater (toner is less likely to leak) than that of the seal form of the partial surface contact. Therefore, the seal form of the entire surface contact is more preferable than the seal form of the partial contact.

In view of the above circumstances, a preferable seal form of the container seal 333 is the entire surface contact because backlash or slip can hardly occur, and a preferable deformation amount is in a range from 1.6 mm or more to less than 3 mm. A more preferable deformation amount is in a range from 1.9 mm or more to less than 2.2 mm. As for the thicknesses of the first layer 3331 and the second layer 3332, the relationship of 3 mm:4 mm is preferable to 2 mm:5 mm.

As described above, as the layered structure of the container seal 333 of the present embodiment, the inner side of the toner container on the downstream side in the first moving direction Q1 is formed of the first layer 3331 with a higher foam density and excellent slidability, and the outer side of the toner container on the upstream side in the first moving direction Q1 is formed of the second layer 3332 with a lower foam density and a lower friction coefficient than those of the first layer 3331. Therefore, it becomes possible to prevent toner scattering even when the toner container 32 unexpectedly falls down while the toner container 32 is being shipped and the inertial force due to the drop impact acts on the container shutter 332 to cause the container shutter 332 to be deviated from the container seal 333, and it becomes also possible to reduce heat generation at the inner surface 333*a* serving as a sliding-contact surface when the toner container 32 is rotating.

An increase in the temperature of the container seal 333 over time will be explained below with reference to FIG. 48 and FIG. 49.

To evaluate the sliding heat, three types (T-1, T-2, and T-3) of the container seals 333 were formed and each of them is mounted on the nozzle receiver 330 of the toner container 32 to obtain three types of the toner containers 32. FIG. 48 illustrates a result obtained when a thermocouple was disposed inside the conveying nozzle 611 and rotation operation for rotating the toner container 32 for 0.9 second and then stopping the toner container 32 for 0.1 second was repeated for 100 seconds. T-1 is a container seal formed of the first layer 3331 made of Moltpren with the thickness of 7 mm and the second layer 3332 made of a Mylar sheet (registered trademark) with the thickness of 0.1 mm, and was used with the deformation amount of 1 mm. T-2 is a container seal having the same structure as the seal form 7 in FIG. 40 and formed of the first layer 3331 made of PORON with the thickness of 2 mm and the second layer 3332 made of Moltpren with the thickness of 5 mm. T-3 is a container seal having the same structure as the seal form 3 in FIG. 40 and formed of the first layer 3331 made of PORON with the thickness of 3 mm and the second layer 3332 made of Moltpren with the thickness of 4 mm. Each of T-2 and T-3 was used with the deformation amount of 1.8 mm. The seal forms of T-1 to T-3 were the entire surface contact illustrated in FIG. 40. At the evaluation, the conveying screw in the conveying nozzle 611 was not rotated and toner was not contained in the toner container 32.

Figure 48:
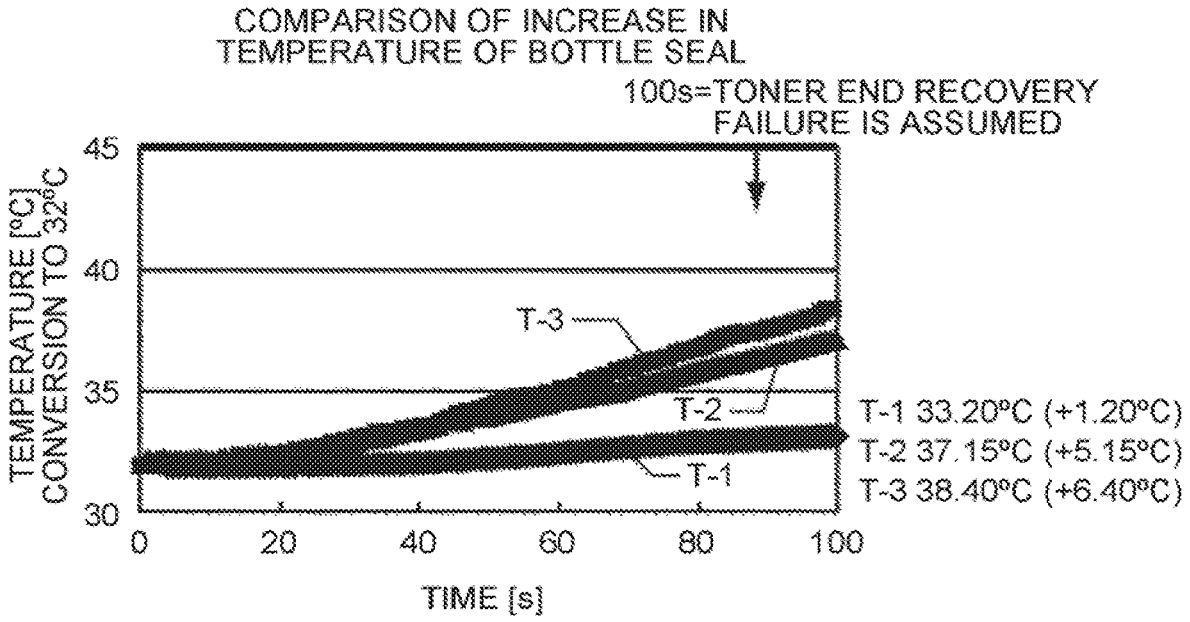
FIG. 48 is a diagram illustrating a result of a sliding heat due to rotation of the powder container with the sealing member of a different layered structure when operation has continued for 100 seconds.

It can be seen from FIG. 48 that the temperatures of the container seals of T-2 and T-3 become higher over time than that of T-1. Furthermore, it can be seen that the temperature of T-2 tends to become higher than that of T-3. It can also been seen that the temperature increases when PORON is employed and increases in proportion to the thickness of PORON.

Subsequently, a toner container, to which the container seal of T-3 whose temperature has most increased was attached and in which toner is filled, was mounted on a real device, and an increase in the temperature due to actual toner discharge operation was evaluated. Specifically, a thermocouple was disposed on the outer surface of the conveying nozzle 611, and an increase in the temperature due to continuous printing of 100 pages per job with the image area ratio of 20% under the environment of temperature of 32° C. and humidity of 54% was evaluated. In the evaluation, when the temperature detected by the thermocouple became stable, the toner container was replaced with an empty bottle and end stop control was performed. Then, the front cover of the image forming apparatus was opened and closed during 100 seconds until toner-end recovery control failed, and then the toner container 32 was replaced with new one and recovery control was performed. Subsequently, the continuous printing of 100 pages per job with the image area ratio of 20% was resumed, the power is turned off for about 300 seconds to cause overshoot, and the continuous printing of 100 pages per job with the image area ratio of 20% was resumed again.

Figure 49:
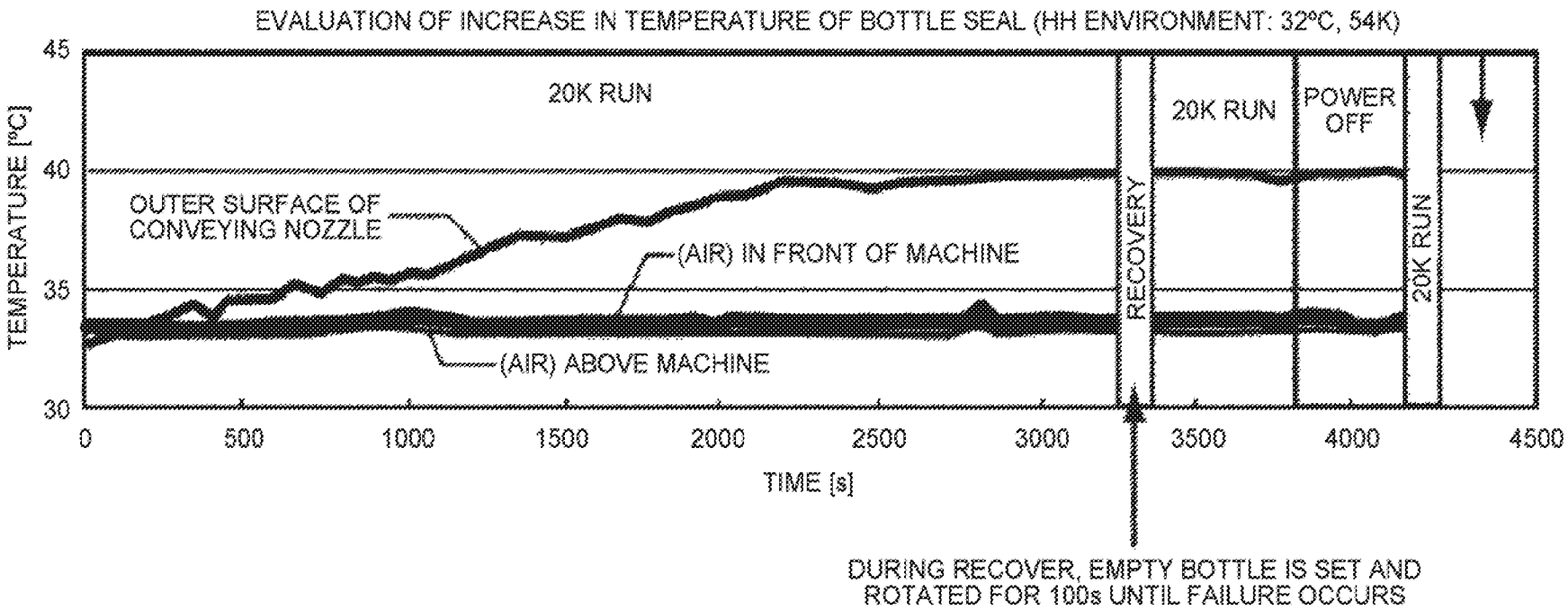
FIG. 49 illustrates evaluation of an increase in the temperature with actual toner discharge operation when a layered structure T-3 illustrated in FIG. 48 is applied.

As illustrated in FIG. 49, even when the container seal of T-3 whose temperature has most increased was used, the temperature increased up to only about 40° C. Therefore, it can be seen that, when the container seal of T-2 or the container seal of T-1 is used, the temperature becomes lower than that of T-1. Therefore, it is possible to assume that an increase in the temperature becomes lower than the increase in the temperature illustrated in FIG. 49.

A modification of the structure for fitting the outer surface 332*r* of the container shutter 332 illustrated in FIG. 39A and the inner surface 3331*a* of the first layer of the container seal 333 will be explained below with reference to FIGS. 47A and 47B.

Figure 47A:
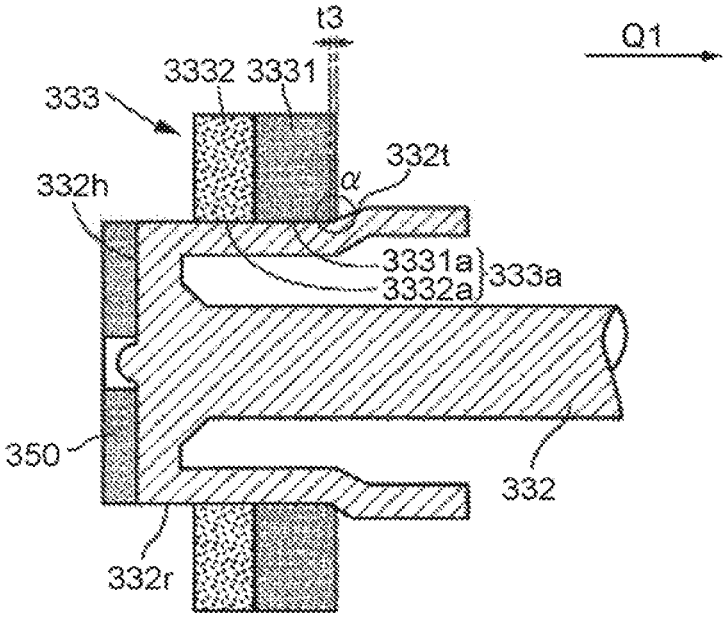
FIG. 47A is a cross-sectional view of the main components around the sealing member in the state illustrated in FIG. 39A.

As illustrated in FIG. 47A, the container seal 333 according to the modification is configured such that an end of the inner surface 3331*a* of the first layer 3331 on the downstream side in the first moving direction Q1 is in contact with the inclined surface 332*t*, which is a tapered surface, of the container shutter 332 by about t3 (mm) and is compressed and deformed along the inclined surface 332*t*. In the modification, t3=0.1 mm.

Figure 47B:
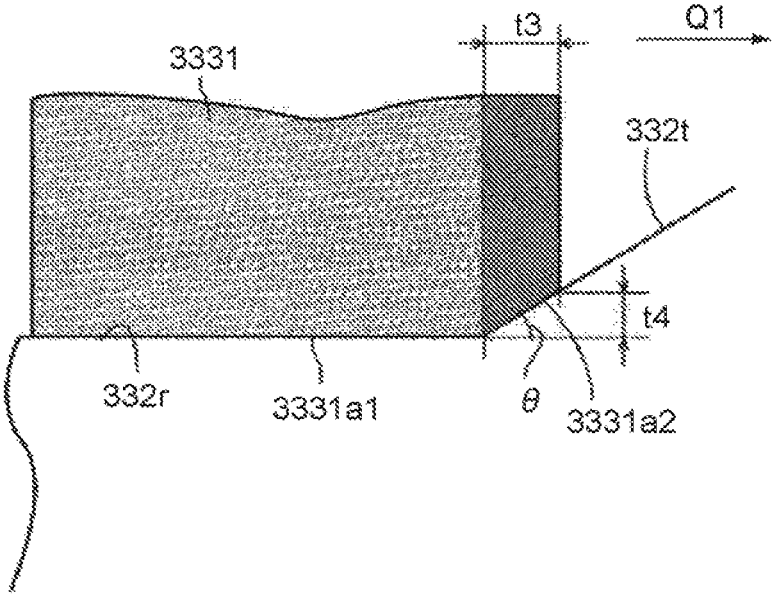
FIG. 47B is an enlarged view of a region a illustrated in FIG. 47A.

FIG. 47B is an enlarged view of a region a illustrated in FIG. 47A. The inner surface 3331*a* of the first layer 3331 of the container seal 333 includes an inner surface portion 3331*a*1 that fits to the outer surface 332*r* of the container shutter 332, and includes an inner surface portion 0.2 that fits to the inclined surface 332*t* of the container shutter 332. The inclined surface 332*t* of the container shutter 332 is formed in a direction in which the outer diameter of the container shutter 332 increases, and therefore satisfies tan θ=t3/t4. With this configuration, the inner surface portion 3331*a*2 of the first layer is compressed and deformed along the inclined surface 332*t*, so that the density thereof further increases compared to the density of the inner surface portion 3331*a*1 of the first layer and the adhesion with respect to the container shutter 332 can be improved.

As described above, the container seal 333 can achieve the effect to prevent toner scattering by the fitting between the inner surface portion 3331*a*1 and the outer surface 332*r* of the container shutter similarly to the embodiments as described above, and further achieve the effect to prevent toner scattering by the fitting between the inner surface portion 3331*a*2 and the inclined surface 332*t* of the container shutter 332, so that toner scattering can further be prevented.

Furthermore, because the inner surface portion 3331*a*2 is the most downstream portion of the first layer 3331 in the first moving direction Q1, even when toner contained in the toner container 32 moves to the position of the inner surface portion 3331*a*2, it is possible to prevent the toner from moving outward. Moreover, the inner surface portion 3331*a*2 is deformed into an inclined surface along the inclined surface 332*t* of the container shutter 332, so that the area of contact with the container shutter 332 can be increased compared to a configuration in which the inner surface portion 3331*a*2 is formed as a surface along the first moving direction similarly to the inner surface portion 3331*a*1. Therefore, it becomes possible to prevent the toner contained in the toner container 32 from moving outward from the position of the inner surface portion 3331*a*2, enabling to further improve the effect to prevent toner scattering.

According to the examination result, it is preferable to set the width (thickness) of the first layer 3331 serving as an inner layer in the first moving direction Q1 to 1 mm to 4 mm, and set the width (thickness) of the second layer 3332 serving as an outer layer in the first moving direction Q1 to 1 mm to 2.6 mm to achieve favorable effects. Furthermore, it is preferable to satisfy L3/L4=1 when the deformation amount of the first layer 3331 of the container shutter 332 in the radial direction is denoted by L3 and the deformation amount of the second layer 3332 is denoted by L4. Specifically, as the deformation amount (in other words, a pressed amount), favorable effects can be achieved when L3 is set to 1.6 mm to 2.2 mm and L4 is set to 1.9 mm to 2.2 mm.

In the embodiments, an example is explained that the vertical surface of the container seal 333 on the container front end side slightly protrudes relative to the front ends of the nozzle shutter positioning ribs 337*a*; however, it is not limited thereto. For example, the vertical surface of the container seal 333 on the container front end side may not protrude relative to the front ends of the nozzle shutter positioning ribs 337*a*. In this case, the nozzle shutter flange 612*a* does not press and deform the container seal 333, so that the adhesion between the outer circumference of the conveying nozzle 611 and the inner surface 333*a* of the container seal 333 is reduced. To cope with this, if the inner diameter W1 of the through hole 333*h* of the container seal 333 is reduced and the deformation amount of the container seal 333 is increased, it becomes possible to compensate for the lack of press and deformation of the container seal 333 by the nozzle shutter flange 612*a*.

Next, a configuration in which the sealing member of the second embodiment is applied to the powder container of the sixth example of the first embodiment will be explained below with reference to FIGS. 50A to 50D.

Figure 50A:
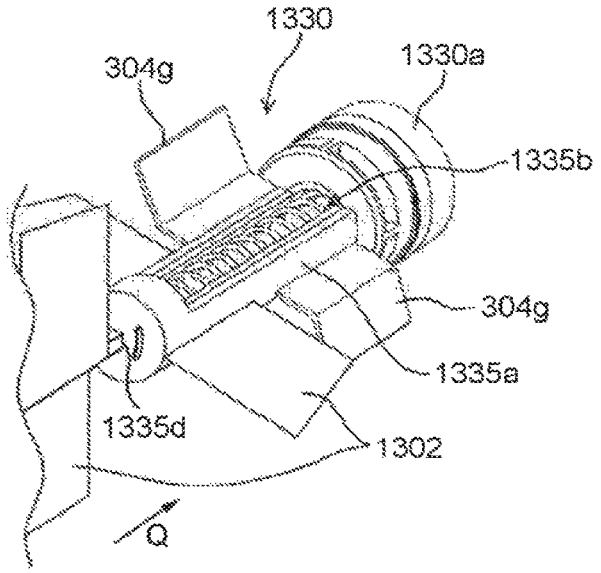
FIG. 50A is an explanatory perspective view of the nozzle receiver provided with scooping ribs serving as scooping portions according to the second embodiment.
Figure 50B:
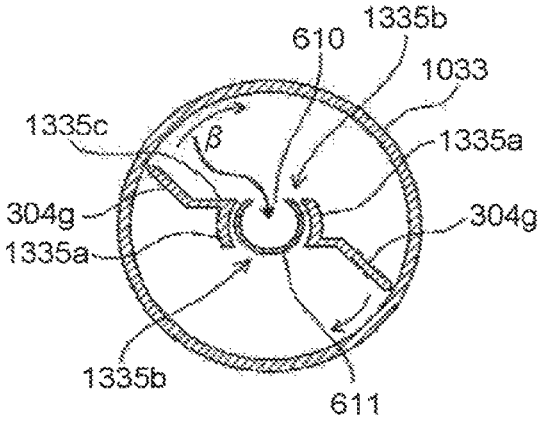
FIG. 50B is an explanatory cross-sectional view of a state in which the nozzle receiver illustrated in FIG. 50A is mounted on a container body.
Figure 50C:
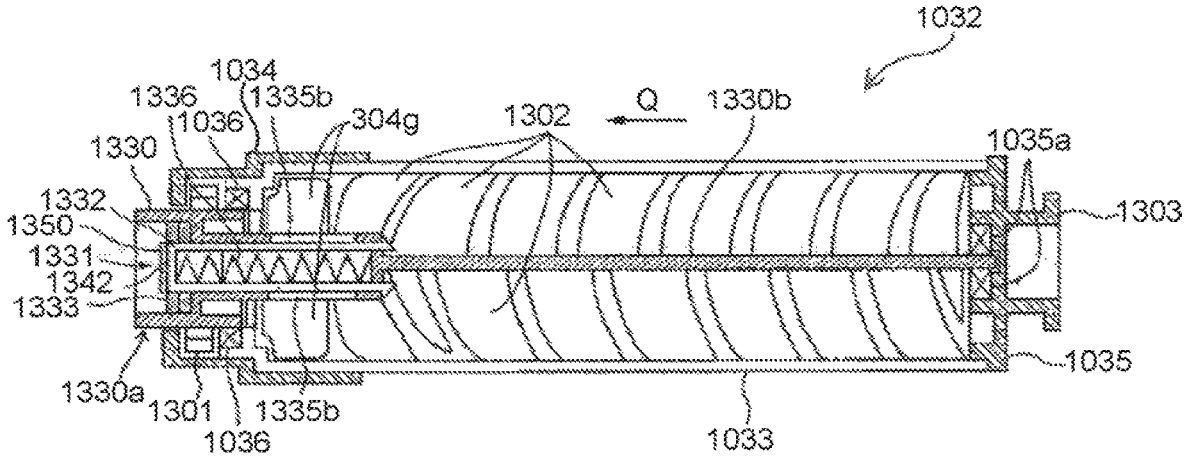
FIG. 50C is an explanatory lateral cross-sectional view of the entire powder container on which the nozzle receiver illustrated in FIG. 50A is mounted.
Figure 50D:
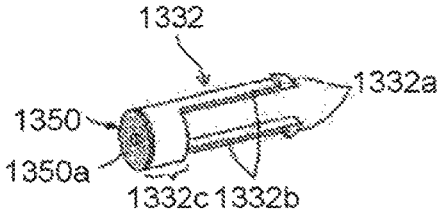
FIG. 50D is a perspective view of a container shutter of the powder container illustrated in FIG. 50C.

FIG. 50A is a perspective view of the nozzle receiver 330 integrated with the scooping ribs 304*g* corresponding to the scooping wall surfaces 304*f* (hereinafter, the nozzle receiver is referred to as the nozzle receiver 1330). FIG. 50B is a cross-sectional view illustrating arrangement of the nozzle receiver 1330 illustrated in FIG. 50A in the container body 1033, and a relationship with respect to the conveying nozzle 611. FIG. 50C is an explanatory lateral cross-sectional view of the entire toner container 1032 on which the nozzle receiver 1330 illustrated in FIG. 50A is mounted. FIG. 50D is a perspective view of the container shutter 1332 as a part of the toner container 1032.

The nozzle receiver 1330 illustrated in FIGS. 50A to 50D includes the scooping ribs 304*g* as described above, and is integrated with the conveying blade holder 1330*b* to which the conveying blades 1302 made of a flexible material, such as a resin film, are fixed. The rotary conveying blades 1302 and the conveying blade holder 1330*b* serve as a rotary conveyor.

Furthermore, the nozzle receiver 1330 illustrated in FIGS. 50A to 50D includes the container seal 1333, the receiving opening 1331, the container shutter 1332, and the container shutter spring 1336. As the container seal 1333, the container seal 333 explained in the above embodiments is employed. The receiving opening 1331 is an opening in which the conveying nozzle 611 is inserted. The container shutter 1332 is a shutter member that opens and closes the receiving opening 1331. The container shutter spring 1336 is a biasing member that biases the container shutter 1332 to a position at which the receiving opening 1331 is closed.

Moreover, in the configuration illustrated in FIGS. 50A to 50D, the nozzle receiver 1330 includes the outer surface 1330*a* that is slidably fitted to the inner surface 615*a* of the container setting section 615 of the main body of the copier 500. The container gear 1301 formed as a separate body is fixed to the nozzle receiver 1330 such that drive can be transmitted.

As described above, it is possible to integrate the structures, such as the scooping inner wall surface, the bridging portion, and the opening 1335*b* of the shutter supporting portions, for introducing toner to the nozzle hole 610. Incidentally, the same configuration as explained in the above embodiments may be applied to the container seal 1333 of the modification.

As illustrated in FIG. 50D, the container shutter 1332 includes the front cylindrical portion 1332*c* that comes in contact with the conveying nozzle 611, and the pair of the guiding pieces 1332*b* having different shapes from the guiding rod 332*e* of the above embodiments. The guiding pieces 1332*b* extend from the front cylindrical portion 1332*c* in the longitudinal direction of the container body 1033, and includes the pair of the shutter hooks 1332*a* that prevent the container shutter 1332 from coming out of the nozzle receiver 1330 due to the bias by the container shutter spring 1336.

The guiding pieces 1332*b* are formed to include the pair of the shutter hooks 1332*a* serving as stoppers (i.e., hooks) at respective ends that are shaped as if they are remained after a cylinder is cut in the axial direction. Therefore, the outer surfaces of the guiding pieces 1332*b* and the inner surfaces of the guiding pieces 1332*b* facing the container shutter spring 1336 are curved surfaces.

In contrast, the shutter rear supporting portion 1335 illustrated in FIG. 50A includes the rear end opening 1335*d* as a through hole or a cohesion preventing mechanism such that the guiding pieces 1332*b* can move in the longitudinal direction. The guiding pieces 1332*b* can move relative to the shutter rear supporting portion 1335 in the longitudinal direction, but cannot rotate relative to the shutter rear supporting portion 1335. Therefore, the container shutter 1332 rotates with rotation of the nozzle receiver 1330.

Furthermore, as illustrated in FIG. 50D, the seal 1350 is provided on the container front end side of the container shutter 1332.

The toner container 1032 including the scooping ribs 304*g* will be described in detail below.

As illustrated in FIG. 50C, the toner container 1032 includes the container front end cover 1034, the container body 1033, the rear cover 1035, the nozzle receiver 1330, and the like. The container front end cover 1034 is arranged on the front end of the toner container 1032 in the attachment direction with respect to the main body of the copier 500. The container body 1033 has an approximately cylindrical shape. The rear cover 1035 is arranged on the rear end of the toner container 1032 in the attachment direction. The nozzle receiver 1330 is rotatably held by the approximately cylindrical container body 1033 as described above.

The gear exposing hole 1034*a* (a hole similar to the gear exposing hole 34*a*) is arranged on the container front end cover 1034 in order to expose the container gear 1301 fixed to the nozzle receiver 1330. The approximately cylindrical container body 1033 holds the nozzle receiver 1330 so that the nozzle receiver 1330 can rotate. The container front end cover 1034 and the rear cover 1035 are fixed to the container body 1033 (by a well-known method, such as thermal welding or adhesive agent). The rear cover 1035 includes the rear side bearing 1035*a* that supports one end of the conveying blade holder 1330*b*, and includes the gripper 1303 that a user can grip when he/she attaches and detaches the toner container 1032 to and from the copier 500.

A method to assemble the container front end cover 1034, the rear cover 1035, and the nozzle receiver 1330 on the container body 1033.

The nozzle receiver 1330 is first inserted in the container body 1033 from the container rear end side, and positioning is performed such that the nozzle receiver 1330 is rotatably supported by the front side bearing 1036 arranged on the front end of the container body 1033. Subsequently, positioning is performed such that one end of the conveying blade holder 1330*b* of the nozzle receiver 1330 is rotatably supported by the rear side bearing 1035*a* arranged on the rear cover 1035, and the rear cover 1035 is fixed to the container body 1033. Thereafter, the container gear 1301 is fixed to the nozzle receiver 1330 from the container front end side. After the container gear 1301 is fixed, the container front end cover 1034 is fixed to the container body 1033 so as to cover the container gear 1301 from the container front end side.

Incidentally, the fixation between the container body 1033 and the container front end cover 1034, the fixation between the container body 1033 and the rear cover 1035, and the fixation between the nozzle receiver 1330 and the container gear 1301 are performed by appropriately using a well-known method (for example, thermal welding, adhesive agent, or the like).

A configuration for conveying toner from the toner container 1032 to the nozzle hole 610 will be explained below.

The scooping ribs 304*g* protrude so as to come closer to the inner surface of the container body 1033 such that rib surfaces are continued from downstream ends 1335*c* of the shutter side supporting portions 1335*a* in the rotation direction. The rib surfaces are bent once in the middle portions so as to resemble curved surfaces. However, the configuration is not limited to this example depending on the compatibility with toner. For example, simple flat ribs without bend may be used. With this configuration, it becomes not necessary to form a bulged portion in the container body 1033. Furthermore, because the scooping ribs 304*g* stand from the opening 1335*b* of the shutter supporting portion in an integrated manner, it becomes possible to obtain the same bridging function and advantageous effects as those obtained by fitting the shutter side supporting portion 335*a* and the convex 304*h*.

Specifically, when the nozzle receiver 1330 rotates while the toner container 1032 is attached to the main body of the image forming apparatus, the conveying blades are rotated, so that toner contained in the toner container 1032 is conveyed from the rear end side to the front end side where the nozzle receiver 1330 is arranged. Subsequently, the scooping ribs 304*g* receive the toner conveyed by the conveying blades 1302, scoop up the toner from bottom to top along with the rotation, and introduce the toner into the nozzle hole 610 by using the rib surfaces as slides.

As described above, even in the configuration in which the sealing member of the second embodiment is applied to the powder container of the sixth example of the first embodiment, the same advantageous effects can be achieved.

The present invention further includes the following aspects.

Aspect A

A nozzle insertion member that is arranged in a powder container used in an image forming apparatus and that includes a nozzle insertion opening into which a conveying nozzle for conveying powder supplied from the powder container inside the image forming apparatus is inserted, the nozzle insertion member comprising:

an opening/closing member to move to an opening position so as to open the nozzle insertion opening by being pressed by the conveying nozzle thus inserted, and to a closing position so as to close the nozzle insertion opening when the conveying nozzle is separated from the nozzle insertion member;

a supporting member to support the opening/closing member so as to guide the opening/closing member to the opening position and the closing position; and a biasing member that is provided to the supporting member and that biases the opening/closing member toward the closing position, wherein when the opening/closing member is located at the opening position, relative rotation between an opening formed on the supporting member and an elongated member that is arranged on the opening/closing member and that is inserted in the opening are restricted at least in a rotation direction about a longitudinal axis of the opening/closing member.

Aspect B

A powder container comprising:

a powder storage to store therein powder to be supplied to a powder replenishing device and to convey the powder by a rotary conveyor arranged inside the powder storage from one end in a rotation axis direction of the rotary conveyor to other end where an opening is arranged; and the nozzle insertion member according to aspect A, wherein the nozzle insertion member is attached to the powder storage.

Aspect C

A nozzle insertion member that is arranged in a powder container used in an image forming apparatus and that includes a nozzle insertion opening into which a conveying nozzle for conveying powder supplied from the powder container inside the image forming apparatus is inserted, the nozzle insertion member comprising:

an opening/closing member to move to an opening position so as to open the nozzle insertion opening by being pressed by the conveying nozzle thus inserted, and to a closing position so as to close the nozzle insertion opening when the conveying nozzle is separated from the nozzle insertion member;

a supporting member to support the opening/closing member so as to guide the opening/closing member to the opening position and the closing position; and a biasing member that is provided to the supporting member and that biases the opening/closing member toward the closing position, wherein the opening/closing member includes a protrusion protruding from an end surface thereof on a front end side of the powder container.

Aspect D

A powder container comprising:

a powder storage to store therein powder to be supplied to a powder replenishing device and to convey the powder by a rotary conveyor arranged inside the powder storage from one end in a rotation axis direction of the rotary conveyor to other end where an opening is arranged; and the nozzle insertion member according to the aspect D, wherein the nozzle insertion member is attached to the powder storage.

Aspect E

A nozzle insertion member that is arranged in a powder container used in an image forming apparatus and that includes a nozzle insertion opening into which a conveying nozzle for conveying powder supplied from the powder container is inserted, the nozzle insertion member comprising:

an opening/closing member to move to an opening position so as to open the nozzle insertion opening by being pressed by the conveying nozzle thus inserted, and to a closing position so as to close the nozzle insertion opening when the conveying nozzle is separated from the nozzle insertion member;

a supporting member to support the opening/closing member so as to guide the opening/closing member to the opening position and the closing position; and a biasing member that is provided to the supporting member and that biases the opening/closing member toward the closing position, wherein when the powder in the powder container is supplied to the conveying nozzle inserted into the nozzle insertion opening along with rotation of a rotary conveyor arranged inside the powder container, the supporting member rotates with the rotation of the rotary conveyor, and the opening/closing member rotates with rotation of the supporting member and includes a cohesion preventing unit to prevent cohesion of the powder generated due to rotation of the opening/closing member.

Aspect F

The nozzle insertion member according to aspect E, wherein the cohesion preventing unit serves as a drive transmitting mechanism to transmit a rotational force from the supporting member to the opening/closing member.

Aspect G

The nozzle insertion member according to aspect F, wherein the supporting member is formed with an opening thereon, and the drive transmitting mechanism includes an elongated member that is arranged on the opening/closing member so as to extend in a longitudinal direction of the conveying nozzle and that penetrates through the opening formed on the supporting member;

a drive transmitted portion formed on the elongated member; and a drive transmitting portion that is formed on an inner surface of the opening and that comes in contact with the drive transmitted portion.

Aspect H

The nozzle insertion member according to aspect G, wherein the drive transmitted portion is one of a rib, a flat surface, and a curved surface that extends approximately parallel to a central axis of the elongated member.

Aspect I

The nozzle insertion member according to any one of aspects E to H, wherein the opening/closing member includes a closure fitting to an inner surface of the nozzle insertion opening to close the nozzle insertion opening at the closing position, and the supporting member includes a side portion that faces a part of the closure at the opening position; and a side opening which is arranged adjacent to the side portion and through which the toner passes when the toner is supplied to the conveying nozzle.

Aspect J

The nozzle insertion member according to aspect E, wherein the cohesion preventing mechanism is a protrusion protruding from an end surface of the opening/closing member on a front end side of the powder container toward a front end of the conveying nozzle and comes in contact with the front end of the conveying nozzle when the powder container is attached to the image forming apparatus.

Aspect K

The nozzle insertion member according to aspect J, wherein the protrusion is arranged so as to be located substantially on a rotation axis of the opening/closing member.

Aspect L

The nozzle insertion member according to aspect J or K, wherein a seal is arranged in a non-contact area in which the protrusion on the end surface of the opening/closing member does not come in contact with the conveying nozzle.

Aspect M

The nozzle insertion member according to aspect L, wherein a plurality of concaves are arranged in the non-contact area, and the seal covers the concaves.

Aspect N

The nozzle insertion member according to aspect L or M, wherein the seal is compressed in a thickness direction when the opening/closing member is located at the opening position to open the nozzle insertion opening due to insertion of the conveying nozzle.

Aspect O

The nozzle insertion member according to aspect M or N, wherein a surface of the seal facing the front end of the conveying nozzle has lower friction than other portions of the seal.

Aspect P

A nozzle insertion member that is arranged in a powder container used in an image forming apparatus and that includes a nozzle insertion opening into which a conveying nozzle for conveying powder supplied from the powder container inside the image forming apparatus is inserted, the nozzle insertion member comprising:

an opening/closing member to move to an opening position so as to open the nozzle insertion opening by being pressed by the conveying nozzle thus inserted, and to a closing position so as to close the nozzle insertion opening when the conveying nozzle is separated from the nozzle insertion member;

a supporting member to support the opening/closing member so as to guide the opening/closing member to the opening position and the closing position; and a biasing member that is provided to the supporting member and that biases the opening/closing member toward the closing position, wherein the powder in the powder container is supplied to the conveying nozzle inserted in the nozzle insertion opening along with rotation of a rotary conveyor arranged inside the powder container, the supporting member rotates with the rotation of the rotary conveyor, the opening/closing member rotates with rotation of the supporting member, the opening/closing member including a first cohesion preventing unit to prevent cohesion of the powder generated due to rotation of the opening/closing member; and a second cohesion preventing unit to prevent cohesion of the powder generated due to rotation of the opening/closing member, wherein the first cohesion preventing unit is the drive transmitting mechanism according to any of aspects F to H, and the second cohesion preventing unit is the protrusion according to any one of aspects J to O.

Aspect Q

A powder container comprising:

a powder storage to store therein powder to be supplied to a powder replenishing device and to convey the powder by a rotary conveyor arranged inside the powder storage from one end in a rotation axis direction of the rotary conveyor to other end where an opening is arranged; and the nozzle insertion member according to any one of aspects E to P, wherein the nozzle insertion member is attached to the powder storage.

Aspect R

An image forming apparatus comprising:

the powder container according to aspect Q; and an image forming unit to form an image on an image bearer by using the powder conveyed from the powder container.

Aspect A1

A nozzle receiver that is arranged in a powder container used in an image forming apparatus and that includes a receiving opening into which a conveying nozzle for conveying powder supplied from the powder container is inserted, the nozzle receiver comprising:

a container shutter to move to an opening position so as to open the receiving opening by being pressed by the conveying nozzle thus inserted, and to a closing position so as to close the receiving opening when the conveying nozzle is separated from the nozzle receiver;

a container shutter supporter to support the container shutter so as to guide the container shutter to the opening position and the closing position, the container shutter supporter being formed with an opening thereon; and a container shutter spring that is provided to the container shutter supporter and that biases the container shutter toward the closing position, wherein when the powder in the powder container is supplied to the conveying nozzle inserted into the receiving opening along with rotation of a rotary conveyor arranged inside the powder container, the container shutter supporter rotates with the rotation of the rotary conveyor, the container shutter is rotated by a drive transmitting mechanism along with rotation of the container shutter supporter, the drive transmitting mechanism includes a rod member that is arranged on the container shutter so as to extend in a longitudinal direction of the conveying nozzle and that penetrates through the opening formed on the container shutter supporter;

a drive transmitted portion formed on the rod member; and a drive transmitting portion that is formed on an inner surface of the opening and that is configured to come into contact with the drive transmitted portion.

Aspect A2

The nozzle receiver according to Aspect A1, wherein the drive transmitted portion is one of a rib, a flat surface, and a curved surface that extends approximately parallel to a central axis of the rod member.

Aspect A3

The nozzle receiver according Aspect A1, wherein the container shutter spring is arranged within the container shutter supporter.

Aspect A4

A powder container comprising:

a powder storage to store therein powder to be supplied to a powder replenishing device and to convey the powder by a rotary conveyor arranged inside the powder storage from one end in a rotation axis direction of the rotary conveyor to other end where an opening is arranged; and the nozzle receiver according to Aspect A1, wherein the nozzle receiver is attached to the powder storage.

Aspect A5

An image forming apparatus comprising:

the powder container according to Aspect A4; and an image forming unit to form an image on an image bearer by using the powder conveyed from the powder container.

Aspect A6

A nozzle receiver that is arranged in a powder container used in an image forming apparatus and that includes a receiving opening into which a conveying nozzle for conveying powder supplied from the powder container is inserted, the nozzle receiver comprising:

a container shutter to move to an opening position so as to open the receiving opening by being pressed by the conveying nozzle thus inserted, and to a closing position so as to close the receiving opening when the conveying nozzle is separated from the nozzle receiver;

a container shutter supporter to support the container shutter so as to guide the container shutter to the opening position and the closing position;

a container shutter spring that is provided to the container shutter supporter and that biases the container shutter toward the closing position; and a protrusion that protrudes from an end surface of the container shutter on a front end side of the powder container toward a front end of the conveying nozzle and comes in contact with the front end of the conveying nozzle when the powder container is attached to the image forming apparatus, wherein when the powder in the powder container is supplied to the conveying nozzle inserted into the receiving opening along with rotation of a rotary conveyor arranged inside the powder container, the container shutter supporter rotates with the rotation of the rotary conveyor, and the container shutter rotates with rotation of the container shutter supporter.

Aspect A7

The nozzle receiver according to Aspect A6, wherein the protrusion is arranged so as to be located substantially on a rotation axis of the container shutter.

Aspect A8

The nozzle receiver according to Aspect A6, wherein a seal is arranged in a non-contact area in which the protrusion on the end surface of the container shutter does not come in contact with the conveying nozzle.

Aspect A9

The nozzle receiver according to Aspect A8, wherein a plurality of concaves are provided in the non-contact area, and the seal covers the concaves.

Aspect A10

The nozzle receiver according to Aspect A8, wherein the seal is compressed in a thickness direction when the container shutter is located at the opening position to open the receiving opening due to insertion of the conveying nozzle.

Aspect A11

The nozzle receiver according to Aspect A8, wherein a surface of the seal facing the front end of the conveying nozzle has lower friction than other portions of the seal.

Aspect A12

The nozzle receiver according Aspect A6, wherein the container shutter spring is arranged within the container shutter supporter.

Aspect A13

A powder container comprising:

a powder storage to store therein powder to be supplied to a powder replenishing device and to convey the powder by a rotary conveyor arranged inside the powder storage from one end in a rotation axis direction of the rotary conveyor to other end where an opening is arranged; and the nozzle receiver according to Aspect A6, wherein the nozzle receiver is attached to the powder storage.

Aspect A14

An image forming apparatus comprising:

the powder container according to Aspect A13; and an image forming unit to form an image on an image bearer by using the powder conveyed from the powder container.

Aspect A15

The nozzle receiver according to Aspect A6, wherein the container shutter is rotated by a drive transmitting mechanism along with rotation of the container shutter supporter.

Aspect A16

The nozzle receiver according to Aspect A15, wherein the container shutter supporter is formed with an opening thereon, and the drive transmitting mechanism includes a drive transmitted portion formed on a rod member that penetrates the opening formed on the container shutter supporter; and a drive transmitting portion that is formed on an inner surface of the opening and that comes in contact with the drive transmitted portion.

Aspect A17

A nozzle insertion member that is arranged in a powder container used in an image forming apparatus and that includes a nozzle insertion opening into which a conveying nozzle for conveying powder supplied from the powder container is inserted, the nozzle insertion member comprising:

a moving member to move in an insertion direction in which the conveying nozzle is inserted, along with insertion of the conveying nozzle; and a supporting member to support the moving member so as to guide the moving member in the insertion direction, the supporting member being formed with an opening thereon, wherein when the powder in the powder container is supplied to the conveying nozzle inserted into the nozzle insertion opening along with rotation of a rotary conveyor arranged inside the powder container, the supporting member rotates with the rotation of the rotary conveyor, the moving member is rotated by a drive transmitting mechanism along with rotation of the supporting member, the drive transmitting mechanism includes an elongated member that is arranged on the moving member so as to extend in a longitudinal direction of the conveying nozzle and that penetrates through the opening formed on the supporting member;

a drive transmitted portion formed on the elongated member; and a drive transmitting portion that is formed on an inner surface of the opening and that is contactable with the drive transmitted portion.

Aspect A18

The nozzle insertion member according to Aspect A17, further comprising a biasing member that is provided to the supporting member and that biases the moving member toward the conveying nozzle being inserted.

Aspect A19

The powder container according to Aspect A4, wherein the powder storage comprises toner.

Aspect A20

The powder container according to Aspect A13, wherein the powder storage comprises toner.

Aspect A21

The powder container according to Aspect A4, wherein the powder storage comprises developer including toner and carrier particle.

Aspect A22

The powder container according to Aspect A13, wherein the powder storage comprises developer including toner and carrier particle.

Aspect S

A sealing member arranged on a circumference of an opening/closing member that moves from a closing position for closing a nozzle insertion opening of a powder container to an opening position for opening the nozzle insertion opening due to a contact with a conveying nozzle of an image forming apparatus, wherein the sealing member is formed such that a foam density of a downstream side in a first moving direction in which the opening/closing member moves from the closing position to the opening position is higher than a foam density of an upstream side, the sealing member is formed with a penetrated portion through which the opening/closing member and a nozzle opening/closing member arranged on an outer side of the conveying nozzle penetrate in the first moving direction, an inner circumference of the penetrated portion serves as a sliding-contact surface that comes in sliding-contact with an outer circumference of the opening/closing member due to movement of the opening/closing member from the closing position to the opening position and that rotates relative to an outer circumference of the nozzle opening/closing member while coming in sliding-contact with the outer circumference of the nozzle opening/closing member at the opening position, and the sliding-contact surface is formed such that a frictional force of the upstream side in the first moving direction becomes lower than a frictional force of the downstream side.

Aspect Sa

A sealing member arranged on a circumference of an opening/closing member that moves from a closing position for closing a nozzle insertion opening of a powder container to an opening position for opening the nozzle insertion opening due to a contact with a conveying nozzle of an image forming apparatus, wherein the sealing member is formed such that a foam density of a downstream side in a first moving direction in which the opening/closing member moves from the closing position to the opening position is higher than a foam density of an upstream side, and the sealing member is formed with a penetrated portion through which the opening/closing member and a nozzle opening/closing member arranged on an outer side of the conveying nozzle penetrate in the first moving direction.

Aspect Sb

The sealing member according to Aspect Sa, further comprising an inner circumference of the penetrated portion serves as a sliding-contact surface that comes in sliding-contact with an outer circumference of the opening/closing member due to movement of the opening/closing member from the closing position to the opening position and that rotates relative to an outer circumference of the nozzle opening/closing member while coming in sliding-contact with the outer circumference of the nozzle opening/closing member at the opening position.

Aspect Sc

The sealing member according to Aspect Sb, wherein the sliding-contact surface is formed such that a frictional force of the upstream side in the first moving direction becomes lower than a frictional force of the downstream side.

Aspect Sd

The sealing member according to Aspect Sb, wherein $W1<W2<W3$ is satisfied, where W1 is an inner diameter of the penetrated portion, W2 is an outer diameter of the nozzle opening/closing member, and W3 is an outer diameter of the opening/closing member.

Aspect T

The sealing member according to aspect S, wherein a first layer on the downstream side in the first moving direction is made with microcellular polymer, and a second layer on the upstream side in the first moving direction is made with expanded polyurethane.

Aspect U

The sealing member according to aspect S or T, wherein the sealing member is formed of two layers, one of which is the second layer on the upstream side in the first moving direction and the first layer on the downstream side in the first moving direction, a total thickness of the first layer and the second layer is in a range from 4 millimeters to 30 millimeters, and a thickness of the first layer is in a range of 1 millimeter to 4 millimeters.

Aspect V

The sealing member according to any one of aspects S, T, and U, wherein a deformation amount of the first layer on the downstream side in the first moving direction is in a range from 1.6 millimeters to 2.2 millimeters, and a deformation amount of the second layer on the upstream side in the first moving direction is in a range from 1.9 millimeters to 2.2 millimeters.

Aspect W

The sealing member according to any one of aspects S, T, U, and V, wherein $W1<W2<W3$ is satisfied, where W1 is an inner diameter of the penetrated portion, W2 is an outer diameter of the nozzle opening/closing member, and W3 is an outer diameter of the opening/closing member.

Aspect X

The sealing member according to aspects S, T, U, V, and W, wherein the first layer on the downstream side in the first moving direction is in contact with an inclined surface that extends outward from the outer circumference of the opening/closing member.

Aspect Y

The sealing member according to any one of aspects S, T, U, V, W, and X, wherein a vertical surface of the sealing member on the upstream side in the first moving direction serves as an abutting surface that abuts against a protrusion of the nozzle opening/closing member, the protrusion protruding outward from an outer surface of the nozzle opening/closing member.

Aspect Z

The sealing member according to aspect Y, wherein the sealing member is pressed and deformed in the first moving direction when the protrusion of the nozzle opening/closing member abuts against the abutting surface.

Aspect AA

A powder container comprising:

a powder storage to store therein powder to be supplied to an image forming apparatus;

a nozzle insertion member that includes a nozzle insertion opening into which a conveying nozzle of the image forming apparatus is inserted and which is arranged inside the nozzle insertion opening;

an opening/closing member that is arranged on the nozzle insertion member, that is biased toward a closing position for closing the nozzle insertion opening, and that opens the nozzle insertion opening along with insertion of the conveying nozzle; and the sealing member according to any one of aspects S, T, U, V, W, X, Y, and Z.

Aspect AB

The powder container according to aspect AA, wherein the nozzle insertion member includes a portion having an inner cylindrical space in which the sealing member is arranged, the portion includes a plurality of convexes that come in contact with an outer circumference of the sealing member and that are arranged along the outer circumference of the sealing member, and a vertical surface of the sealing member on the upstream side in the first moving direction protrudes toward the upstream side in the first moving direction relative to ends of the convexes on the upstream side in the first moving direction.

Aspect AC

The powder container according to aspect AA, wherein the nozzle insertion member includes a portion having an inner cylindrical space in which the sealing member is arranged, the portion includes a plurality of convexes that come in contact with an outer circumference of the sealing member and that are arranged along the outer circumference of the sealing member, and an outer diameter of the sealing member is greater than an inner diameter of a circle formed by the convexes.

Aspect AD

The powder container according to aspect AA, wherein the opening/closing member includes a front cylindrical portion that comes in contact with a sliding-contact surface of the sealing member, and includes a slide area that is formed on a downstream side relative to the front cylindrical portion in the first moving direction and on outer side of the front cylindrical portion, a part of an outer circumference of the slide area serves as a contact surface that comes in surface-contact with an inner surface of the nozzle insertion member along the inner surface.

Aspect AE

The powder container according to aspect AA, wherein the powder storage includes a rotary conveyor to convey powder contained in the powder container from one end in a rotation axis direction along with rotation of the powder container to other end where an opening is arranged.

Aspect AF

The powder container according to aspect AA, wherein the powder storage includes a conveyor to rotate relative to the powder storage, and conveys powder contained in the powder container from one end in a rotation axis direction along with rotation of the conveyor to other end where opening is arranged.

Aspect AG

An image forming apparatus comprising:

a powder container according to any one of aspects AA, AB, AC, AD, AE, and AF;

a conveying nozzle to convey toner in the powder container to the image forming apparatus; and an image forming unit to form an image on an image bearer with the toner conveyed by the conveying nozzle.

Aspect S1

A container seal arranged on a circumference of a container shutter that moves from a closing position for closing a receiving opening of a powder container to an opening position for opening the receiving opening due to a contact with a conveying nozzle of an image forming apparatus, wherein the container seal is formed such that a foam density of a downstream side in a first moving direction in which the container shutter moves from the closing position to the opening position is higher than a foam density of an upstream side, the container seal is formed with a penetrated portion through which the container shutter and a nozzle shutter arranged on an outer side of the conveying nozzle penetrate in the first moving direction, an inner circumference of the penetrated portion serves as a sliding-contact surface that comes in sliding-contact with an outer circumference of the container shutter due to movement of the container shutter from the closing position to the opening position and that rotates relative to an outer circumference of the nozzle shutter while coming in sliding-contact with the outer circumference of the nozzle shutter at the opening position, and the sliding-contact surface is formed such that a frictional force of the upstream side in the first moving direction becomes lower than a frictional force of the downstream side.

Aspect T1

The container seal according to aspect S1, wherein a first layer on the downstream side in the first moving direction is made with microcellular polymer, and a second layer on the upstream side in the first moving direction is made with expanded polyurethane.

Aspect U1

The container seal according to aspect S1 or T1, wherein the container seal is formed of two layers, one of which is the second layer on the upstream side in the first moving direction and the first layer on the downstream side in the first moving direction, a total thickness of the first layer and the second layer is in a range from 4 millimeters to 30 millimeters, and a thickness of the first layer is in a range of 1 millimeter to 4 millimeters.

Aspect V1

The container seal according to any one of aspects S1, T1, and U1, wherein a deformation amount of the first layer on the downstream side in the first moving direction is in a range from 1.6 millimeters to 2.2 millimeters, and a deformation amount of the second layer on the upstream side in the first moving direction is in a range from 1.9 millimeters to 2.2 millimeters.

Aspect W1

The container seal according to any one of aspects S1, T1, U1, and V1, wherein $W1<W2<W3$ is satisfied, where W1 is an inner diameter of the penetrated portion, W2 is an outer diameter of the nozzle shutter, and W3 is an outer diameter of the container shutter.

Aspect X1

The container seal according to aspects S1, T1, U1, V1, and W1, wherein the first layer on the downstream side in the first moving direction is in contact with an inclined surface that extends outward from the outer circumference of the container shutter.

Aspect Y1

The container seal according to any one of aspects S1, T1, U1, V1, W1, and X1, wherein a vertical surface of the container seal on the upstream side in the first moving direction serves as an abutting surface that abuts against a protrusion of the nozzle shutter, the protrusion protruding outward from an outer surface of the nozzle shutter.

Aspect Z1

The container seal according to aspect Y1, wherein the container seal is pressed and deformed in the first moving direction when the protrusion of the nozzle shutter abuts against the abutting surface.

Aspect AA1

A powder container comprising:

a powder storage to store therein powder to be supplied to an image forming apparatus;

a nozzle receiver that includes a receiving opening into which a conveying nozzle of the image forming apparatus is inserted and which is arranged inside the receiving opening;

a container shutter that is arranged on the nozzle receiver, that is biased toward a closing position for closing the receiving opening, and that opens the receiving opening along with insertion of the conveying nozzle; and the container seal according to any one of aspects S1, T1, U1, V1, W1, X1, Y1, and Z1.

Aspect AB1

The powder container according to aspect AA1, wherein the nozzle receiver includes a portion having an inner cylindrical space in which the container seal is arranged, the portion includes a plurality of convexes that come in contact with an outer circumference of the container seal and that are arranged along the outer circumference of the container seal, and a vertical surface of the container seal on the upstream side in the first moving direction protrudes toward the upstream side in the first moving direction relative to ends of the convexes on the upstream side in the first moving direction.

Aspect AC1

The powder container according to aspect AA1, wherein the nozzle receiver includes a portion having an inner cylindrical space in which the container seal is arranged, the portion includes a plurality of convexes that come in contact with an outer circumference of the container seal and that are arranged along the outer circumference of the container seal, and an outer diameter of the container seal is greater than an inner diameter of a circle formed by the convexes.

Aspect AD1

The powder container according to aspect AA1, wherein the container shutter includes a front cylindrical portion that comes in contact with a sliding-contact surface of the container seal, and includes a slide area that is formed on a downstream side relative to the front cylindrical portion in the first moving direction and on outer side of the front cylindrical portion, a part of an outer circumference of the slide area serves as a contact surface that comes in surface-contact with an inner surface of the nozzle receiver along the inner surface.

Aspect AE1

The powder container according to aspect AA1, wherein the powder storage includes a rotary conveyor to convey powder contained in the powder container from one end in a rotation axis direction along with rotation of the powder container to other end where an opening is arranged.

Aspect AF1

The powder container according to aspect AA1, wherein the powder storage includes a conveyor to rotate relative to the powder storage, and conveys powder contained in the powder container from one end in a rotation axis direction along with rotation of the conveyor to other end where opening is arranged.

Aspect AG1

An image forming apparatus comprising:

a powder container according to any one of aspects AA1, AB1, AC1, AD1, AE1, and AF1;

a conveying nozzle to convey toner in the powder container to the image forming apparatus; and an image forming unit to form an image on an image bearer with the toner conveyed by the conveying nozzle.

According to at least one embodiment of the present invention, the cohesion preventing mechanism that prevents a powder cohesion from being formed along with rotation of the powder storage. Therefore, it becomes possible to reduce a load on the powder to the minimum, enabling to prevent a cohesion.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

REFERENCE SIGNS LIST

27 FEED ROLLER
28 REGISTRATION ROLLER PAIR
29 DISCHARGE ROLLER PAIR
30 STACK SECTION
32 (Y, M, C, K) TONER CONTAINER (POWDER CONTAINER)
33 (Y, M, C, K) CONTAINER BODY (POWDER STORAGE)
33*a* OPENING (CONTAINER OPENING)
34 (Y, M, C, K), 1034 CONTAINER FRONT END COVER (CONTAINER COVER)
34*a* GEAR EXPOSING HOLE
34*b* COLOR-SPECIFIC RIB (COLOR IDENTIFYING PROTRUSION)
41 (Y, M, C, K) PHOTOCONDUCTOR (IMAGE BEARER)
42 (Y, M, C, K) PHOTOCONDUCTOR CLEANING DEVICE
42*a* CLEANING BLADE
44 (Y, M, C, K) CHARGING ROLLER (CHARGING UNIT)
46 (Y, M, C, K) IMAGE FORMING SECTION
47 EXPOSING DEVICE (LATENT-IMAGE FORMING DEVICE)
48 INTERMEDIATE TRANSFER BELT (INTERMEDIATE TRANSFER MEDIUM)
49 (Y, M, C, K) PRIMARY-TRANSFER BIAS ROLLER
50 (Y, M, C, K) DEVELOPING DEVICE (DEVELOPING UNIT)
51 (Y, M, C, K) DEVELOPING ROLLER (DEVELOPER BEARER)
52 (Y, M, C, K) DOCTOR BLADE (DEVELOPER REGULATING PLATE)
53 (Y, M, C, K) FIRST DEVELOPER ACCOMMODATING PART
54 (Y, M, C, K) SECOND DEVELOPER ACCOMMODATING PART
55 (Y, M, C, K) DEVELOPER CONVEYING SCREW
56 (Y, M, C, K) TONER DENSITY SENSOR
60 (Y, M, C, K) TONER REPLENISHING DEVICE (POWDER REPLENISHING DEVICE)
64 (Y, M, C, K) TONER DROPPING PASSAGE
70 TONER CONTAINER HOLDER (CONTAINER HOLDING SECTION)
71 INSERTION HOLE PART
72 CONTAINER RECEIVING SECTION
73 CONTAINER COVER RECEIVING SECTION
82 SECONDARY-TRANSFER BACKUP ROLLER
85 INTERMEDIATE TRANSFER DEVICE
86 FIXING DEVICE
91 (Y, M, C, K) CONTAINER DRIVING SECTION
100 PRINTER
200 SHEET FEEDER
301 (Y, M, C, K) CONTAINER GEAR
302 SPIRAL RIB (ROTARY CONVEYOR)
303, 1303 GRIPPER
304 SCOOPING PORTION
304*h* CONVEX
304*f* SCOOPING WALL SURFACE
304*g* SCOOPING RIB
305 FRONT END OPENING

306 COVER HOOK STOPPER (COVER HOOK REGULATOR)
331, 1331 RECEIVING OPENING (NOZZLE INSERTION OPENING)
330, 1330 NOZZLE RECEIVER (NOZZLE INSERTION MEMBER)
332, 1332 CONTAINER SHUTTER (OPENING/CLOSING MEMBER)
332*a*, 1332*a* SHUTTER HOOK
332*c*, 1332*c* FRONT CYLINDRICAL PORTION (CLOSURE)
332*d* SLIDE AREA
332*e*, 2332*e*, 3332*e* GUIDING ROD
332*f* CANTILEVER
332*g*, 2332*g* FLAT GUIDING PORTION (COHESION PREVENTING MECHANISM)
332*h* END SURFACE OF CONTAINER SHUTTER
332*i* CYLINDRICAL PORTION
332*r* OUTER SURFACE OF FRONT CYLINDRICAL PORTION
332*t* INCLINED SURFACE
332*u* OUTER SURFACE OF SLIDE AREA
332*v* CONCAVE
333 CONTAINER SEAL (SEALING MEMBER)
333*a* INNER SURFACE (SLIDING-CONTACT SURFACE, INNER SURFACE OF NOZZLE INSERTION OPENING)
333*g* DOUBLE-SIDED TAPE
333*h* THROUGH HOLE (CIRCULAR PENETRATED PORTION)
335, 1335 SHUTTER REAR SUPPORTING PORTION (SHUTTER REAR PORTION)
335*a*, 1335*a* SHUTTER SIDE SUPPORTING PORTION (SHUTTER SIDE PORTION)
335*b*, 1335*b* OPENING OF SHUTTER SUPPORTING PORTION (SHUTTER SIDE OPENING)
335*d*, 1335*d*, 2335*d*, 3335*d* REAR END OPENING (THROUGH HOLE) (COHESION PREVENTING MECHANISM)
336, 1336 CONTAINER SHUTTER SPRING (BIASING MEMBER)
337 NOZZLE RECEIVER FIXING PORTION
337*a* NOZZLE SHUTTER POSITIONING RIB (ABUTTING PORTION) (CONVEX PORTION)
337*b* SEAL JAM PREVENTING SPACE
339 CONTAINER ENGAGED PORTION
339*a* GUIDING PROTRUSION
339*b* GUIDING GROOVE
339*c* BUMP
339*d* ENGAGED OPENING
340 CONTAINER SHUTTER SUPPORTER (SUPPORTING MEMBER)
342, 342B, 1342 PROTRUSION (COHESION PREVENTING MECHANISM)
350, 1350, 3501*b*, 3502*b* SEAL
350*a*, 1350*a*, 3501*a*, 3502*a* FRONT SURFACE OF SEAL
351 SHEET
361 SLIDING GUIDE
361*a* SLIDING GUTTER (SLIDING GROOVE)
400 SCANNER (SCANNER SECTION)
500 COPIER (IMAGE FORMING APPARATUS)
601 (Y, M, C, K) CONTAINER DRIVING GEAR
602 FRAME
603*a* WORM GEAR
604 DRIVE TRANSMITTING GEAR
607 NOZZLE HOLDER
608 (Y, M, C, K) SETTING COVER
609 REPLENISHING DEVICE ENGAGING MEMBER
610 NOZZLE HOLE
611 CONVEYING NOZZLE
611*a* FRONT END OF CONVEYING NOZZLE (END SURFACE)
612 NOZZLE SHUTTER (NOZZLE OPENING/CLOSING MEMBER)
612*a* NOZZLE SHUTTER FLANGE (ABUTTED PART, PROTRUSION OF NOZZLE OPENING/CLOSING MEMBER)
612*h* ANNULAR NOZZLE SHUTTER SEAL
612*f* BIASED SURFACE OF NOZZLE SHUTTER FLANGE
612*r* OUTER SURFACE OF NOZZLE SHUTTER
613 NOZZLE SHUTTER SPRING (BIASING MEMBER)
614 CONVEYING SCREW (MAIN BODY CONVEYOR)
615 CONTAINER SETTING SECTION
700 IC TAG (IC CHIP)
1035 REAR COVER (REAR CAP)
1035*a* REAR SIDE BEARING
1036 FRONT SIDE BEARING
1302 CONVEYING BLADE
1330*a* OUTER SURFACE OF NOZZLE RECEIVER
1330*b* CONVEYING BLADE HOLDER
1332*b* GUIDING PIECE
3331 FIRST LAYER (INNER LAYER)
3332 SECOND LAYER (OUTER LAYER)
3332*b* VERTICAL SURFACE (FRONT SURFACE)
G DEVELOPER
P RECORDING MEDIUM
R NON-CONTACT AREA
X HEIGHT OF PROTRUSION
T THICKNESS OF SEAL
T1 DEFORMATION AMOUNT OF SEAL
S1 CYLINDRICAL SPACE (SPACE BETWEEN SIDE SUPPORTING PORTIONS)
L A DIAMETER OF A VIRTUAL CIRCLE
D OUTER DIAMETER OF CONTAINER SEAL
Q1 FIRST MOVING DIRECTION
W1 INNER DIAMETER OF THROUGH HOLE
W2 OUTER DIAMETER OF NOZZLE SHUTTER
W3 OUTER DIAMETER OF CONTAINER SHUTTER

What is claimed is:

1. A nozzle receiver for use with a powder container, the nozzle receiver comprising:

a shutter to open an opening of the nozzle receiver to an open position when the shutter is pressed by a nozzle of an image forming apparatus, and to close the opening of the nozzle receiver to a closed position when not being pressed by the nozzle of the image forming apparatus;

a support to support the shutter between the open position and the closed position, the support including an end and an opening at the end of the support, the opening at the end of the support including a flat surface; and an elongated guide at the shutter and extending parallel to an axial length of the support, the elongated guide including a flat surface parallel to the axial length of the support, the elongated guide disposed within the opening at the end of the support, wherein when the shutter is at the open position, the flat surface of the elongated guide faces the flat surface of the opening at the end of the support.

2. The nozzle receiver according to claim 1, further comprising:

a biasing member, within the support, that biases the shutter toward the closed position, the biasing member being within the support.

3. A powder container comprising:

a powder storage to store therein powder and to convey the powder by a rotary conveyor inside the powder storage from one end in a rotation axis direction of the rotary conveyor to another end where an opening of the powder storage is located; and the nozzle receiver according to claim 1, wherein the nozzle receiver is attached to the powder storage.

4. An image forming apparatus comprising:

the powder container according to claim 3; and an image forming unit to form an image on an image bearer using the powder conveyed from the powder container.

5. The powder container according to claim 3, wherein the powder storage comprises toner.

6. The powder container according to claim 3, wherein the powder storage comprises developer including toner and carrier particles.

7. The powder container according to claim 3, wherein:

the powder storage comprises a gear whose rotation causes the rotary conveyor to move powder within the powder storage towards the opening thereof and causes the support of the nozzle receiver to rotate in a manner which corresponds to the rotation of the gear.

8. The nozzle receiver according to claim 1, wherein:

the support includes the opening of the nozzle receiver, and the opening of the nozzle receiver is integral with the end of the support which is opposite to the opening of the nozzle receiver.

9. The nozzle receiver according to claim 8, wherein:

the support guides the shutter between the open position and the closed position.

10. The nozzle receive according to claim 1, wherein:

a tip of the elongated guide is divided into two.

11. A nozzle receiver for use with a powder container, the nozzle receiver comprising:

a shutter to open an opening of the nozzle receiver to an open position when the shutter is pressed by a nozzle of an image forming apparatus, and to close the opening to a closed position when not being pressed by the nozzle of the image forming apparatus;

means for supporting the shutter between the open position and the closed position, the means for supporting including an end and an opening at the end of the means for supporting, the opening of the means for supporting including a flat surface;

means for biasing the shutter toward the closed position; and means for guiding the shutter relative to the opening of the means for supporting, the means for guiding including a flat surface parallel to an axial length of the means for supporting, wherein when the shutter is at the open position, the flat surface of the means for guiding faces the flat surface of the opening.

12. The nozzle receiver according to claim 11, wherein:

the means for biasing is within the support.

13. A powder container comprising:

a powder storage to store therein powder and to convey the powder by a rotary conveyor inside the powder storage from one end in a rotation axis direction of the rotary conveyor to another end where an opening is of the powder storage is located; and the nozzle receiver according to claim 11, wherein the nozzle receiver is attached to the powder storage.

14. An image forming apparatus comprising:

the powder container according to claim 13; and an image forming unit to form an image on an image bearer using the powder conveyed from the powder container.

15. The powder container according to claim 13, wherein the powder storage comprises toner.

16. The powder container according to claim 13, wherein the powder storage comprises developer including toner and carrier particles.

17. The powder container according to claim 13, wherein:

the powder storage comprises a gear whose rotation causes the rotary conveyor to move powder within the powder storage towards the opening thereof and causes the means for supporting of the nozzle receiver to rotate in a manner which corresponds to the rotation of the gear.

18. The nozzle receiver according to claim 11, wherein:

the means for supporting includes the opening of the nozzle receiver, and the opening of the nozzle receiver is integral with the end of the means for supporting which is opposite to the opening of the nozzle receiver.

19. The nozzle receiver according to claim 18, wherein:

the means for supporting guides the shutter between the open position and the closed position.

20. The nozzle receive according to claim 11, wherein:

a tip of the elongated means for guiding is divided into two.

* * * * *